US009956764B2

(12) United States Patent
Kyoso

(10) Patent No.: US 9,956,764 B2
(45) Date of Patent: May 1, 2018

(54) PATTERN FORMATION DEVICE, LIQUID EJECTION DEVICE, AND ELECTRICAL FAULT DETECTION METHOD

(71) Applicant: FUJIFILM Corporation, Tokyo (JP)

(72) Inventor: Tadashi Kyoso, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days. days.

(21) Appl. No.: 15/490,909

(22) Filed: Apr. 19, 2017

(65) Prior Publication Data

US 2017/0305145 A1 Oct. 26, 2017

(30) Foreign Application Priority Data

Apr. 21, 2016 (JP) ..... 2016-085550

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/04586
See application file for complete search history.

(56) References Cited

U.S. PATENT DOCUMENTS

| | | | | |
|---|---|---|---|---|
| 8,251,483 | B2 | 8/2012 | Menzel et al. | |
| 9,643,413 | B2 * | 5/2017 | Teraji | B41J 2/04586 |
| 2010/0207974 | A1 | 8/2010 | Menzel et al. | |
| 2013/0194325 | A1 * | 8/2013 | Teraji | B41J 2/175 347/6 |

FOREIGN PATENT DOCUMENTS

| | | |
|---|---|---|
| JP | 2008230222 | 10/2008 |
| JP | 2010241118 | 10/2010 |

* cited by examiner

*Primary Examiner* — Lamson Nguyen
(74) *Attorney, Agent, or Firm* — JCIPRNET

(57) ABSTRACT

A pattern formation device, a liquid ejection device, and an electrical fault detection method capable of detecting electrical fault of a liquid ejection head on the basis of an analysis result of an electrical fault detection pattern are provided. An electrical fault detection pattern having an arrangement of dot arrays satisfying an arrangement condition with an arrangement of a plurality of ejection elements in a liquid ejection head is formed by ejecting liquid from a liquid ejection head in which M rows of ejection element groups in which a plurality of ejection elements are arranged in a first direction are arranged in a second direction intersecting the first direction, and M is an integer equal to or greater than 2.

25 Claims, 33 Drawing Sheets

PATTERN FORMATION DEVICE, LIQUID EJECTION DEVICE, AND ELECTRICAL FAULT DETECTION METHOD

CROSS-REFERENCE TO RELATED APPLICATIONS

The present application claims priority under 35 U.S.C. § 119 to Japanese Patent Application No. 2016-085550, filed on Apr. 21, 2016. The above application is hereby expressly incorporated by reference, in its entirety, into the present application.

BACKGROUND OF THE INVENTION

1. Field of the Invention

The present invention relates to a pattern formation device, a liquid ejection device, and an electrical fault detection method and, more particular, to an electrical fault detection technology in a liquid ejection head.

2. Description of the Related Art

JP2010-241118A describes a liquid ejection device on which a liquid ejection head including a plurality of ejection elements is mounted. The liquid ejection device described in JP2010-241118A detects a short circuit between the ejection elements included in the liquid ejection head.

Electrical measurement such as capacitance measurement or leakage current measurement, or observation of wirings such as observation of wirings using an optical microscope or observation of an infrared image during application of electrical stimulation is applied to the detection of the short circuit between the ejection elements.

A term ejection element herein corresponds to the term liquid ejection unit in JP2010-241118A. A term liquid ejection head herein corresponds to the term print head disclosed in JP2010-241118A. A term liquid ejection device herein corresponds to the term liquid ejection device in JP2010-241118A.

JP2008-230222A describes a liquid ejection head including a detection electrode portion that is electrically connected to a driving electrode portion of an ejection element. In the liquid ejection head described in JP2008-230222A, in a detection mode, a detection driving voltage is applied to the driving electrode portion. If a detection voltage appears at the detection electrode portion, a detection signal is input from the detection electrode portion to a voltage detection circuit.

An electrical connection state of various components of the liquid ejection head is detected from the voltage appearing at the detection electrode portion using the voltage detection circuit. The term ejection element herein corresponds to a term piezoelectric unit in JP2008-230222A.

Further, a term liquid ejection head here corresponds to a term inkjet head disclosed in JP2008-230222A. A term detection used herein corresponds to a term inspection in JP2008-230222A.

SUMMARY OF THE INVENTION

In a case where electrical fault such as a short circuit between electrical wirings electrically connected to ejection elements occurs after a liquid ejection head is mounted on a liquid ejection device, it is possible to determine whether or not exchange of the liquid ejection head is required if a determination of whether or not electrical fault related to any of ejection elements occurs can be performed.

Further, since the ejection element in which electrical fault occurs is not used, continuous use can be realized without exchange of the liquid ejection head.

JP2010-241118A and JP2008-230222A do not describe or suggest detecting whether or not there is electrical fault on the basis of an analysis result of a pattern formed using a liquid ejection head.

The present invention has been made in view of such circumstances, and an object of the present invention is to provide a pattern formation device, a liquid ejection device, and an electrical fault detection method capable of detecting electrical fault of a liquid ejection head on the basis of an analysis result of an electrical fault detection pattern.

To achieve the above object, the following aspects of the invention are provided.

A pattern formation device according to a first aspect is a pattern formation device that forms, in a medium, an electrical fault detection pattern that is used when electrical fault of a liquid ejection head is detected, by ejecting liquid from the liquid ejection head in which M rows of ejection element groups in which a plurality of ejection elements are arranged in a first direction are arranged in a second direction intersecting the first direction, M being an integer equal to or greater than 2, the pattern formation device comprising: an ejection data acquisition unit that acquires ejection data of the electrical fault detection pattern when the electrical fault detection pattern is formed on a medium; and a driving voltage supply unit that supplies a driving voltage to each of the plurality of ejection elements on the basis of the ejection data acquired using the ejection data acquisition unit, in which the ejection data acquisition unit acquires ejection data of the electrical fault detection pattern including a first dot set in which a plurality of first dot arrays each including one or more dots formed by ejecting liquid from a plurality of respective ejection elements belonging to an ejection element group of a j-th row are arranged along a first dot set first axis, and a second dot set in which a plurality of second dot arrays each including one or more dots formed by ejecting liquid from a plurality of respective ejection elements belonging to an ejection element group of an i-th row are arranged along a second dot set first axis, i being an integer equal to greater than 2 and equal to or smaller than M and j being an integer smaller than i, equal to greater than 1 and equal to or smaller than M−1, an approximate straight line indicating an arrangement direction of the plurality of first dot arrays being the first dot set first axis, an axis orthogonal to the first dot set first axis being a first dot set second axis, a direction from the first dot set to the second dot set being a positive direction of the first dot set second axis, and a maximum value of a coordinate value of the first dot set second axis of the plurality of first dot arrays being a value smaller than a minimum value of the coordinate value of the first dot set second axis of the plurality of second dot arrays.

According to the first aspect, the electrical fault detection pattern in which an arrangement relationship between an arrangement of the ejection elements, and an arrangement of the first dot arrays and an arrangement of the second dot arrays satisfies a predetermined arrangement condition is formed. It is possible to detect electrical fault of the liquid ejection head on the basis of an analysis result of analysis of the electrical fault detection pattern.

The ejection element is a minimum unit that ejects liquid. A configuration example of the ejection element may include a configuration in which a nozzle unit that ejects liquid and a pressurizing element that pressurizes the liquid in the nozzle unit.

Further, a configuration example of the nozzle unit may include a configuration in which a nozzle opening, a pressure chamber, and a supply port that communicates with the pressure chamber are included.

An example of the electrical fault of the liquid ejection head may include a short circuit between the ejection elements, or a short circuit of at least one of an electrical wiring, an electrode, and an output terminal for a driving voltage electrically connected to each ejection element. Another example of the electrical fault of the liquid ejection head may include fault of a driving voltage supply circuit that supplies a driving voltage to each ejection element.

The first dot array belonging to the first dot set may include a dot array including a plurality of clots in the second direction. The second dot array belonging to the second clot set may include a dot array including a plurality of dots in the second direction.

In a second aspect, in the pattern formation device according to the first aspect, the ejection data acquisition unit may acquire ejection data of the electrical fault detection pattern in which the plurality of respective ejection elements belonging to the ejection element group of the j-th row form the same number of first dot arrays, and the plurality of respective ejection elements belonging to the ejection elements of the i-th row form the same number of second dot arrays.

According to the second aspect, it is possible to detect electrical fault of the liquid ejection head on the basis of whether or not a predetermined dot array number condition is satisfied.

In a third aspect, in the pattern formation device according to the first aspect or the second aspect, the driving voltage supply unit may supply a driving voltage for forming the electrical fault detection pattern to the plurality of ejection elements in a state in which relative conveyance of the liquid ejection head and the medium is stopped.

According to the third aspect, it is possible to detect electrical fault of the liquid ejection head based on an analysis result of the electrical fault detection pattern formed in a state in which relative conveyance between the liquid ejection head and the medium is stopped.

In the third aspect, in a case where there are dots having a larger area than other dots among the dots constituting the electrical fault detection pattern, it is possible to determine that at least one of a short circuit between the plurality of ejection elements and a short circuit between the electrical wirings electrically connected to the plurality of respective ejection elements has occurred.

In the third aspect, in a case where dots to be originally formed are not formed, it is possible to determine that at least one of fault of the driving circuit that supplies the driving voltage to the ejection element and opening of the electrical wiring occurs.

In a fourth aspect, in the pattern formation device according to the first aspect or the second aspect, the driving voltage supply unit may supply a driving voltage for forming the electrical fault detection pattern to the plurality of ejection elements in a state in which the liquid ejection head and the medium are conveyed relatively in a relative conveyance direction.

According to the fourth aspect, it is possible to detect electrical fault of the liquid ejection head based on an analysis result of the electrical fault detection pattern formed in a state in which the liquid ejection head and the medium are relatively conveyed in the relative conveyance direction.

In the electrical fault detection pattern, the dot array including one or more dots arranged at adjacent positions at which a dot can be formed, in the relative conveyance direction may be used.

In the fourth aspect, in a case where an arrangement relationship between the arrangement of the first dot array constituting the electrical fault detection pattern and the arrangement of the second dot array, and the arrangement of the plurality of ejection elements belonging to the ejection element group of the j-th row and the plurality of ejection elements belonging to the ejection element group of the i-th row does not satisfy the predetermined arrangement condition, it can be determined that electrical fault of the liquid ejection head occurs.

In a fifth aspect, in the pattern formation device of the fourth aspect, the ejection data acquisition unit may acquire ejection data of the electrical fault detection pattern in which an arrangement interval of the dots formed using ejection elements that are arranged at positions adjacent to each other in the first direction or ejection elements that are arranged at positions adjacent to each other in an oblique direction obliquely intersecting the first direction is equal to or larger than a distance corresponding to a period of two ejection cycles.

According to the fifth aspect, it is possible to separate and arrange the dot arrays formed using two ejection elements suspected of a short circuit, and it is easy to determine whether or not an arrangement relationship between the arrangement of the first dot arrays and the arrangement of the second dot arrays constituting the electrical fault detection pattern, and the arrangement of the plurality of ejection elements belonging to the ejection element group of the j-th row and the arrangement of the plurality of ejection elements belonging to the ejection element group of the i-th row satisfies the predetermined arrangement condition.

In a sixth aspect, in the pattern formation device according to the fourth aspect or the fifth aspect, the ejection data acquisition unit may acquire ejection data of the electrical fault detection pattern in which an arrangement interval in the relative conveyance direction of the first dot set and the second dot set exceeds an arrangement interval of the ejection elements in the first direction.

According to the sixth aspect, it is possible to separate the dot array formed using the ejection element of the j-th row and the dot array formed using the ejection element of the i-th row, and it is possible to form the electrical fault detection pattern in which the physical arrangement of the ejection elements in the second direction of the dot array formed using the ejection element of the j-th row and the dot array formed using the ejection element of the i-th row is emphasized.

Since the electrical fault detection pattern in which the physical arrangement of the ejection elements in the second direction is emphasized, it is easy to determine whether or not an arrangement relationship between the arrangement of the first dot arrays and the arrangement of the second dot arrays constituting the electrical fault detection pattern, and the arrangement of the plurality of ejection elements belonging to the ejection element group of the j-th row and the arrangement of the plurality of ejection elements belonging to the ejection element group of the i-th row satisfies the predetermined arrangement condition.

In a seventh aspect, in the pattern formation device according to any one of the fourth to sixth aspects, the ejection data acquisition unit may acquire ejection data of the electrical fault detection pattern including an auxiliary pattern formed on at least one of the upstream side in the relative conveyance direction and the downstream side in the relative conveyance direction for at least one of a plurality of patterns constituting the first dot set and the second clot set.

According to the seventh aspect, it is easy to recognize a correspondence relationship between the ejection elements used for formation of the first dot array and the second dot array, and the first dot array and the second dot array.

In an eighth aspect, in the pattern formation device of the seventh aspect, the ejection data acquisition unit may acquire the ejection data of the electrical fault detection pattern including the auxiliary pattern that is formed at a position thinned out in the first direction.

According to the eighth aspect, it is easy to distinguish between the first dot array and the second dot array used for electrical fault detection and the auxiliary pattern.

In a ninth aspect, in the pattern formation device according to the seventh aspect or the eighth aspect, the ejection data acquisition unit may acquire the ejection data of the electrical fault detection pattern including the auxiliary pattern that includes dots having a diameter smaller than a diameter of dots constituting the first dot set and the second dot set.

According to the ninth aspect, it is easy to distinguish between the first dot array and the second dot array used for electrical fault detection and the auxiliary pattern.

In a tenth aspect, in the pattern formation device according to any one of the seventh to ninth aspects, the ejection data acquisition unit may acquire the ejection data of the electrical fault detection pattern including the auxiliary pattern that includes dots having a concentration lower than a concentration of dots constituting the first dot set and the second dot set.

According to the tenth aspect, it is easy to distinguish between the first dot array and the second dot array used for electrical fault detection and the auxiliary pattern.

In an eleventh aspect, in the pattern formation device according to any one of the seventh to tenth aspects, the ejection data acquisition unit may acquire the ejection data of the electrical fault detection pattern including the auxiliary pattern of which a length in the relative conveyance direction is regularly changed.

According to the eleventh aspect, it is easy to recognize a correspondence relationship between the ejection elements used for formation of the first dot array and the second dot array, and the first dot array and the second dot array.

In a twelfth aspect, in the pattern formation device of the eleventh aspect, the ejection data acquisition unit may acquire the ejection data of the electrical fault detection pattern including the auxiliary pattern that indicates an identification number of the plurality of ejection elements.

According to the twelfth aspect, it is easy to recognize a correspondence relationship between the ejection elements used for formation of the first dot array and the second dot array, and the first dot array and the second dot array.

In the twelfth aspect, an aspect in which an auxiliary pattern including the same number of dots as the numerical value of one place of the identification number of the ejection element is formed can be realized.

In a thirteenth aspect, in the pattern formation device according to any one of the fourth to twelfth aspects, the ejection data acquisition unit may acquire ejection data of the electrical fault detection pattern in which the ejection element in which ejection abnormality occurs is not used.

According to the thirteenth aspect, it is easy to distinguish between abnormality of an ejection state of the ejection element and electrical fault of the liquid ejection head.

A liquid ejection device of a fourteenth aspect is a liquid ejection device, comprising: a liquid ejection head in which M rows of ejection element groups in which a plurality of ejection elements are arranged in a first direction are arranged in a second direction intersecting the first direction, M being an integer equal to or greater than 2; a relative conveyance unit that relatively conveys the liquid ejection head and a medium in a relative conveyance direction; an ejection data acquisition unit that acquires ejection data of an electrical fault detection pattern when liquid is ejected from the plurality of ejection elements and the electrical fault detection pattern for detecting electrical fault of the liquid ejection head is formed on a medium; and a driving voltage supply unit that supplies a driving voltage to each of the plurality of ejection elements on the basis of the ejection data acquired using the ejection data acquisition unit, in which the ejection data acquisition unit acquires ejection data of the electrical fault detection pattern including a first dot set in which a plurality of first dot arrays each including one or more dots formed by ejecting liquid from a plurality of respective ejection elements belonging to an ejection element group of a j-th row are arranged along a first dot set first axis, and a second dot set in which a plurality of second dot arrays each including one or more dots formed by ejecting liquid from a plurality of respective ejection elements belonging to an ejection element group of an i-th row are arranged along a second dot set first axis, i being an integer equal to greater than 2 and equal to or smaller than M and j being an integer smaller than i, equal to greater than 1 and equal to or smaller than M-1, an approximate straight line indicating an arrangement direction of the plurality of first dot arrays being the first dot set first axis, an axis orthogonal to the first dot set first axis being a first dot set second axis, a direction from the first dot set to the second dot set being a positive direction of the first dot set second axis, and for the first dot set second axis, a maximum value of a coordinate value of the first dot set second axis of the plurality of first dot arrays being a value smaller than a minimum value of the coordinate value of the first dot set second axis of the plurality of second dot arrays.

According to the fourteenth aspect, it is possible to obtain the same effects as those in the first aspect.

In the fourteenth aspect, it is possible to appropriately combine the same matters as those specified in the second to thirteen aspects. In this case, a component responsible for a process or a function specified in the pattern formation device can be recognized as a component of the liquid ejection device responsible for a process or a function corresponding thereto.

In a fifteenth aspect, in the liquid ejection device according to the fourteenth aspect, the ejection data acquisition unit may acquire ejection data of the electrical fault detection pattern in which the plurality of respective ejection elements belonging to the ejection element group of the j-th row form the same number of first dot arrays, and the plurality of respective ejection elements belonging to the ejection elements of the i-th row form the same number of second dot arrays.

According to the fifteenth aspect, it is possible to obtain the same effects as those in the second aspect.

In a sixteenth aspect, the liquid ejection device according to the fourteenth aspect or the fifteenth aspect may further comprise one or more liquid ejection heads for each of a plurality of colors, in which the ejection data acquisition unit may acquire ejection data of the electrical fault detection pattern including an auxiliary pattern formed on at least one of the upstream side in the relative conveyance direction and the downstream side in the relative conveyance direction for at least one of a plurality of patterns constituting the first dot set and the second dot set, the ejection data of the electrical fault detection pattern being ejection data of the electrical fault detection pattern including the auxiliary pattern in which color different from those of the first dot set and the second dot set is used.

According to the sixteenth aspect, it is easy to distinguish between the first dot array and the second dot array used for electrical fault detection and the auxiliary pattern.

In a seventeenth aspect, the liquid ejection device according to any one of the fourteenth to sixteenth aspects may further comprise a head movement unit that changes a distance between the liquid ejection head and the medium supported by the relative conveyance unit, in which when the electrical fault detection pattern is formed, the head movement unit may cause an interval between the liquid ejection head and the medium to be shorter than that in a case where normal liquid ejection is performed.

According to the seventeenth aspect, since a variation in a landing position of liquid due to a variation in the ejection state of each ejection element is suppressed, it is possible to prevent a variation in the ejection state of each ejection element from being determined to be electrical fault.

In an eighteenth aspect, in the liquid ejection device of any one aspect of the fourteenth to seventeenth aspects, the liquid ejection head may have a structure in which the plurality of ejection elements are arranged in a two-dimensional form.

According to the eighteenth aspect, it is possible to detect electrical fault of the liquid ejection head in which a plurality of ejection elements are arranged in a two-dimensional form.

In a nineteenth aspect, in the liquid ejection device according to any one of the fourteenth to eighteenth aspects, the ejection data acquisition unit may acquire ejection data of the electrical fault detection pattern for forming the electrical fault detection pattern using all of the ejection elements included in the liquid ejection head.

According to the nineteenth aspect, it is possible to determine whether or not there is electrical fault for all of the plurality of ejection elements.

In a twentieth aspect, in the liquid ejection device of any one of the fourteenth to nineteenth aspects, two or more ejection elements may be arranged at the same position in the first direction in the liquid ejection head.

According to the twentieth aspect, it is possible to determine whether or not there is electrical fault for the liquid ejection head in which two or more ejection elements are arranged at the same position in the first direction.

A electrical fault detection method according to a twenty-first aspect is an electrical fault detection method of detecting electrical fault of a liquid ejection head in which M rows of ejection element groups in which a plurality of ejection elements are arranged in a first direction are arranged in a second direction intersecting the first direction, M being an integer equal to or greater than 2, the method comprising: an ejection data acquisition step of acquiring ejection data of an electrical fault detection pattern when the electrical fault detection pattern that is used when electrical fault of the liquid ejection head is detected is formed on a medium; a driving voltage supply step of supplying a driving voltage to each of the plurality of ejection elements on the basis of the ejection data acquired in the ejection data acquisition step; and a determination step of analyzing the electrical fault detection pattern formed on the medium and determining whether or not there is electrical fault of the liquid ejection head, in which the ejection data acquisition step includes acquiring ejection data of the electrical fault detection pattern including a first dot set in which a plurality of first dot arrays each including one or more dots formed by ejecting liquid from a plurality of respective ejection elements belonging to an ejection element group of a j-th row are arranged along a first dot set first axis, and a second dot set in which a plurality of second dot arrays each including one or more dots formed by ejecting liquid from a plurality of respective ejection elements belonging to an ejection element group of an i-th row are arranged along a second dot set first axis, i being an integer equal to greater than 2 and equal to or smaller than M and j being an integer smaller than i, equal to greater than 1 and equal to or smaller than M−1, an arrangement direction of the plurality of first dot arrays being the first dot set first axis, an axis orthogonal to the first dot set first axis being a first dot set second axis, a direction from the first dot set to the second dot set being a positive direction of the first dot set second axis, and for the first dot set second axis, a maximum value of a coordinate value of the first dot set second axis of the plurality of first dot arrays being a value smaller than a minimum value of the coordinate value of the first dot set second axis of dots constituting the plurality of second dot arrays.

According to the twenty-first aspect, it is possible to obtain the same effects as in the first aspect.

In the twenty-first aspect, it is possible to appropriately combine the same matters as the matters specified in the second to thirteenth aspects and the fifteenth to twentieth aspects. In this case, a component responsible for a process or a function specified in the pattern formation device or the liquid ejection device can be recognized as a component of the an electrical fault detection method responsible for a process or a function corresponding thereto.

In a twenty-second aspect, in the electrical fault detection method according to the twenty-first aspect, the ejection data acquisition step may include acquiring ejection data of the electrical fault detection pattern in which the plurality of respective ejection elements belonging to the ejection element group of the j-th row form the same number of first clot arrays, and the plurality of respective ejection elements belonging to the ejection elements of the i-th row form the same number of second dot arrays.

According to twenty-second aspect, it is possible to obtain the same effects as in the second embodiment.

In a twenty-third aspect, in the electrical fault detection method according to the twenty-first aspect or the twenty-second aspect, the driving voltage supply step may include supplying a driving voltage for forming the electrical fault detection pattern to the plurality of ejection elements in a state in which relative conveyance of the liquid ejection head and the medium is stopped, and the determination step may include determining whether or not there is electrical fault of the liquid ejection head on the basis of areas of the dots in the electrical fault detection pattern.

According to the twenty-third aspect, in a case where the relative conveyance between the liquid ejection head and the medium is stopped, it is possible to determine whether or not there is electrical fault of the liquid ejection head on the basis of the area of the dots in the electrical fault detection pattern.

In a twenty-fourth aspect, in the electrical fault detection method according to the twenty-first aspect or the twenty-second aspect, the driving voltage supply step may include supplying a driving voltage for forming the electrical fault detection pattern to the plurality of ejection elements in a state in which the liquid ejection head and the medium are conveyed relatively in a relative conveyance direction, and the determination step may include determining whether or not there is electrical fault of the liquid ejection head on the basis of whether or not an arrangement relationship among an arrangement of the first dot arrays, an arrangement of the second dot arrays, an arrangement of the plurality of ejection elements belonging to the ejection element group of the j-th row, and an arrangement of the plurality of ejection elements belonging to the ejection element group of the i-th row satisfies a predetermined arrangement condition.

According to the twenty-fourth aspect, it is possible to determine whether or not there is electrical fault in the liquid ejection head on the basis of whether or not the predetermined arrangement condition is satisfied in a case where the liquid ejection head and the medium are relatively conveyed in the relative conveyance direction.

In a twenty-fifth aspect, in the electrical fault detection method of the twenty-fourth aspect, the determination step may include determining whether or not there is electrical fault of the liquid ejection head on the basis of at least one of whether or not the number of the first dot arrays formed by the plurality of respective ejection elements belonging to the ejection element group of the j-th row satisfies a predetermined dot array number condition and whether or not the number of the second dot arrays formed by the plurality of respective ejection elements belonging to the ejection element group of the i-th row satisfies a predetermined dot array number condition.

According to the twenty-fifth aspect, it is possible to determine whether or not there is electrical fault in the liquid ejection head on the basis of the predetermined dot array number condition in a case where the liquid ejection head and the medium are relatively conveyed in the relative conveyance direction.

According to the present invention, the electrical fault detection pattern in which an arrangement relationship between an arrangement of the ejection elements, and an arrangement of the first dot arrays and an arrangement of the second dot arrays satisfies a predetermined arrangement condition is formed. It is possible to detect electrical fault of the liquid ejection head on the basis of an analysis result of analysis of the electrical fault detection pattern.

DESCRIPTION OF THE PREFERRED EMBODIMENTS

Hereinafter, preferred embodiments of the present invention will be described in detail with reference to the accompanying drawings. In the present specification, configurations that have been already described are denoted with the same reference signs, and description thereof is appropriately omitted.

[Description of Liquid Ejection Device]

<Overall Configuration>

Figure 1:
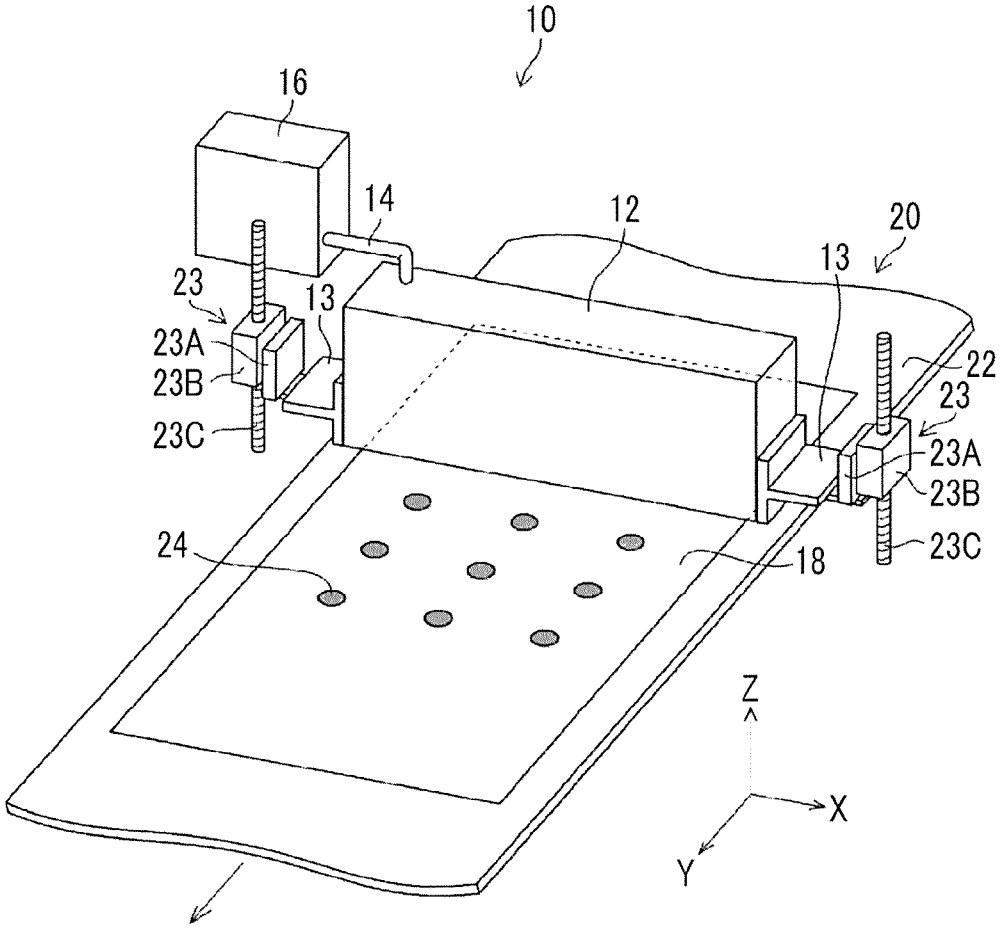
FIG. 1 is an overall configuration diagram of a liquid ejection device.

FIG. 1 is an overall configuration diagram of a liquid ejection device. The inkjet recording device 10 illustrated in FIG. 1 includes an inkjet head 12 including a plurality of ejection elements. Ink is supplied from an ink tank 16 to the inkjet head 12 through a tube 14. The ejection element is not illustrated in FIG. 1.

Figure 4:
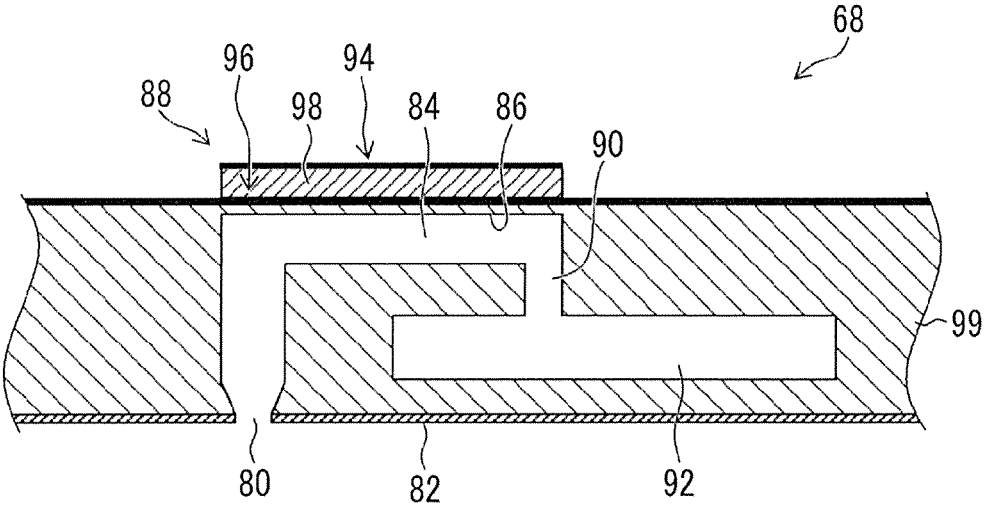
FIG. 4 is a cross-sectional view illustrating a configuration example of an ejection element.

The ejection element is denoted with a reference sign 68 and illustrated in FIG. 4. Hereinafter, unless otherwise mentioned, the term ejection element indicates the ejection element 68 illustrated in FIG. 4. The inkjet head 12 is an aspect of a liquid ejection head. The ink is an aspect of the liquid.

The inkjet recording device 10 illustrated in FIG. 1 includes a sheet conveyance unit 20 that conveys a sheet 18. The sheet conveyance unit 20 illustrated in FIG. 1 includes a conveyance belt 22 that supports a back surface of the sheet 18. The sheet 18 is an aspect of a medium.

The conveyance belt 22 has an endless shape and is wound around two rollers. In the conveyance belt 22, a plurality of suction holes are provided in a sheet support area that supports the sheet 18. The two rollers around which the conveyance belt 22 is wound, and a plurality of suction holes are not illustrated.

In FIG. 1, a sheet width direction is indicated by a reference sign X. Further, a sheet conveyance direction is indicated by a reference sign Y. Further, an upward direction is indicated by a reference sign Z. The sheet width direction is a direction orthogonal to the sheet conveyance direction.

The sheet conveyance direction is a direction in which the sheet 18 is conveyed using the sheet conveyance unit 20. The upward direction is a direction opposite to a gravity direction. In a case where the sheet width direction and the sheet conveyance direction are directions parallel to a horizontal direction, the upward direction is orthogonal to both of the sheet width direction and the sheet conveyance direction.

The term orthogonal or perpendicular herein includes substantially orthogonal or vertical that achieves the same operation and effects as in the case of intersection at 90° in the case of intersection at an angle exceeding 90° or the case of intersection at an angle smaller than 90°.

Further, the term parallel herein includes substantially parallel, in which two directions are not parallel, but the same operation and effects as parallel are achieved. Further, the term the same herein includes substantial the same, in which there is a difference and the same operation and effects as the same can be obtained.

In this embodiment, as an example of the relative conveyance unit that relatively conveys the inkjet head 12 and the sheet 18, an aspect in which the sheet conveyance unit 20 that conveys the sheet 18 relatively to the fixedly arranged inkjet head 12 is applied is illustrated. An arrow line not denoted with a reference sign in FIG. 1 indicates a traveling direction of the conveyance belt 22 that is a conveyance direction of the sheet 18.

For the relative conveyance unit that relatively conveys the inkjet head 12 and the sheet 18, a head movement unit (not illustrated) that moves the inkjet head 12 relatively to the fixedly arranged sheet 18 may be applied. Further, the inkjet head 12 may be moved using the head movement unit (not illustrated), and the sheet 18 may be conveyed using the sheet conveyance unit 20.

The inkjet recording device 10 illustrated in FIG. 1 includes a head lifting and lowering unit 23. The head lifting and lowering unit 23 includes head support members 23A that supports lifting and lowering support members 13 attached to both ends of the inkjet head 12 in the sheet width direction, and actuators 23B connected to the head support members 23A.

The actuator 23B includes a driving member 23C, and a driving source of the driving member. The driving source is not illustrated. An example of the driving member includes a ball screw. An example of the driving source includes a motor. As the actuator 23B, a linear motor in which a driving mechanism and a driving source are integrated can be applied.

In an aspect in which a plurality of inkjet heads 12 are included, the head lifting and lowering unit 23 may be included in each of the plurality of inkjet heads 12. Further, the head lifting and lowering unit 23 may collectively lift or lower the plurality of inkjet heads 12.

A rising direction of the inkjet head 12 is the upward direction denoted with the reference sign Z in FIG. 1. The rising direction of the inkjet head 12 may be an oblique upward direction intersecting the upward direction denoted with the reference sign Z in FIG. 1.

A lowering direction of the inkjet head 12 is a downward direction opposite to the upward direction denoted with the reference sign Z in FIG. 1. The lowering direction of the inkjet head 12 may be an oblique downward direction intersecting the downward direction opposite to the upward direction denoted with the reference sign Z in FIG. 1.

An example in which the inkjet head 12 illustrated in FIG. 1 is lifted or lowered includes an example in which a position of the inkjet head 12 in a vertical direction in a case where the normal drawing is performed is used as a drawing position, and the inkjet head 12 is lowered from the drawing position and moved to an electrical fault detection pattern formation position in a downward direction relative to the drawing position in a case in which an electrical fault detection pattern is formed.

The inkjet head 12 illustrated in FIG. 1 is a line-type liquid ejection head in which a plurality of ejection elements are arranged over a length equal to or larger than a total length of the sheet 18 in the sheet width direction.

Dots 24 using ink ejected from the inkjet head 12 are formed in the sheet 18 illustrated in FIG. 1.

<Control System>

Figure 2:
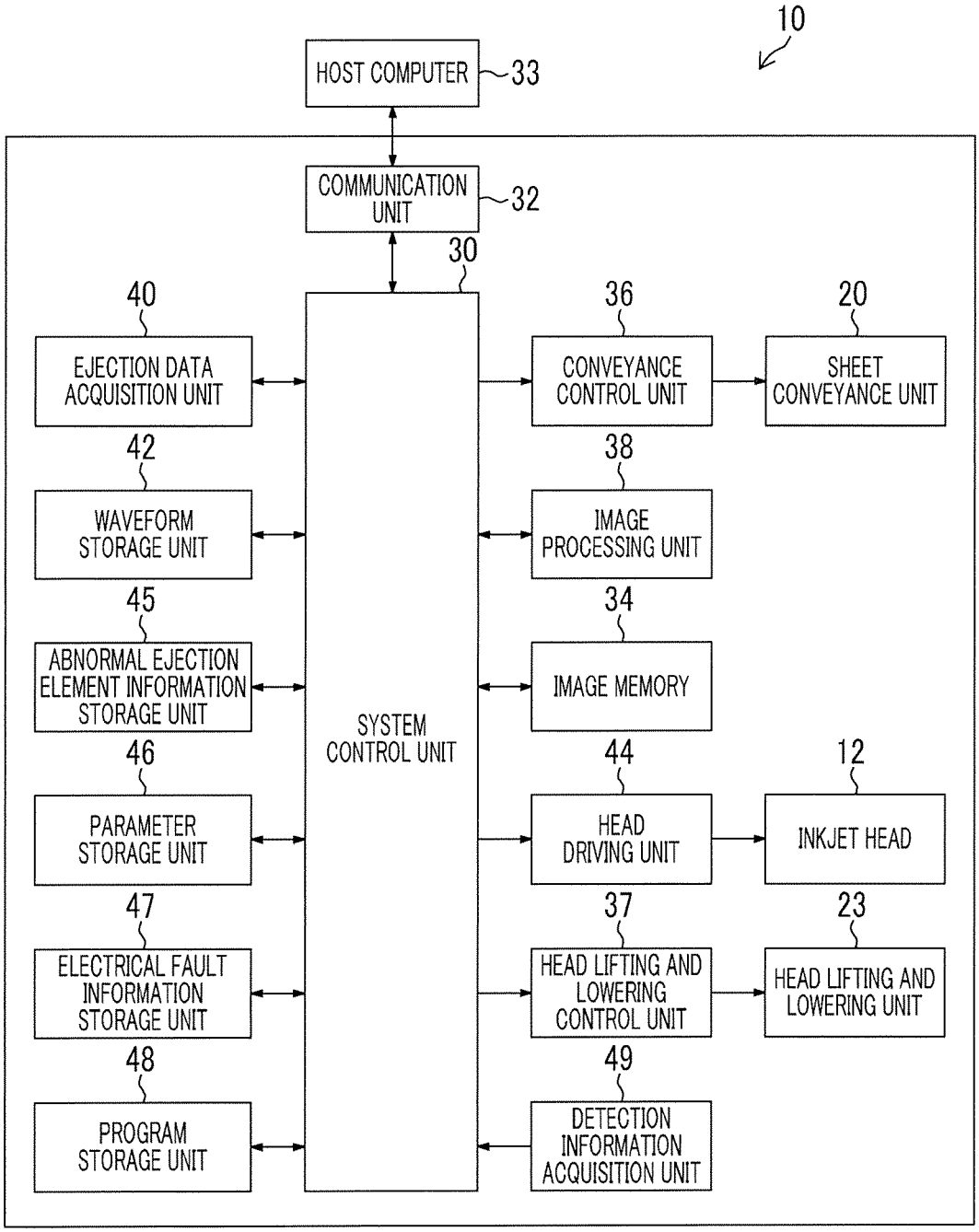
FIG. 2 is a block diagram illustrating a schematic configuration of a control system.

FIG. 2 is a block diagram illustrating a schematic configuration of a control system. The inkjet recording device 10 illustrated in FIG. 2 includes a system control unit 30.

For the system control unit 30, a configuration in which a CPU, a ROM, and a RAM are included can be applied. Further, the CPU is an abbreviation of central processing unit. The ROM is an abbreviation of read only memory. The RAM is an abbreviation of random access memory.

The system control unit 30 functions as a general control unit that generally controls respective units of the inkjet recording device 10. The system control unit 30 functions as a calculation unit that performs various calculations.

Further, the system control unit 30 functions as a memory controller that controls writing of data to a storage device included in the inkjet recording device 10 and reading of data from the storage device.

The inkjet recording device 10 illustrated in FIG. 2 includes a communication unit 32. The communication unit 32 includes a communication interface (not illustrated). The communication unit 32 can perform transmission and reception of data to and from a host computer 33 connected to the communication interface.

An image memory 34 functions as a temporary storage unit of various types of data including input image data. Data is written or read to or from the image memory 34 via the system control unit 30. Image data acquired from the host computer 33 via the communication unit 32 is temporarily stored in the image memory 34.

The inkjet recording device 10 illustrated in FIG. 2 includes a conveyance control unit 36. The conveyance control unit 36 controls an operation of the sheet conveyance unit 20. The conveyance control unit 36 controls conveyance start of the sheet 18 illustrated in FIG. 1, conveyance stop of the sheet 18, and a conveyance speed of the sheet 18.

The inkjet recording device 10 illustrated in FIG. 2 includes a head lifting and lowering control unit 37. The head lifting and lowering control unit 37 controls an operation of the head lifting and lowering unit 23. The head lifting and lowering control unit 37 controls lifting and lowering start of the inkjet head using the head lifting and lowering unit 23, lifting and lowering stop of the inkjet head, and a lifting and lowering speed of the inkjet head.

The inkjet recording device 10 illustrated in FIG. 2 includes an image processing unit 38. The image processing unit 38 performs a color separation process, a color conversion process, a correction process, and halftone processing on the input image data acquired via the communication unit 32 to generate dot data.

That is, the image processing unit 38 includes a color separation processing unit, a color conversion processing unit, a correction processing unit, and a halftone processing unit. The color separation processing unit, the color conversion processing unit, the correction processing unit, and the halftone processing unit are not illustrated.

In the color separation processing unit, a color separation process is performed on the input image data. For example, in a case where the input image data is represented in RGB, the input image data is separated into data for each of colors R, G, and B. Here, R represents red. G represents green. B represents blue.

In the color conversion processing unit, image data for each color separated into to R, G, and B is converted into C, M, Y, and K corresponding to ink colors. Here, C represents cyan, M represents magenta. Y represents yellow. K represents the black.

In the correction processing unit, a correction process is performed on the image data for each color converted into C, M, Y, and K. Examples of the correction process include a gamma correction process, a concentration non-uniformity correction process, an abnormal recording element correction process, and the like.

In the halftone processing unit, for example, image data represented in a multi-gradation number such as 0 to 255 is converted into dot data represented by a two-value or a multi-value equal to or greater than three-value which is smaller than the number of gradations of input image data.

For the halftone processing unit, a predetermined halftone processing rule is applied. An example of the halftone processing rule includes a dither method, an error diffusion method, or the like. The halftone processing rule may be changed according to an image recording condition, content of the image data, or the like.

The inkjet recording device 10 illustrated in FIG. 2 includes an ejection data acquisition unit 40, a waveform storage unit 42, and a head driving unit 44.

The ejection data acquisition unit 40 acquires ejection data of an electrical fault detection pattern that is used at the time of electrical fault detection of the inkjet head 12 illustrated in FIG. 1. The ejection data acquisition unit 40 illustrated in FIG. 2 can acquire the ejection data of the electrical fault detection pattern generated in the outside of the device.

The ejection data acquisition unit 40 can acquire the ejection data of the electrical fault detection pattern generated by an ejection data generation unit (not illustrated). The electrical fault of the inkjet head 12 includes fault of a wiring member via which a driving voltage that is supplied to the inkjet head 12 is transferred, and a fault of an electrical circuit that generates a driving voltage.

The waveform storage unit 42 stores a driving waveform that is a waveform of the driving voltage that is supplied to the ejection elements included in the inkjet head 12 illustrated in FIG. 1. The driving waveform stored in the waveform storage unit 42 illustrated in FIG. 2 may be a driving waveform generated in the outside of the device or may be a driving waveform generated using a driving waveform generating unit (not illustrated).

The head driving unit 44 serves as a driving voltage generation unit that generates a driving voltage that is supplied to each of the plurality of ejection elements included in the inkjet head 12. The head driving unit 44 functions as a driving voltage supply unit that supplies the driving voltage to each of the plurality of ejection elements included in the inkjet head 12.

The head driving unit 44 generates a driving voltage for electrical fault detection pattern generation on the basis of the ejection data of the electrical fault detection pattern acquired using the ejection data acquisition unit 40 at the time of detection of electrical fault of the inkjet head 12 illustrated in FIG. 1.

The head driving unit 44 supplies the driving voltage for electrical fault detection pattern generation to the ejection elements included in the inkjet head 12 illustrated in FIG. 1.

The inkjet recording device 10 illustrated in FIG. 2 includes an abnormal ejection element information storage unit 45. An example of the abnormal ejection element includes an ejection element incapable of ejecting ink or an ejection element that ejects a too small or large volume of ink.

The abnormal ejection element information storage unit 45 stores identification information of the abnormal ejection element. The identification information of the abnormal ejection element includes identification number assigned to each ejection element. The identification information of the abnormal ejection element stored in the abnormal ejection element information storage unit 45 is used for image processing in the image processing unit 38, and electrical fault detection pattern generation.

The inkjet recording device 10 illustrated in FIG. 2 includes a parameter storage unit 46, and a program storage unit 48.

The parameter storage unit 46 stores various parameters that are used in the inkjet recording device 10. The various parameters stored in the parameter storage unit 46 are read via the system control unit 30 and set to the respective units.

The program storage unit 48 stores programs used in the respective units of the inkjet recording device 10. Various programs stored in the program storage unit 48 are read via the system control unit 30 and executed in the respective units of the device.

The inkjet recording device 10 illustrated FIG. 2 includes an electrical fault information storage unit 47. The electrical fault information storage unit 47 stores the identification information of the ejection element in which the electrical fault detected in electrical fault detection has occurred.

The inkjet recording device 10 illustrated in FIG. 2 includes a detection information acquisition unit 49. The detection information acquisition unit 49 acquires detection information in the electrical fault detection. Known data communication can be applied to the acquisition of the detection information in the electrical fault detection.

Examples of the known data communication may include wired data communication, and wireless data communication. In the acquisition of the detection information in the electrical fault detection, an aspect in which the detection information is read from the storage device that stores the detection information is also possible.

Further, the respective units are listed according to functions in FIG. 2. The respective units illustrated in FIG. 2 can be appropriated integrated, separated, combined, or omitted. Further, the respective units illustrated in FIG. 2 can be configured in appropriate combination of hardware and software.

<Description of Head Driving Unit>

Figure 3:
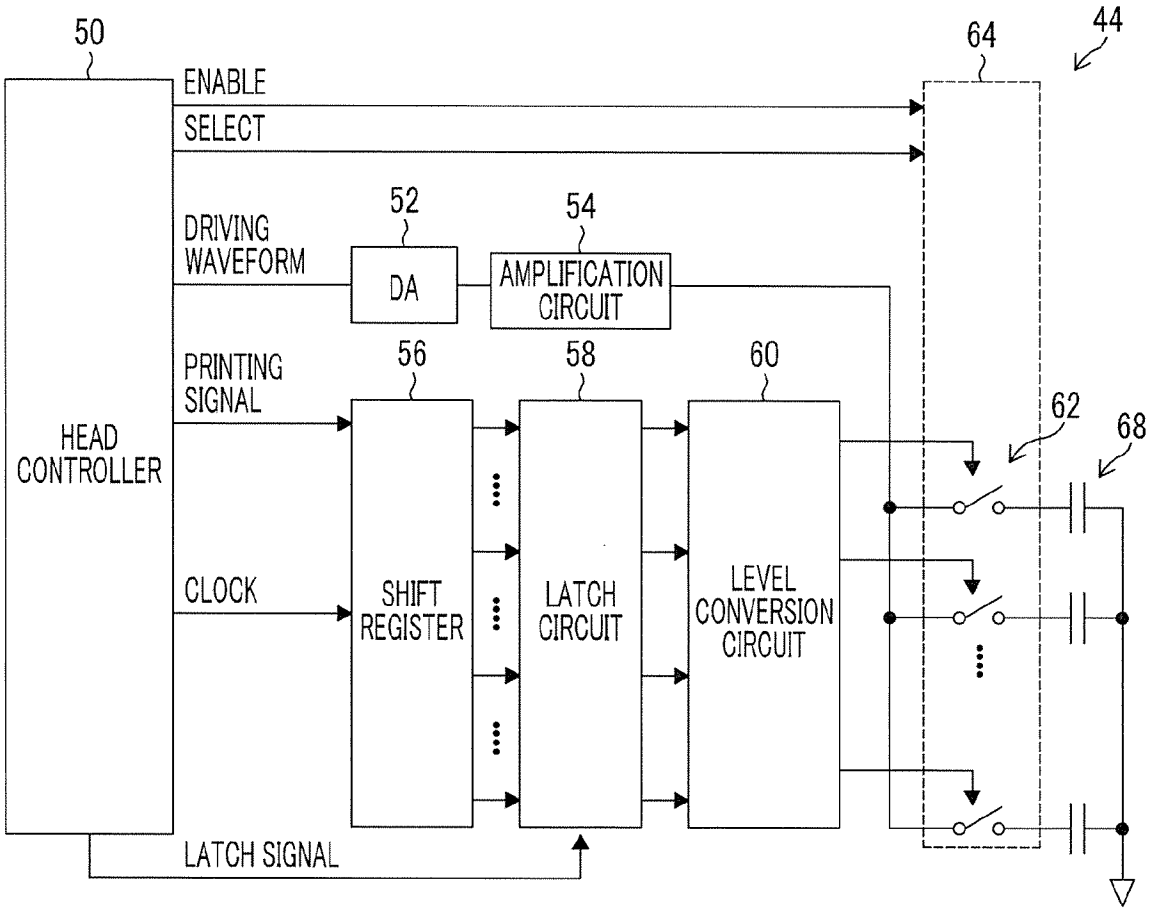
FIG. 3 is a block diagram illustrating a schematic configuration of a head driving unit.

FIG. 3 is a block diagram illustrating a schematic configuration of the head driving unit. The head driving unit 44 illustrated in FIG. 3 includes a head controller 50, a digital-to-analog conversion circuit 52, an amplification circuit 54, a shift register 56, a latch circuit 58, and a level conversion circuit 60. D of DA of the digital-to-analog conversion circuit 52 illustrated in FIG. 3 represents digital. Further, A of DA represents analog.

The head controller 50 reads the driving waveform stored in the waveform storage unit 42 illustrated in FIG. 2, and sends a digital signal indicating the driving waveform to the digital-to-analog conversion circuit 52.

The digital-to-analog conversion circuit 52 converts the driving waveform of the digital signal to a driving waveform of an analog signal. The driving waveform converted into the analog signal is sent to the amplification circuit 54.

The amplification circuit 54 voltage-amplifies and current amplifies the driving waveform in an analog format to generate a driving voltage. The driving voltage generated through the voltage amplification and the current amplification in the amplification circuit 54 is sent to a driving voltage input terminal of each switch element 62 that is electrically connected to a driving electrode of each ejection element 68.

Further, the head controller 50 sends a print signal in a serial format to the shift register 56 in synchronization with a clock signal. Further, the head controller 50 sends a latch signal to the latch circuit 58.

The shift register 56 stores the print signal that is sent from the head controller 50 and is used to select one or more waveform elements from among a plurality of waveform elements included in the driving waveform. The print signal stored in the shift register 56 is read to the latch circuit 58 on the basis of the latch signal.

The latch circuit 58 sends the print signal read from the shift register 56 to the level conversion circuit 60. The level conversion circuit 60 converts the print signal sent from the latch circuit 58 into a voltage that can be applied to the switch element 62.

One or more waveform elements are selected from among the plurality of waveform elements included in the driving waveform on the basis of the print signal converted by the level conversion circuit 60. The plurality of waveform elements correspond to the ejection amount of the ink. For example, if three types of waveform elements are included in the driving waveform, the ejection amount of ink can be changed in three steps.

The switch element integrated circuit 64 includes a plurality of switch elements 62. The switch element integrated circuit 64 switches on or off each switch element 62 using an enable signal sent and a selection signal from the head controller 50.

The head driving unit 44 illustrated in FIG. 3 transmits a driving voltage common to the respective ejection elements 68 to the plurality of switch elements 62 that are electrically connected to the respective ejection elements 68. When each switch element 62 is turned ON on the basis of a driving signal indicating an ejection timing of the ejection element 68 electrically connected thereto, and a driving signal corresponding to the ink ejection amount, a driving voltage corresponding to each ink ejection amount of each ejection element 68 is supplied at each ejection timing for the ejection element 68.

A scheme of driving the inkjet head 12 described with reference to FIG. 3 is one example and, for example, a scheme of generating a driving voltage for each ejection element can be applied in an inkjet head having a relatively small number of ejection elements.

The respective units are listed according to functions in FIG. 3. The respective units illustrated in FIG. 3 can be appropriately integrated, separated, combined, or omitted. Further, the respective units illustrated in FIG. 3 can be configured in appropriate combination of hardware and software.

<Description of Ejection Element>

FIG. 4 is a cross-sectional view illustrating a configuration example of the ejection element. FIG. 4 is a cross-sectional view illustrating a three-dimensional structure of the ejection element 68 that is a minimum unit of ink ejection. The ejection element 68 illustrated in FIG. 4 includes a nozzle unit, and a piezoelectric element 88. The nozzle unit includes a nozzle opening 80, a pressure chamber 84, a vibration plate 86, and a supply port 90.

The nozzle opening 80 is formed in a nozzle plate 82. A surface opposite to a vibration plate 86 of the nozzle plate 82 is a liquid ejection surface. The nozzle opening 80 communicates with the pressure chamber 84. The pressure chamber 84 temporarily stores ink that is ejected from the nozzle opening 80.

The pressure chamber 84 communicates with a common flow path 92 through the supply port 90. The supply port 90 is a flow path that causes the pressure chamber 84 to communicate with the common flow path 92, and has a diameter smaller than an outlet on the nozzle opening 80 side of the pressure chamber 84.

The supply port 90 functions as a diaphragm on the supply side of the pressure chamber 84. The common flow path 92 communicates with the tube 14 illustrated in FIG. 1 through an ink flow path (not illustrated). The vibration plate 86 is bonded on the surface opposite to the nozzle opening 80 of the pressure chamber 84. The piezoelectric element 88 is bonded on a surface of the vibration plate 86 opposite to the pressure chamber 84.

The piezoelectric element 88 includes an upper electrode 94, a piezoelectric body 98, and a lower electrode 96. The piezoelectric element 88 has a structure in which the piezoelectric body 98 is sandwiched between the upper electrode 94 and the lower electrode 96. The lower electrode 96 can also be used as the vibration plate 86. The piezoelectric element is an aspect of a pressure generation element.

Although not illustrated, a plane shape of the pressure chamber 84 provided corresponding to the nozzle opening 80 is a substantially a square, an outlet directed to the nozzle opening 80 is provided at one of two corners on a diagonal line, and the supply port 90 that is an inlet of supply ink is provided at the other of the corners.

Further, the planar shape of the pressure chamber 84 is not limited to the square. A variety of forms such as a rectangle, a pentagon, a hexagon, other polygons, a circular shape, and an elliptic shape can be applied as the planar shape of the pressure chamber 84.

In the ejection element 68, droplet-like ink can be ejected from each nozzle opening 80 by controlling driving of the piezoelectric element 88 corresponding to each nozzle opening 80 according to the dot data generated from the input image data.

A desired image is formed on the sheet 18 by controlling a timing at which the droplet-like ink is ejected from the nozzle opening 80 illustrated in FIG. 4 according to the conveyance speed of the sheet 18 while conveying the sheet 18 illustrated in FIG. 1 in the sheet conveyance direction at a constant speed.

For the ejection element 68 illustrated in FIG. 4, a structure in which a plurality of cavity plates are stacked can be applied. The ejection element 68 illustrated in FIG. 4 has a structure in which a nozzle plate 82 in which a nozzle opening 80 is formed, a flow path plate 99 in which a pressure chamber 84, a supply port 90, a common flow path 92, and the like are formed, a vibration plate 86, and a piezoelectric element 88 are stacked in an order of the nozzle plate 82, the flow path plate 99, the vibration plate 86, and the piezoelectric element 88. The flow path plate 99 may be further subdivided.

Although a piezoelectric scheme in which the piezoelectric element 88 is applied as means for pressurizing the ink stored in the pressure chamber 84 is illustrated in this embodiment, a thermal scheme in which a heater that heats ink in the inside of the pressure chamber 84 is included and the ink is pressurized using a film boiling phenomenon of the ink can be applied. The heater is an aspect of a pressure generation element.

[Description of Electrical Fault Detection According to First Embodiment]

Next, electrical fault detection according to the first embodiment will be described.

<Structure Example of Inkjet Head>

Figure 5:
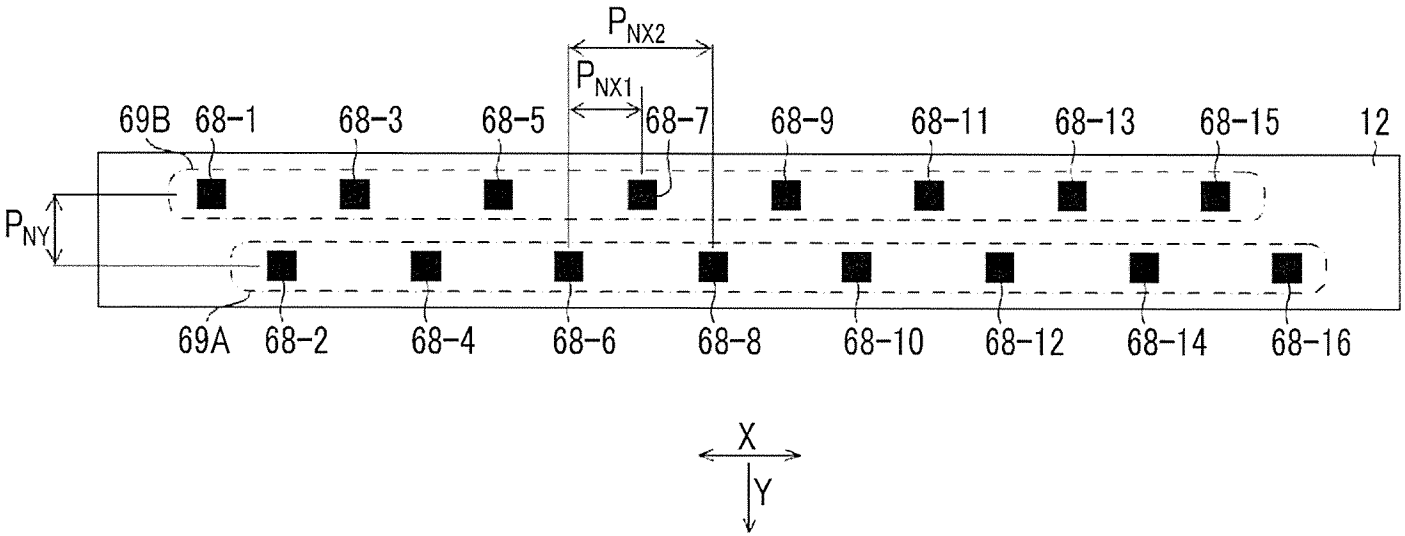
FIG. 5 is a perspective plan view of a liquid ejection surface of an inkjet head.

FIG. 5 is a perspective plan view of a liquid ejection surface of the inkjet head. For ease of description, sixteen ejection elements 68 among the plurality of ejection elements 68 are illustrated in FIG. 5.

A sub-number assigned to reference sign 68 indicating the ejection element is an identification number of the sixteen ejection elements 68, and corresponds to an arrangement order in the sheet width direction. In the following description, in a case where it is not necessary to distinguish among the ejection elements 68-1 to 68-16 illustrated in FIG. 5, the ejection elements are described as the ejection element 68. The ejection element 68 illustrated in FIG. 5 can be replaced with the nozzle opening 80 or the piezoelectric element 88 illustrated in FIG. 4.

In the inkjet head 12 illustrated in FIG. 5, a plurality of ejection elements 68 are arranged in two rows in the sheet conveyance direction. The ejection element 68-2, the ejection element 68-4, the ejection element 68-6, the ejection element 68-8, the ejection element 68-10, the ejection element 68-12, the ejection element 68-14, and the ejection element 68-16 belonging to an ejection element group 69A of a first row, and the ejection element 68-1, the ejection element 68-3, the ejection element 68-5, the ejection element 68-7, the ejection element 68-9, the ejection elements 68-11, the ejection elements 68-13, and the ejection elements 68-15 belonging to an ejection element group 69B of a second row are arranged at regular intervals in the sheet conveyance direction.

An arrangement interval $P_{NX1}$ of the ejection elements 68 in the sheet width direction in a case where the ejection elements 68-1 to 68-16 illustrated in FIG. 5 are projected in the sheet width direction is an equal interval. The arrangement interval $P_{NX1}$ of the ejection elements 68 in a case where the ejection elements 68-1 to 68-16 are projected in the sheet width direction is ½ of an arrangement interval $P_{NX2}$ of the ejection elements 68 in each column in the sheet width direction.

In a case where a maximum resolution of the image is 600 dots per inch, the arrangement interval $P_{NX2}$ of the ejection elements of each column in the sheet width direction is 84 micrometers. The arrangement interval $P_{NX1}$ of the ejection elements 68 in the sheet width direction in a case where the ejection elements 68-1 to 68-16 illustrated in FIG. 5 are projected in the sheet width direction is 42 micrometers.

The arrangement interval $P_{NY}$ of the ejection elements 68 in the sheet conveyance direction is 84 micrometers. Numeric values indicating the arrangement interval $P_{NX1}$, the arrangement interval $P_{NX2}$, and the arrangement interval $P_{NY}$ are numerical values obtained by rounding off a first decimal place.

The arrangement of the plurality of ejection elements 68 illustrated in FIG. 5 is an aspect of a matrix arrangement. Another example in which the plurality of ejection elements 68 are arranged in a matrix form may include an example in which the plurality of ejection elements 68 are arranged in a row direction along a longitudinal direction of the inkjet head 12 and an oblique column direction intersecting the longitudinal direction of the inkjet head 12.

Further, the longitudinal direction of the inkjet head 12 corresponds to the sheet width direction in a state in which the inkjet head 12 is used. A lateral direction of the inkjet head 12 corresponds to the sheet conveyance direction in a state in which the inkjet head 12 is used.

The same applies to the following description. In the following description, for the sake of convenience, the longitudinal direction of the inkjet head 12 is denoted with reference sign X. Further, the lateral direction of the inkjet head 12 is denoted with a reference sign Y. The same applies to the drawings that are used in the following description.

Figure 33:
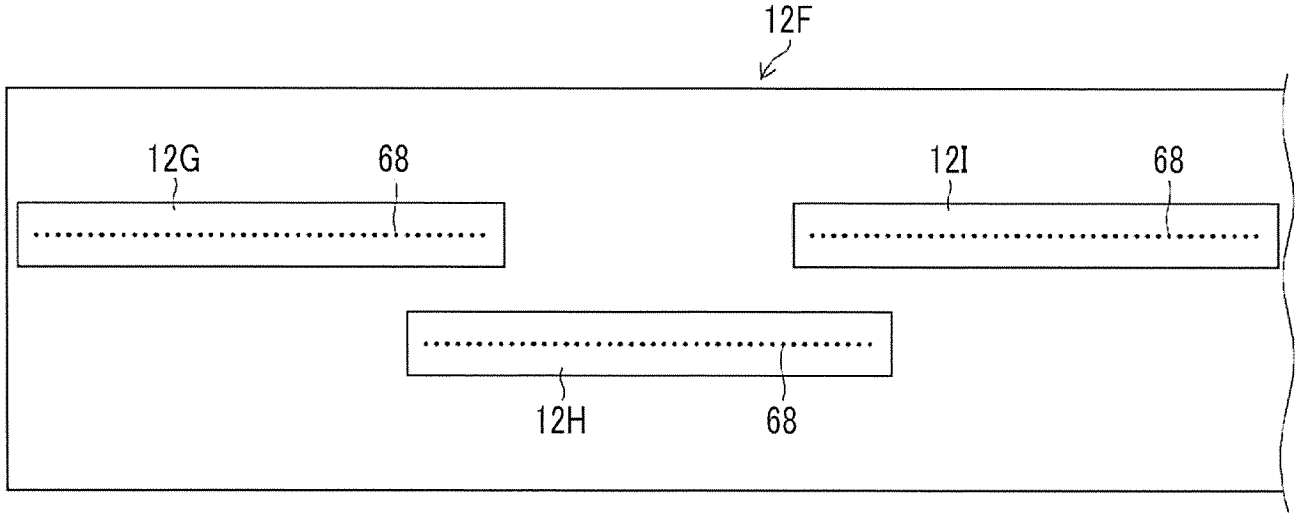
FIG. 33 is an illustrative diagram of a third modification example of the inkjet head.

An inkjet head having a structure in which a plurality of head modules are included and the plurality of head modules are arranged in the longitudinal direction of the inkjet head may be applied. The plurality of head modules may be arranged in a line or may be arranged in two or more rows. The inkjet head including a plurality of head modules is illustrated in FIG. 33.

For the head module, a planar shape of a parallelogram having end surfaces on the long side in a direction having an inclination with respect to a longitudinal direction of the inkjet head 12, and end surfaces on the short side in a direction having an inclination with respect to the lateral direction of the inkjet head 12 can be applied.

Figure 27:
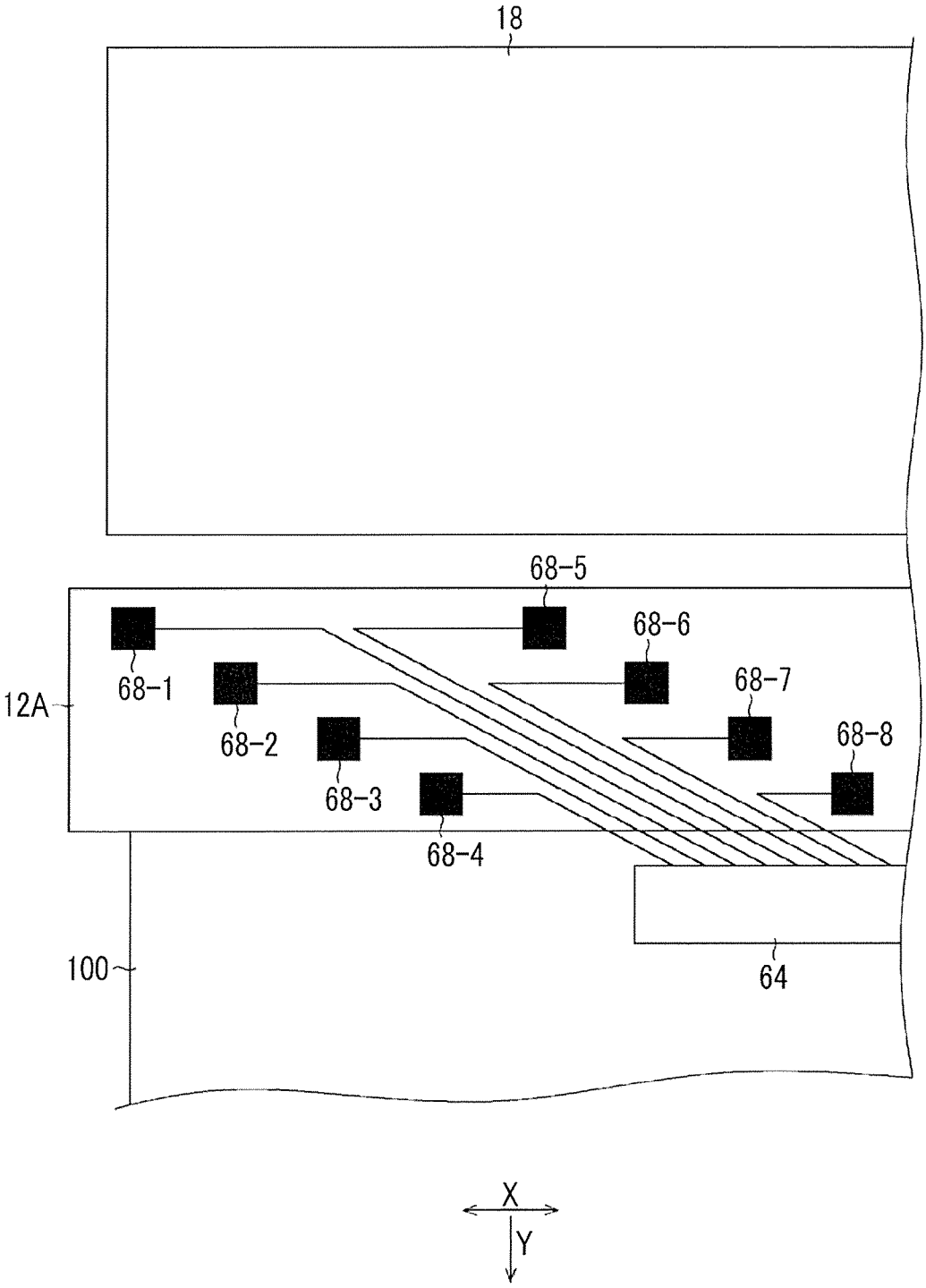
FIG. 27 is an illustrative diagram of a matrix arrangement of the ejection element.
Figure 31:
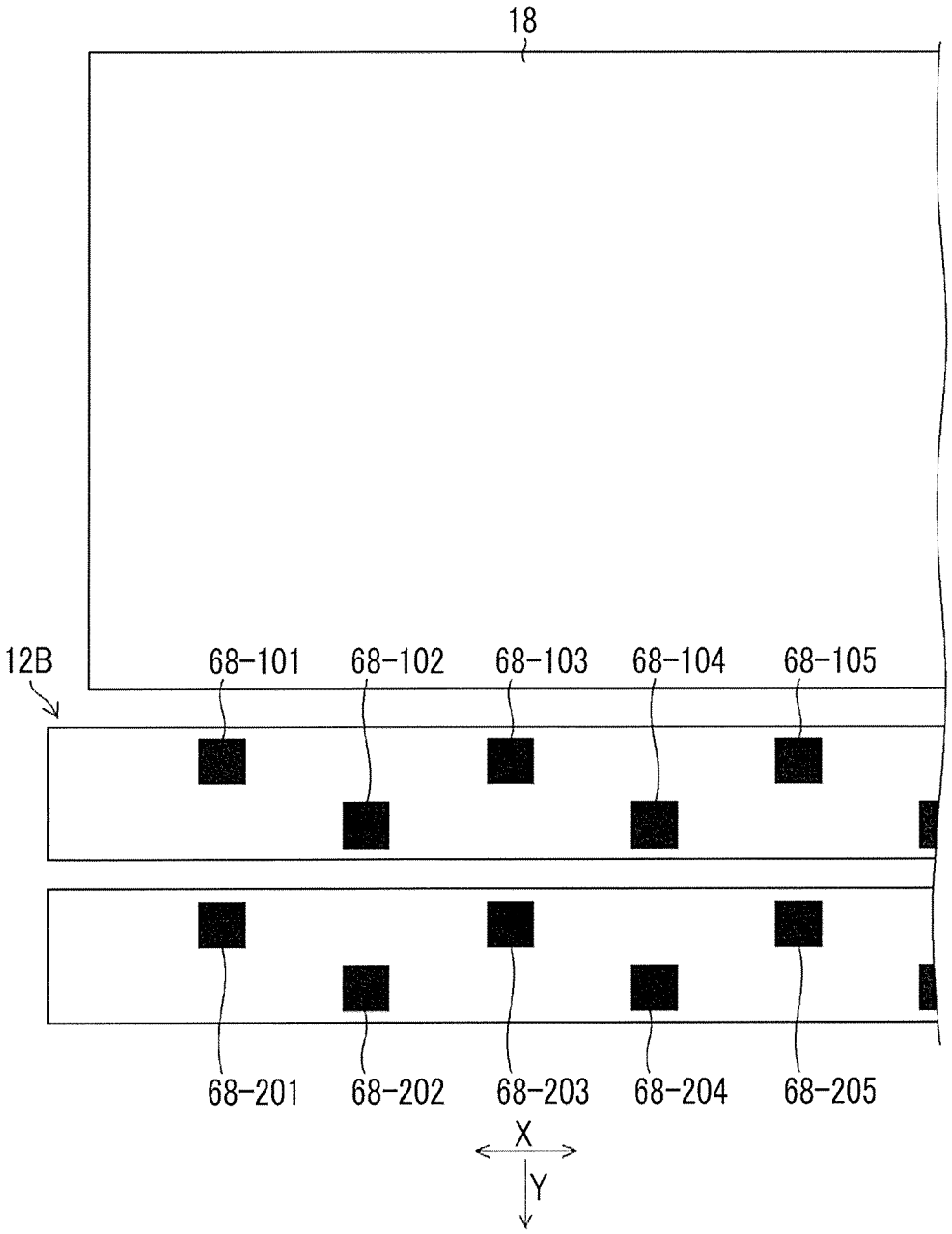
FIG. 31 is an illustrative diagram of a first modification example of the inkjet head.
Figure 32:
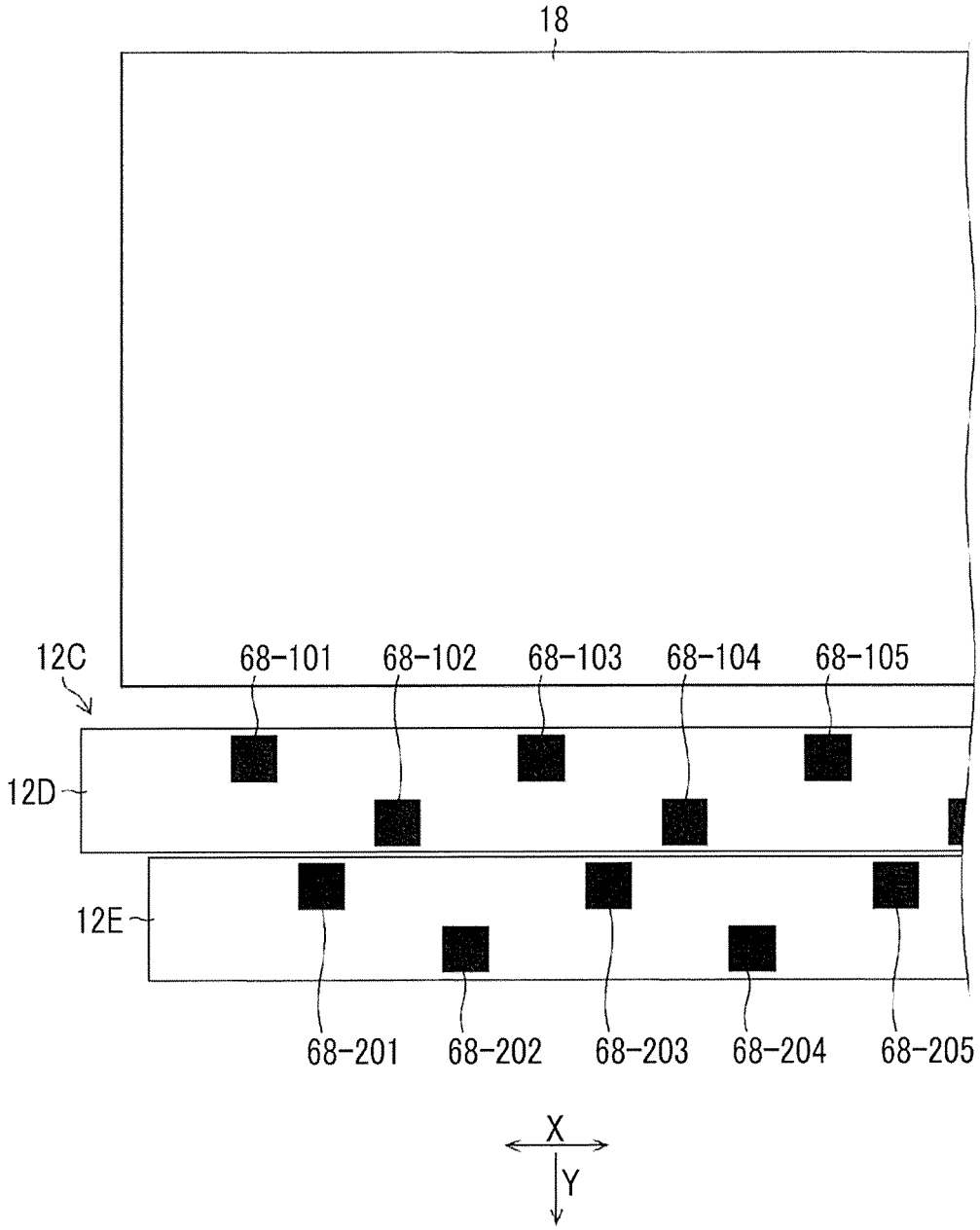
FIG. 32 is an illustrative diagram of a second modification example of the inkjet head.

Another example in which the plurality of ejection elements 68 are arranged in a matrix form may include an example in which a plurality of nozzle openings 80 are arranged in a row direction along a direction of an end surface on the long side and a column direction along a direction of the end surface of the short side. The inkjet head in which the plurality of ejection elements 68 are arranged in a matrix form is illustrated in FIGS. 27, 31, and 32.

Figure 6:
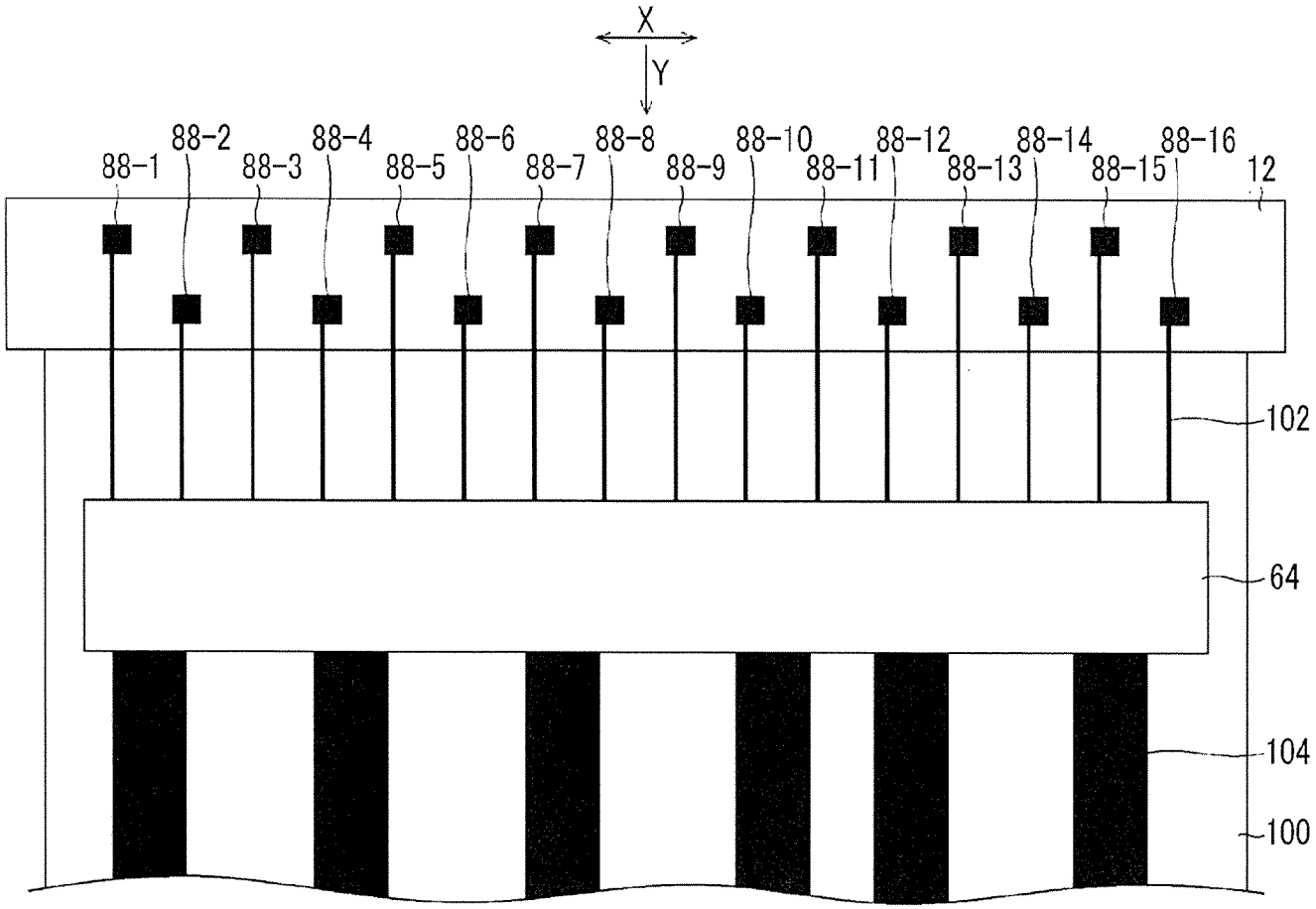
FIG. 6 is an illustrative diagram schematically illustrating electrical wirings of ejection elements.

FIG. 6 is an illustrative diagram schematically illustrating electrical wirings of the ejection elements. In FIG. 6, the piezoelectric elements 88-1 to 88-16 corresponding to the respective ejection elements 68-1 and 68-16 are illustrated instead of the ejection elements 68-1 and 68-16 illustrated in FIG. 5.

The sub-number added to the reference sign 88 indicating the piezoelectric element is an identification number of the piezoelectric elements 88, and corresponds to an arrangement order in the sheet width direction, similar to the sub-number added to the reference sign 68 indicating the ejection element illustrated in FIG. 5. In the following description, in a case where it is not necessary to distinguish among the piezoelectric elements 88-1 to 88-16 illustrated in FIG. 6, the piezoelectric elements 88-1 to 88-16 are described as the piezoelectric element 88. The electrical wiring may include an electrode, a pad, or a through hole.

The inkjet head 12 is electrically connected to an electrical circuit board on which the head driving unit 44 illustrated in FIGS. 2 and 3 is mounted, using flexible substrate 100. The switch element integrated circuit 64 illustrated in FIG. 3 is mounted on the flexible substrate 100 illustrated in FIG. 6. The electrical circuit board is not illustrated.

The flexible substrate 100 illustrated in FIG. 6 is electrically connected to a driving voltage output terminal of the switch element integrated circuit 64, and an electrical wiring 102 that electrically connects an electrode mechanically bonded to the driving voltage output terminal of the switch element integrated circuit 64 to the upper electrode of each piezoelectric element 88 is formed. In FIG. 6, the upper electrode of each piezoelectric element 88 is not illustrated. The upper electrode of the piezoelectric element 88 is denoted ah the reference sign 94 and illustrated in FIG. 4.

In FIG. 6, only one of the plurality of illustrated electrical wirings 102 is denoted with a reference sign. Further, the driving voltage output terminal of the switch element integrated circuit 64 is not illustrated in FIG. 6.

In the flexible substrate 100 illustrated in FIG. 6, electrical wirings 104 for the driving voltage transferred from the head driving unit 44 illustrated in FIG. 3 to the switch element integrated circuit 64 are formed. In FIG. 6, only one of the plurality of illustrated electrical wirings 104 is denoted with a reference sign.

<Description of Short Circuit of Ejection Element>

Figure 7:
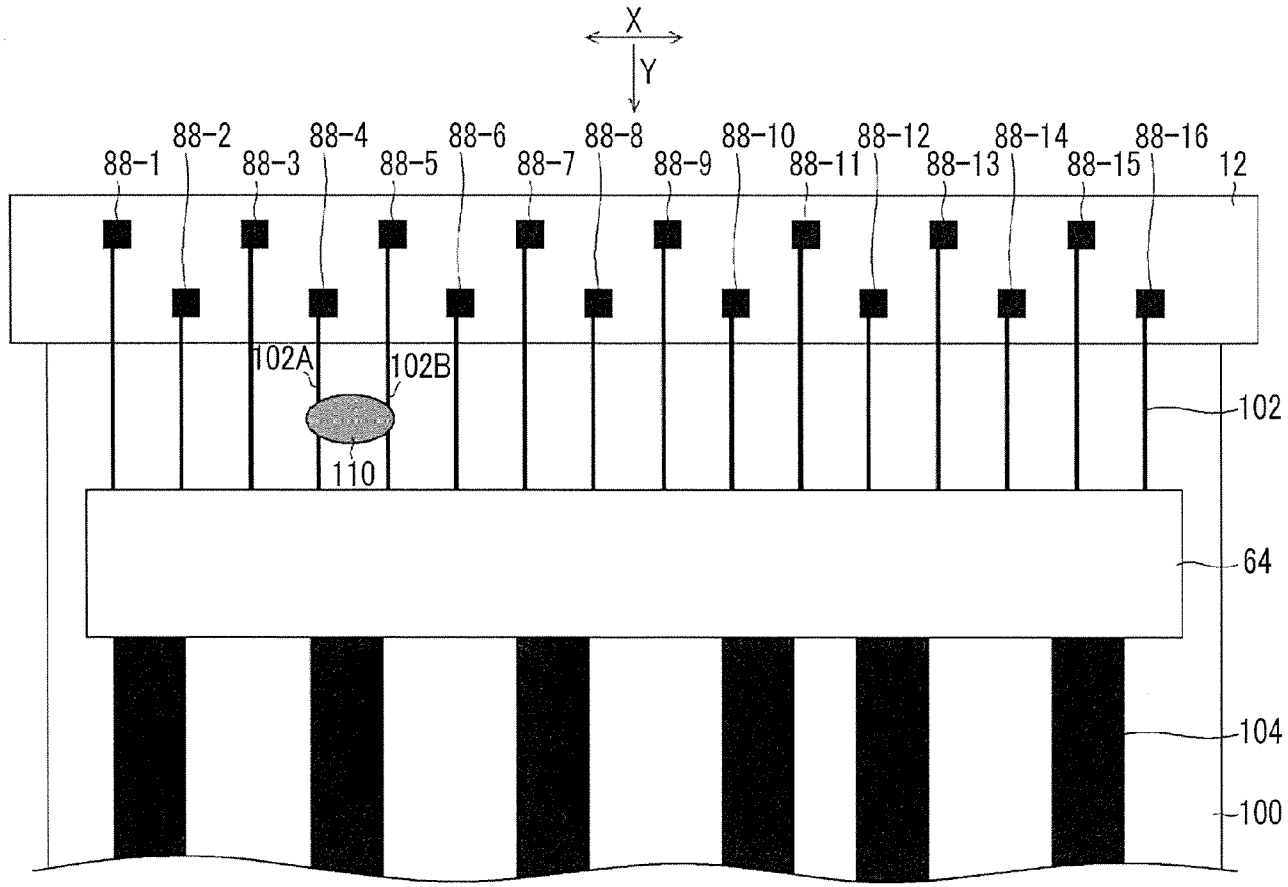
FIG. 7 is an illustrative diagram schematically illustrating a case where an electrical wiring is short-circuited.

FIG. 7 is an illustrative diagram schematically illustrating a case where an electrical wiring is short-circuited. In the inkjet head 12 illustrated in FIG. 7, a conductive material 110 comes in contact with an electrical wiring 102A that is electrically connected to the piezoelectric element 88-4 and an electrical wiring 102B that is electrically connected to the piezoelectric element 88-5, and the electrical wirings are short-circuited. The short circuit of the electrical wirings 102 that are electrically connected to the respective ejection elements 68 is synonymous with a short circuit of the ejection elements 68.

As illustrated in FIG. 7, if the electrical wiring 102A that is electrically connected to the piezoelectric element 88-4 and the electrical wiring 102E that is electrically connected to the piezoelectric element 88-5 are short-circuited, the piezoelectric element 88-5 may be driven at a timing at which the piezoelectric element 88-4 is driven.

Then, at a timing at which ink is ejected from the ejection element 68-4 including the piezoelectric element 88-4, ink is ejected from the ejection element 68-5 including the piezoelectric element 88-5.

Further, in a case where the piezoelectric element 88-5 is driven, ink is ejected from the ejection element 68-4 including the piezoelectric element 88-4 at a timing at which ink is ejected from the ejection element 68-5 including the piezoelectric element 88-5. In such a state, an image different from an image to be originally formed is formed.

In a case where an image to be originally formed is not formed, a countermeasure in which the formed image is not allowed is possible. On the other hand, if the ejection element in which an electrical fault such as a short circuit occurs is specified, it is possible to increase a level of the countermeasure of the electrical fault.

An example in which the level of the countermeasure against the electrical fault is increased may include an example in which the ejection element in which the electrical fault has occurred is subjected to a non-use process. Since the ejection element in which the electrical fault has occurred is subjected to the non-use process, it is possible to use the inkjet head. Further, it can be determined whether or not exchange of the inkjet head is required according to the number of ejection elements in which the electrical fault occurs.

Further, by specifying a position of the electrical fault, it is possible to improve a process of producing the inkjet head. Hereinafter, electrical fault detection will be described in detail.

<Description of Short-Circuit Detection>

Figure 8:
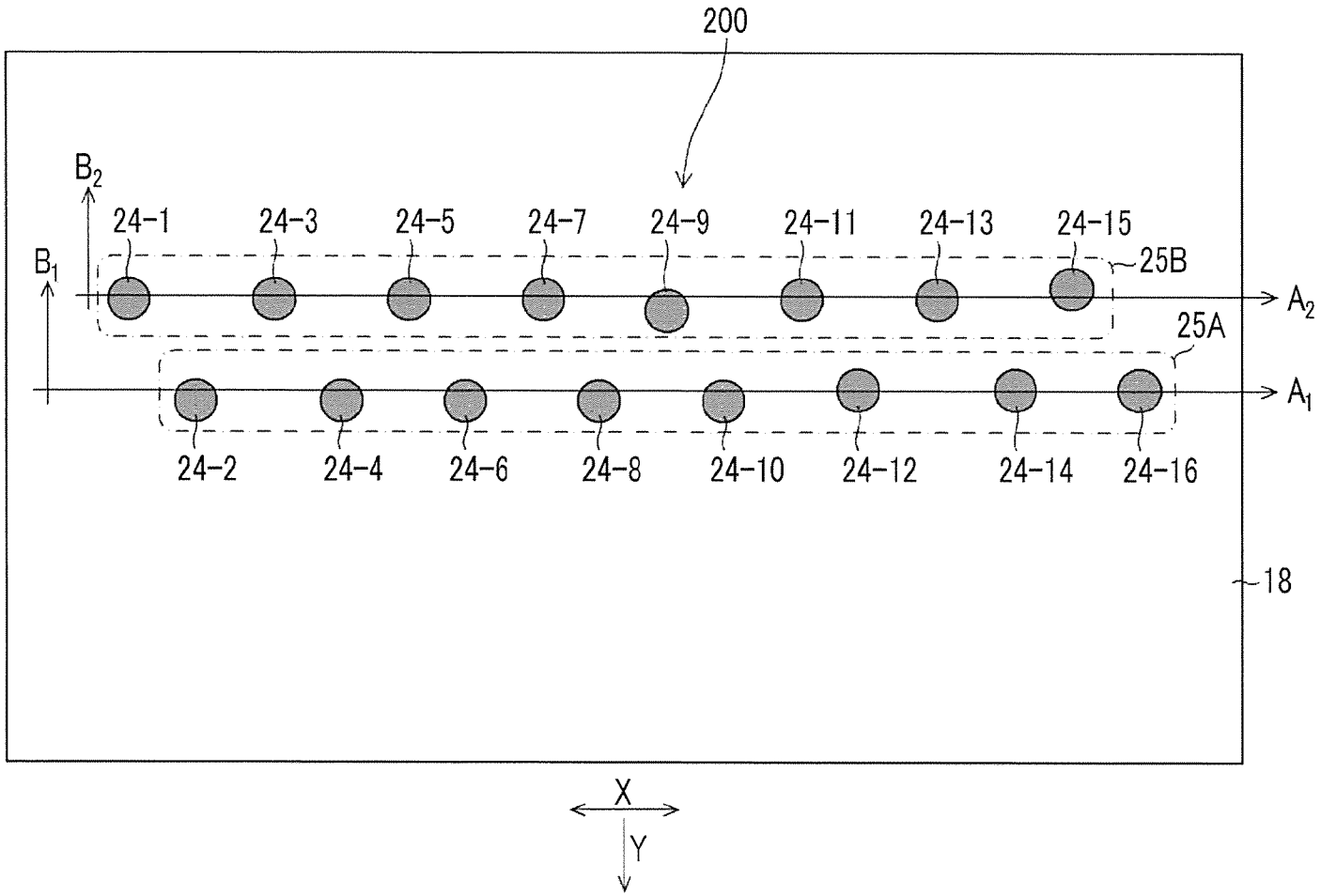
FIG. 8 is an illustrative diagram schematically illustrating an electrical fault detection pattern in a case where a short circuit between the ejection elements does not occur.

First, electrical fault detection according to the first embodiment will be described. FIG. 8 is an illustrative diagram schematically illustrating an electrical fault detection pattern in a case where a short circuit between the ejection elements does not occur. In this embodiment, the ejection elements 68-1 to 68-16 are driven in order using the same ejection condition in a state in which relative conveyance of the inkjet head 12 illustrated in FIG. 5 and the sheet 18 stops. Accordingly, an electrical fault detection pattern 200 illustrated in FIG. 8 is formed.

Examples of the electrical fault may include fault of the electrical wiring via which the driving voltage to be supplied to the ejection element is transferred, fault of an electrical circuit constituting the head driving unit 44 illustrated in FIG. 3, and fault of elements used in the electrical circuit. An example of the ejection condition may include an ejection volume of ink.

The electrical fault detection pattern 200 illustrated in FIG. 8 includes dots 24-1 to 24-16 formed from the ink ejected from the respective ejection elements 68-1 and 68-16 illustrated in FIG. 5. In a case where it is not necessary to distinguish among the dots 24-1 to 24-16 in the following description, the dots are described as a dot 24.

Sub-numbers 1 to 16 added to the reference sign 24 indicating the dot in FIG. 8 correspond to the sub-number added to reference sign 68 indicating the ejection element illustrated in FIG. 5. That is, the dot 24-1 is a dot formed using the ejection element 68-1 illustrated in FIG. 5. The same applies to FIGS. 9 and 11.

The electrical fault detection pattern 200 illustrated in FIG. 8 is formed in a case where the electrical fault of the inkjet head 12 illustrated in FIG. 5 does not occur. The electrical fault detection pattern 200 illustrated in FIG. 8 is formed in a case where the ejection elements 68-1 to 68-16 illustrated in FIG. 5 normally operate and the ejection elements 68-1 to 68-16 eject the same volume of ink.

In other words, in a case where the electrical fault of the inkjet head 12 does not occur, the dots 24-1 to 24-16 illustrated in FIG. 8 have the same area.

The arrangement of the dots 24 constituting the electrical fault detection pattern 200 illustrated in FIG. 8 satisfies the predetermined arrangement condition with the arrangement of the ejection elements 68 in the inkjet head 12 illustrated in FIG. 5. The arrangement of the dots 24 can be determined on the basis of an arrangement interval of the dots and an arrangement relationship of dots arranged at adjacent positions.

Similarly, the arrangement of the ejection elements can be determined on the basis of the arrangement interval of the ejection elements, and an arrangement relationship of the ejection elements arranged at adjacent positions. Hereinafter, a condition under which the arrangement of dots 24 in the electrical fault detection pattern 200 satisfies the predetermined arrangement relationship with the arrangement of the ejection elements will be described in detail.

The dot 24-2, the dot 24-4, the dot 24-6, the dot 24-8, the dot 24-10, the dot 24-12, the dot 24-14, and the dot 24-16 formed using dot ink ejected from the ejection element 68-2, the ejection element 68-4, the ejection element 68-6, the ejection element 68-8, the ejection element 68-10, the ejection element 68-12, the ejection element 68-14, and the ejection element 68-16 belonging to the ejection element group 69A of the first row illustrated in FIG. 5 correspond to a plurality of first dot arrays constituting the first dot set 25A.

Here, the dot array includes at least one dot. The dot array may include one dot. The dot array may include a plurality of dots.

An approximate straight line indicating an arrangement direction of the dot 24-2, the dot 24-4, the dot 24-6, the dot 24-8, the dot 24-10, the dot 24-12, the dot 24-14, and the dot 24-16 that are a plurality of first dot arrays belonging to the first dot set 25A is a first dot set first axis $A_1$. A straight line orthogonal to the first dot set first axis $A_1$ is a first dot set second axis $B_1$.

Further, the dot 24-1, the dot 24-3, the dot 24-5, the dot 24-7, the dot 24-9, the dot 24-11, the dot 24-13, and the dot 24-15 formed using ink ejected from the ejection element 68-1, the ejection element 68-3, the ejection element 68-5, the ejection element 68-7, the ejection element 68-9, the ejection element 68-11, the ejection element 68-13, and the ejection element 68-15 belonging to the ejection element group 69B of the second row correspond to a plurality of second dot arrays constituting the second dot set 25B.

An approximate straight line indicating the arrangement direction of the dot 24-1, the dot 24-3, the dot 24-5, the dot 24-7, the dot 24-9, the dot 24-11, the dot 24-13, and the dot 24-15 that are a plurality of second dot arrays belonging to the second dot set 25B is a second dot set first axis $A_2$. A straight line orthogonal to the second dot set first axis $A_2$ is a second dot set second axis $B_2$.

A positive direction of the first dot set second axis $B_1$ and a positive direction of the second dot set second axis $B_2$ are directions from the first dot set 25A to the second dot set 25B. A positive direction of the first dot set first axis $A_1$ and a positive direction of the second dot set first axis $A_2$ are directions from the left to the right in FIG. 8. The positive direction of the first dot set first axis $A_1$ and the positive direction of the second dot set first axis $A_2$ are directions from the right to the left in FIG. 8.

In the first dot set second axis $B_1$ or the second dot set second axis $B_2$, a maximum value of the dot belonging to the first dot set 25A has a coordinate value smaller than a minimum value of the dot belonging to the second dot set 25B.

All of the dot 24-2, the dot 24-4, the dot 24-6, the dot 24-8, the dot 24-10, the dot 24-12, the dot 24-14, and the dot 24-16 belonging to the first dot set 25A illustrated in FIG. 8 have the same coordinate value of the first dot set second axis $B_1$ or the second dot set second axis $B_2$.

Similarly, all of the dot 24-1, the dot 24-3, the dot 24-5, the dot 24-7, the dot 24-9, the dot 24-11, the dot 24-13, and the dot 24-15 belonging to the second dot set 25B have the same coordinate value of the first dot set second axis $B_1$ or the second dot set second axis $B_2$.

In the first dot set second axis $B_1$ or the second dot set second axis $B_2$, since a maximum coordinate value of the dot 24-2, the dot 24-4, the dot 24-6, the dot 24-8, the dot 24-10, the dot 24-12, the dot 24-14, and the dot 24-16 belonging to the first dot set 25A is smaller than a minimum coordinate value of the dot 24-1, the dot 24-3, the dot 24-5, the dot 24-7, the dot 24-9, the dot 24-11, the dot 24-13, and the dot 24-15 belonging to the second dot set 25B, the electrical fault detection pattern 200 satisfies the predetermined arrangement condition.

Further, in the electrical fault detection pattern 200 illustrated in FIG. 8, the number of dots formed using each ejection element 68 is one. That is, the number of dots formed using each ejection element 68 is the same. The dot described herein is one aspect of the dot array.

That is, the electrical fault detection pattern 200 illustrated in FIG. 8 satisfies the predetermined dot array number condition. The electrical fault detection pattern in which a plurality of dots are formed using the ejection elements 68 can be formed.

Figure 9:
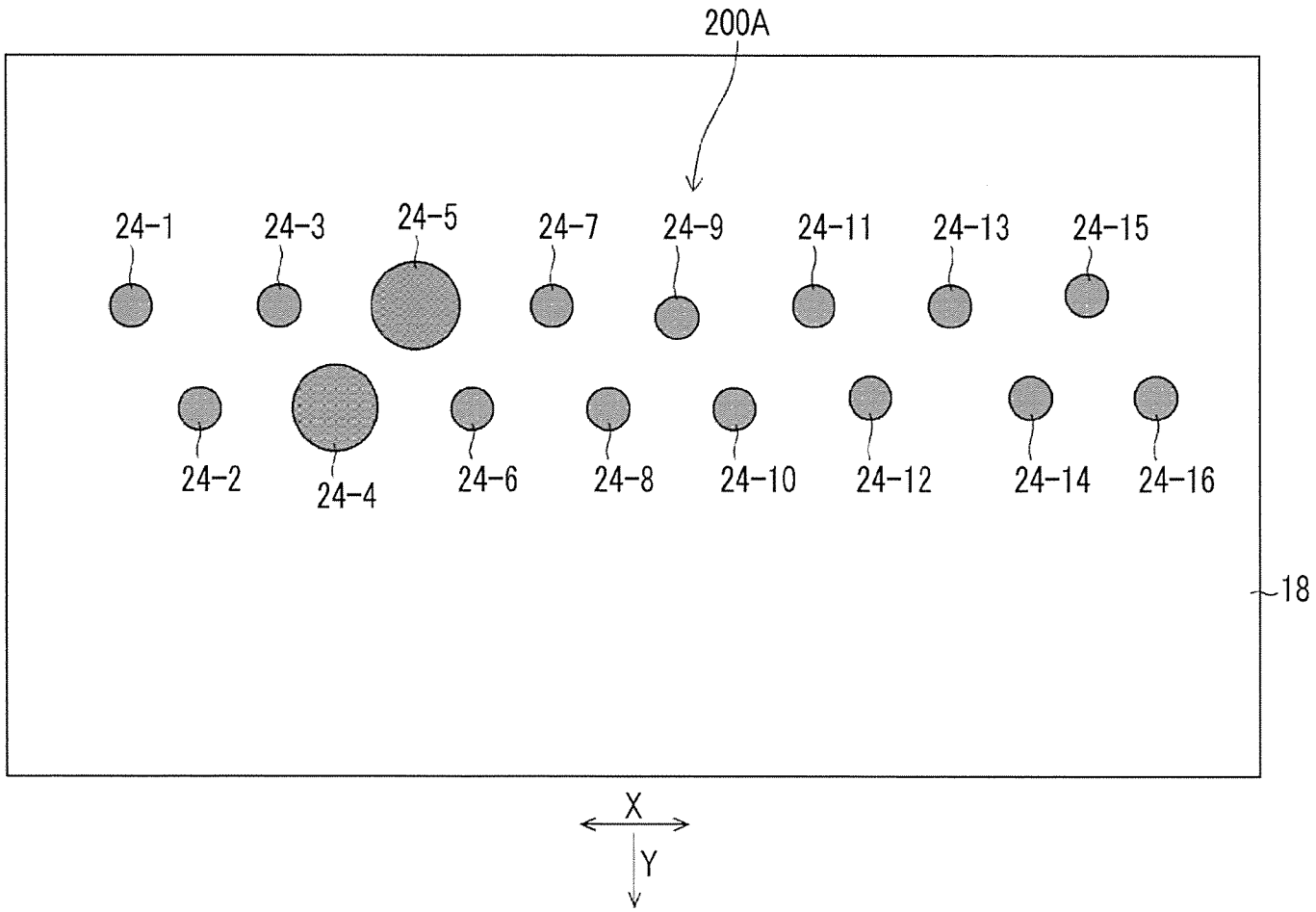
FIG. 9 is an illustrative diagram schematically illustrating an electrical fault detection pattern in a case where a short circuit between the ejection elements occurs.

FIG. 9 is an illustrative diagram schematically illustrating an electrical fault detection pattern in a case where a short circuit between the ejection elements occurs. In FIG. 9, the single clotted line indicating the first dot set 25A, the reference sign of the first dot set 25A, the single dotted line indicating the second dot set 25B, and the reference sign of the second dot set 25B illustrated in FIG. 8 are not illustrated. The same applies to FIGS. 9 and 14.

The electrical fault detection pattern 200A illustrated in FIG. 9 is formed in a case where the ejection element 68-4 and the ejection element 68-5 illustrated in FIG. 5 are short-circuited. The electrical fault detection pattern 200A illustrated in FIG. 9 includes the dot 24-4 and the dot 24-5 having an area that is two times the area of the other dots.

If the ejection elements 68-4 and the ejection element 68-5 illustrated in FIG. 5 are short-circuited, ink is ejected from the ejection element 68-5 at an ejection timing of the ejection element 68-4. Similarly, ink is ejected from the ejection element 68-4 at an ejection timing of the ejection element 68-5.

As a result, the number of ejections of the ejection element 68-4 and the ejection element 68-5 becomes twice the number of ejections of the other ejection elements 68, and the ejection element 68-4 and the ejection element 68-5 eject the volume of the ink twice the volume of ink in the other ejection elements 68.

In a case where the electrical fault detection pattern 200A illustrated in FIG. 9 is analyzed and the dot 24 having the area twice the area of the other dots 24 is found, it can be determined that a short circuit between the two ejection elements 68 occurs. Further, by specifying the position of the dot 24 having the area twice the area of the other dots 24, it is possible to specify the ejection element 68 in which a short circuit occurs.

In the analysis of the electrical fault detection pattern 200A illustrated in FIG. 9, the read data obtained from a reading device (not illustrated) may be an analysis target. A scanner including an image sensor can be applied as a reading device. By performing an image analysis process on read image data of the electrical fault detection pattern 200A obtained from the scanner, the electrical fault detection pattern 200A may be analyzed.

In the analysis of the electrical fault detection pattern 200A, visual inspection may be applied. In the visual inspection, the electrical fault detection pattern 200A may be enlarged using a loupe or the like. In a case where the visual inspection can be applied to the analysis of the electrical fault detection pattern 200A, the reading device is not necessary, and an implementation cost of electrical fault detection can be reduced.

In a case where the visual inspection is applied to the analysis of the electrical fault detection pattern 200A, it may be difficult to determine the magnitude relationship between the dots 24 if the area of the dot 24 is relatively small. For example, in a case where the ink smaller than 10 picoliters is ejected by one ejection, it is difficult to determine the magnitude relationship between the dots 24. The picoliter is a $10^{-2}$ liter. One liter is a $10^{-3}$ cubic meter.

Therefore, when one dot 24 is formed, two or more ejections are performed with respect to the same dot formation position. Accordingly, since an area of one dot 24 is relatively larger, a magnitude relationship between the dots 24 can be determined.

It is preferable for a volume of ink exceeding 50 picoliters to be used for formation of one dot 24. In a case where a base droplet amount that is a volume of ink in one ejection is 5 picoliters, if ten ejections are performed for one ejection element and an electrically normal ejection element 68 is used, the dot 24 using ink of 50 picoliters is formed. On the other hand, if the ejection element 68 in which a short circuit occurs is used, the dot 24 using ink of 100 picoliters is formed. It is possible to determine the magnitude relationship between the dot 24 using ink of 50 picoliters and the dot 24 using ink of 100 picoliters.

Although the ejection elements 68 illustrated in FIG. 5 are operated one by one and the electrical fault detection pattern 200 illustrated in FIG. 8 or the electrical fault detection pattern 200A illustrated in FIG. 9 is formed in this embodiment, a plurality of ejection elements 68 in which a short circuit is sufficiently less likely to occur may be operated simultaneously.

In Table 1, combinations of the ejection element 68 that can be operated simultaneously among the ejection elements 68-1 to 68-16 illustrated in FIG. 5 are shown.

TABLE 1

| | Sub-number of ejection element | | | |
|---|---|---|---|---|
| First ejection timing | 1 | 5 | 9 | 13 |
| Second ejection timing | 2 | 6 | 10 | 14 |
| Third ejection timing | 3 | 7 | 11 | 15 |
| Fourth ejection timing | 4 | 8 | 12 | 16 |

The sub-number of the ejection elements 68 that can be operated simultaneously is described in horizontal series of Table 1. An operation order of the ejection elements 68 is described in vertical series of Table 1. The ejection elements 68 that can be operated simultaneously, which are illustrated in Table 1, are ejection elements 68 that are not adjacent to one another.

The ejection elements 68 that are not adjacent to one another include the ejection elements that are not adjacent to one another in the longitudinal direction of the inkjet head 12, the ejection elements that are not adjacent to one another in the lateral direction of the inkjet head 12, and the ejection elements that are not adjacent to one another in the oblique direction obliquely intersecting the longitudinal direction of the inkjet head 12 in FIG. 5.

For example, the ejection element 68-1, the ejection element 68-5, the ejection element 68-9, and the ejection element 68-13 are the ejection elements 68 that are not adjacent to one another. Similarly, the ejection element 68-3, the ejection element 68-7, ejection elements 68-11, and the ejection element 68-15 are the ejection elements 68 that are not adjacent to one another.

The ejection element 68-2, the ejection element 68-6, the ejection element 68-10, and the ejection element 68-14, and the ejection element 68-4, the ejection element 68-8, the ejection element 68-12, and the ejection element 68-16 are ejection elements 68 that are not adjacent to one another.

That is, as illustrated in Table 1, the ejection element 68-1, the ejection element 68-5, the ejection element 68-9, and the ejection elements 68-13 are operated simultaneously at a first timing, the ejection element 68-2, the ejection elements 68-6, the ejection elements 68-10, and the ejection elements 68-14 are operated simultaneously at a second timing after the first timing, the ejection element 68-3, the ejection element 68-7, the ejection elements 68-11, and the ejection elements 68-15 are operated simultaneously at a third timing after the second timing, and the ejection element 68-4, the ejection element 68-8, the ejection elements 68-12, and the ejection element 68-16 are operated simultaneously at a fourth timing after the third timing. Accordingly, it is possible to form the electrical fault detection pattern 200 illustrated in FIG. 8.

<Description of Fault Detection of Switch Element>

Figure 10:
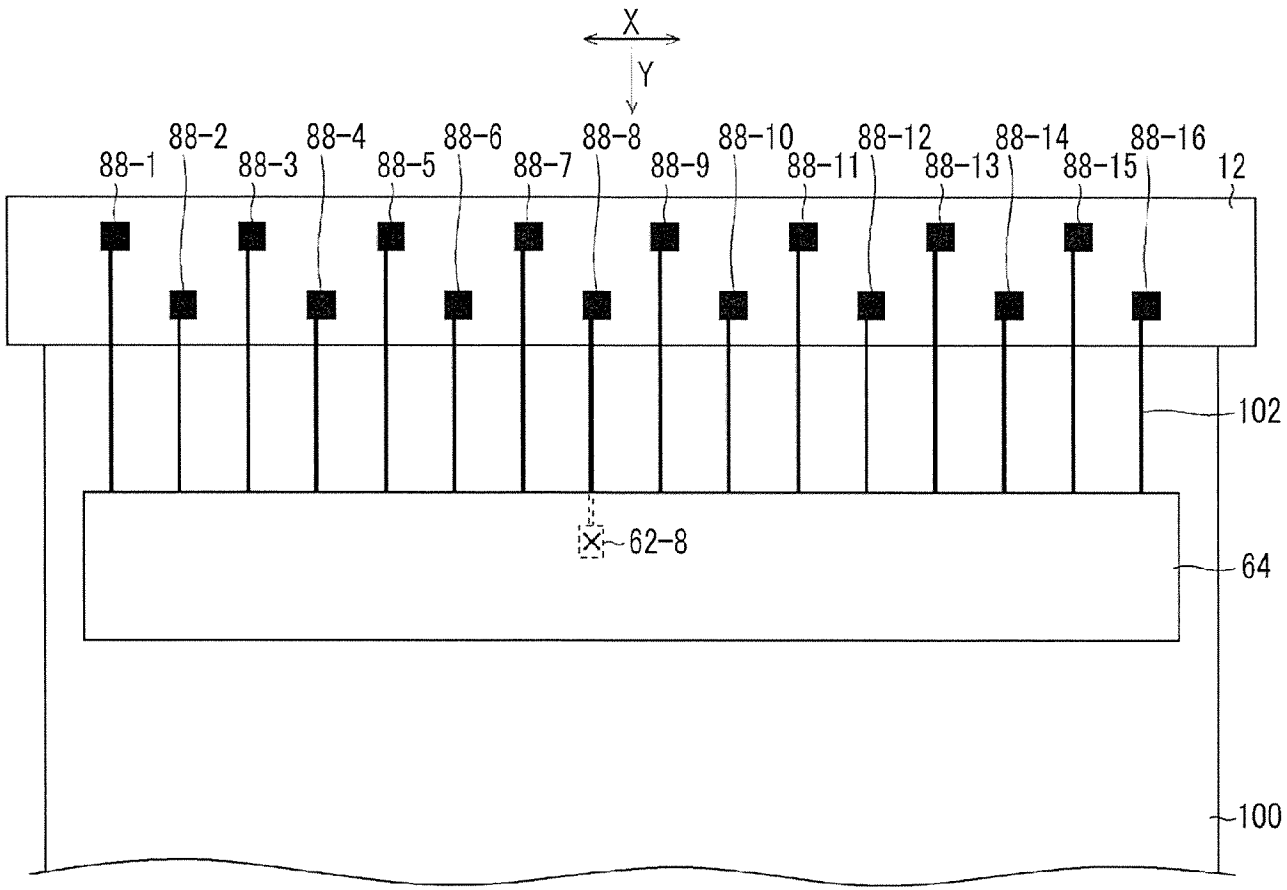
FIG. 10 is an illustrative diagram schematically illustrating a case where the switch element is faulty.

Next, fault detection of the switch element 62 illustrated in FIG. 3 will be described. Fault of the switch element 62 is synonymous with fault of the switch element integrated circuit 64. FIG. 10 is an illustrative diagram schematically illustrating a case where the switch element is faulty. In FIG. 10, an inkjet head 12 in which the switch element 62-8 electrically connected to the ejection element 68-8 is faulty is schematically illustrated.

Figure 11:
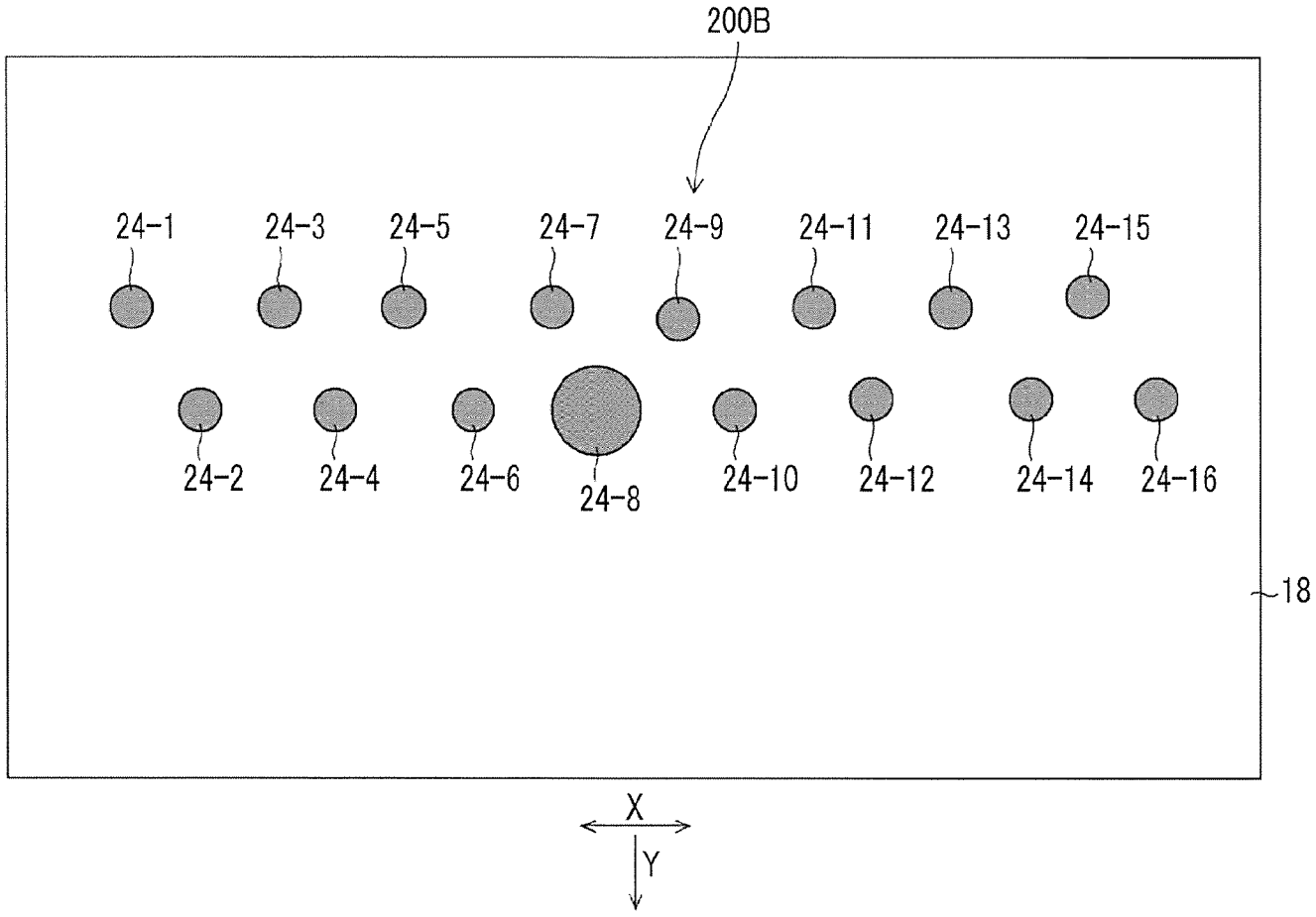
FIG. 11 is an illustrative diagram schematically illustrating an electrical fault detection pattern in a case where the switch element is faulty.

FIG. 11 is an illustrative diagram schematically illustrating an electrical fault detection pattern when the switch element is faulty. An electrical fault detection pattern 200B illustrated in FIG. 11 is formed when the switch element 62-8 electrically connected to the ejection element 68-8 illustrated in FIG. 5 is faulty.

That is, the ejection element 68-8 operates at an ejection timing of the driving signal for operating the other ejection element 68 due to the fault of the switch element 62-8, and an area of the dot 24-8 formed using the ink ejected from the ejection element 68-8 is larger than the area of the other dot 24.

The electrical fault detection pattern 200B is analyzed, and in a case where one dot 24 having a larger area than the other dots 24 is found, it can be determined that fault occurs in the switch element 62 electrically connected to the ejection element 68 that has ejected the ink forming the dot 24 having a larger area than the other dots 24.

Although the detection of the fault of the switch element 62 is illustrated in this embodiment, a fault of the electrical circuit constituting the head driving unit 44 illustrated in FIG. 3 can be detected.

Although, in the electrical fault detection pattern 200, the electrical fault detection pattern 200A, or the electrical fault detection pattern 200B, it is determined whether or not there is an electrical fault according to whether or not there is the dot 24 having a larger area than the other dots 24 in this embodiment, it can be determined whether or not there is an electrical fault according to whether or not there is the dot 24 having a higher concentration than the other dots 24 instead of the area of the dot 24.

<Distance Between Inkjet Head and Sheet>

Figure 12:
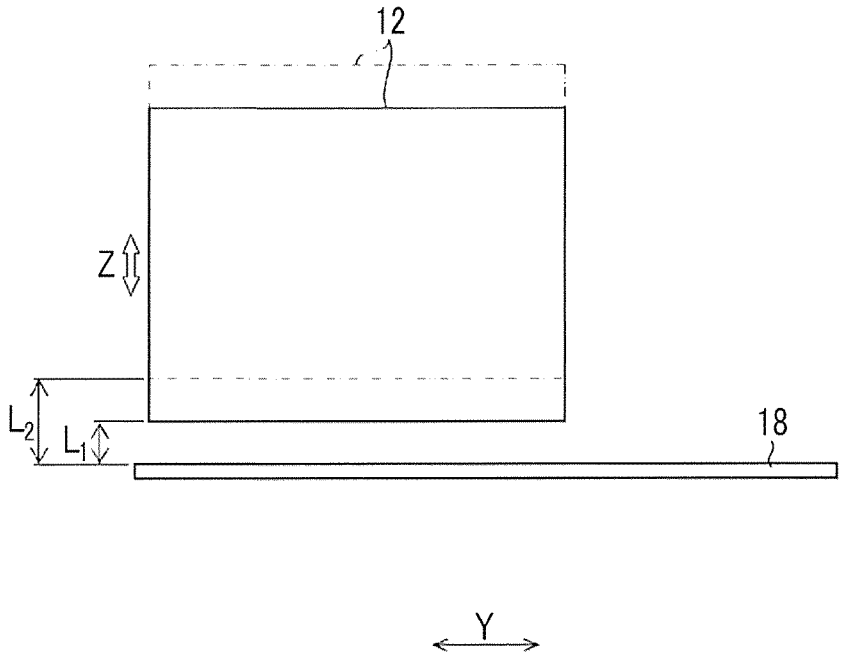
FIG. 12 is an illustrative diagram of head lifting and lowering in electrical fault detection.

FIG. 12 is an illustrative diagram of head lifting and lowering in the electrical fault detection. When the electrical fault detection pattern 200 illustrated in FIG. 8, the electrical fault detection pattern 200A illustrated in FIG. 9, or the electrical fault detection pattern 200B illustrated in FIG. 11 is formed, it is preferable for a distance between the inkjet head 12 and the sheet 18 to be shorter than that at the time of normal drawing.

That is, a distance $L_1$ between the inkjet head 12 and the sheet 18 when the electrical fault detection pattern 200 illustrated in FIG. 8, the electrical fault detection pattern 200A illustrated in FIG. 9, or the electrical fault detection pattern 200B illustrated in FIG. 11 is formed is smaller than a distance $L_2$ between the inkjet head 12 and the sheet 18 at the time of normal drawing.

The inkjet head 12 illustrated using a solid line in FIG. 12 is an inkjet head 12 arranged in an electrical fault detection position that is a position when the electrical fault detection pattern 200 is formed.

The inkjet head 12 illustrated using a two-dot chain line in FIG. 12 is an inkjet head 12 arranged at the drawing position that is a position at the time of normal drawing. It is possible to change the distance between the inkjet head 12 and the sheet 18 by lifting or lowering the inkjet head 12 using the head lifting and lowering unit 23 illustrated in FIG. 1.

When the electrical fault detection pattern 200 illustrated in FIG. 8, the electrical fault detection pattern 200A illustrated in FIG. 9, or the electrical fault detection pattern 200B illustrated in FIG. 11 is formed, the distance between the inkjet head 12 and the sheet 18 is shorter than that at the time of normal drawing. Accordingly, since a variation in a landing position of the ink due to a variation in the ejection state is suppressed, it is possible to prevent a variation in the ejection state of each ejection element from being determined to be electrical fault.

The adjustment of the distance between the inkjet head 12 and the sheet 18 described herein is also applicable to a second embodiment and a third embodiment that will be described below.

<Mask of Abnormal Ejection Element>

Figure 13:
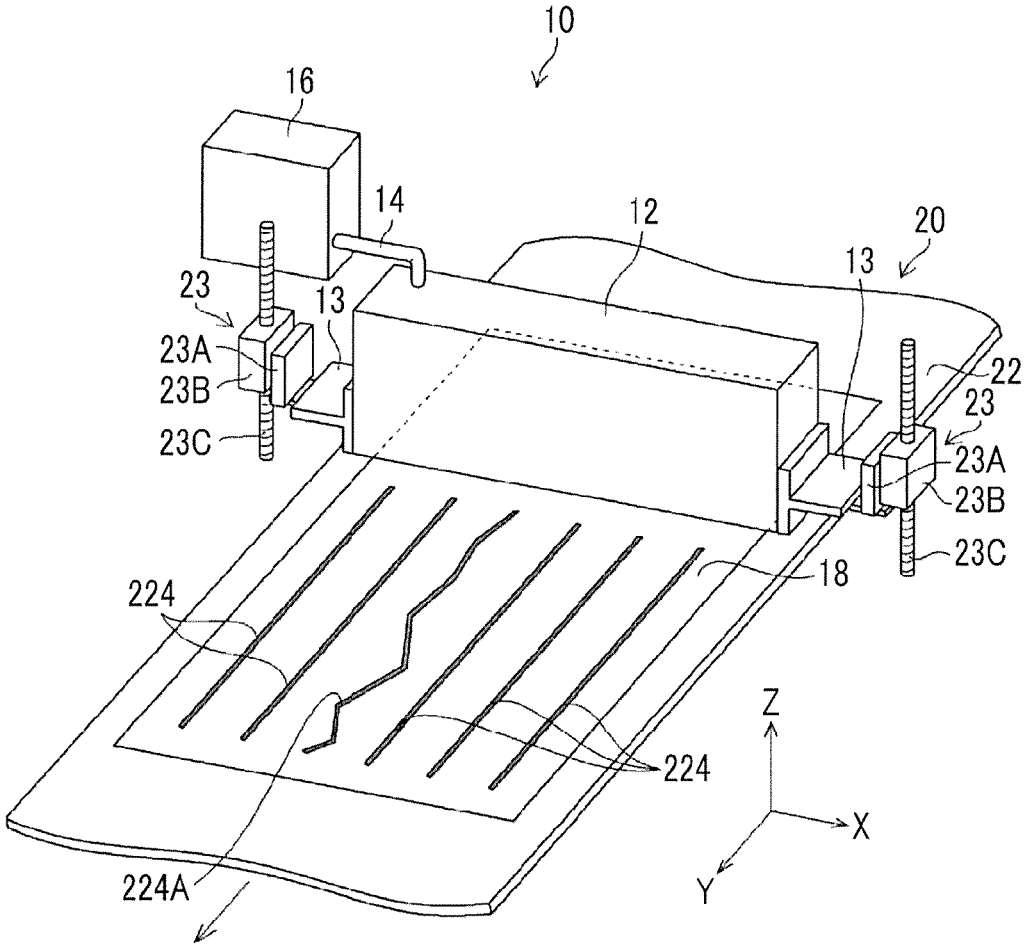
FIG. 13 is an illustrative diagram of an abnormal ejection element in the electrical fault detection.

FIG. 13 is an illustrative diagram of the abnormal ejection element in the electrical fault detection. In the sheet 18 illustrated in FIG. 13, a plurality of dot arrays 224 are formed in the sheet conveyance direction using all the ejection elements included in the inkjet head 12. In FIG. 13, the ejection elements are not illustrated. The ejection elements are denoted with reference sign 68 and illustrated FIG. 4.

In a dot array 224A illustrated in FIG. 13, positions of some of the dots constituting the dot array 224A are shifted. That is, the ejection elements that have ejected ink forming the dot array 224A are abnormal ejection elements in which ejection abnormality has occurred.

Since dots formed using ink ejected from the abnormal ejection elements may have a different area or concentration than dots formed using ink ejected from normal ejection elements, the abnormal ejection elements may be detected as ejection elements in which electrical fault occurs.

Therefore, a masking process of causing ink not to be ejected from the abnormal ejection elements is performed on the abnormal ejection elements stored in abnormal ejection element information storage unit 45 illustrated in FIG. 2. Thus, non-ejection or ejection abnormality caused by the abnormal ejection elements can be prevented from being detected as electrical fault. The masking process of causing ink not to be ejected from the abnormal ejection elements is an aspect of nonuse of ejection elements in which abnormality has occurred.

Figure 14:
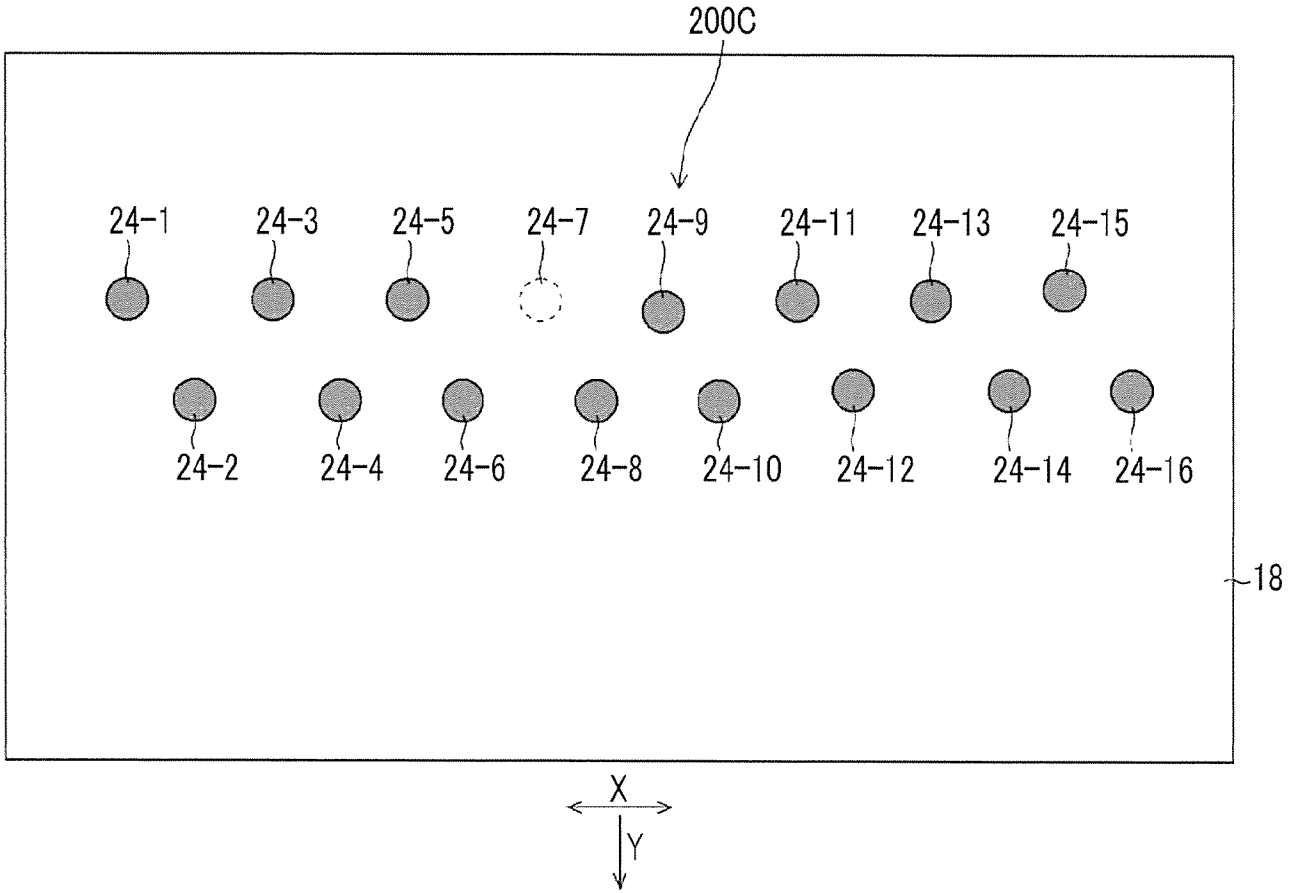
FIG. 14 is an illustrative diagram schematically illustrating an electrical fault detection pattern in a case where an abnormal ejection element masking process has been performed.

FIG. 14 is an illustrative diagram schematically illustrating an electrical fault detection pattern in a case where the abnormal ejection element masking process has been performed. An electrical fault detection pattern 200C illustrated in FIG. 14 is formed in a case where the masking process is performed on the ejection element 68-7 illustrated in FIG. 5.

The electrical fault detection pattern 200C illustrated in FIG. 14 lacks the dot 24-7 formed using the ink ejected from the ejection element 68-7, as compared with the electrical fault detection pattern 200 illustrated in FIG. 8. A broken line denoted with a reference sign 24-7 in FIG. 14 indicates a dot that is not formed.

The arrangement of the dots 24 included in the electrical fault detection pattern 200C illustrated in FIG. 14 is an aspect of the arrangement of the dots 24 satisfying the predetermined arrangement condition with the arrangement of the ejection elements 68 in the inkjet head 12 illustrated in FIG. 5.

Further, the electrical fault detection pattern 200C illustrated in FIG. 14 is an aspect of the electrical fault detection pattern satisfying the predetermined dot array number condition.

In a case where the masking process is performed on the ejection elements 68-1 to 68-16 illustrated in FIG. 5 and the ejection element 68-7 is deleted, the arrangement of the dots 24 included in the electrical fault detection pattern 200C illustrated in FIG. 14 satisfies the predetermined arrangement condition with the arrangement of the ejection elements 68 in the inkjet head 12 illustrated in FIG. 5 in that the dot 24-7 lacks.

In a case where the masking process is performed on the ejection elements 68-1 to 68-16 illustrated in FIG. 5 and the ejection element 68-7 is deleted, the numbers of the dots 24 formed using the ejection elements 68-1 to 68-6 and the ejection elements 68-7 to 68-16 illustrated in FIG. 5 are the same, and the dots 24 satisfy the predetermined dot array number condition.

The abnormal ejection element masking process described herein is also applicable to the second embodiment and the third embodiment that will be described below.

<Description of Flow of Electrical Fault Detection Procedure>

Figure 15:
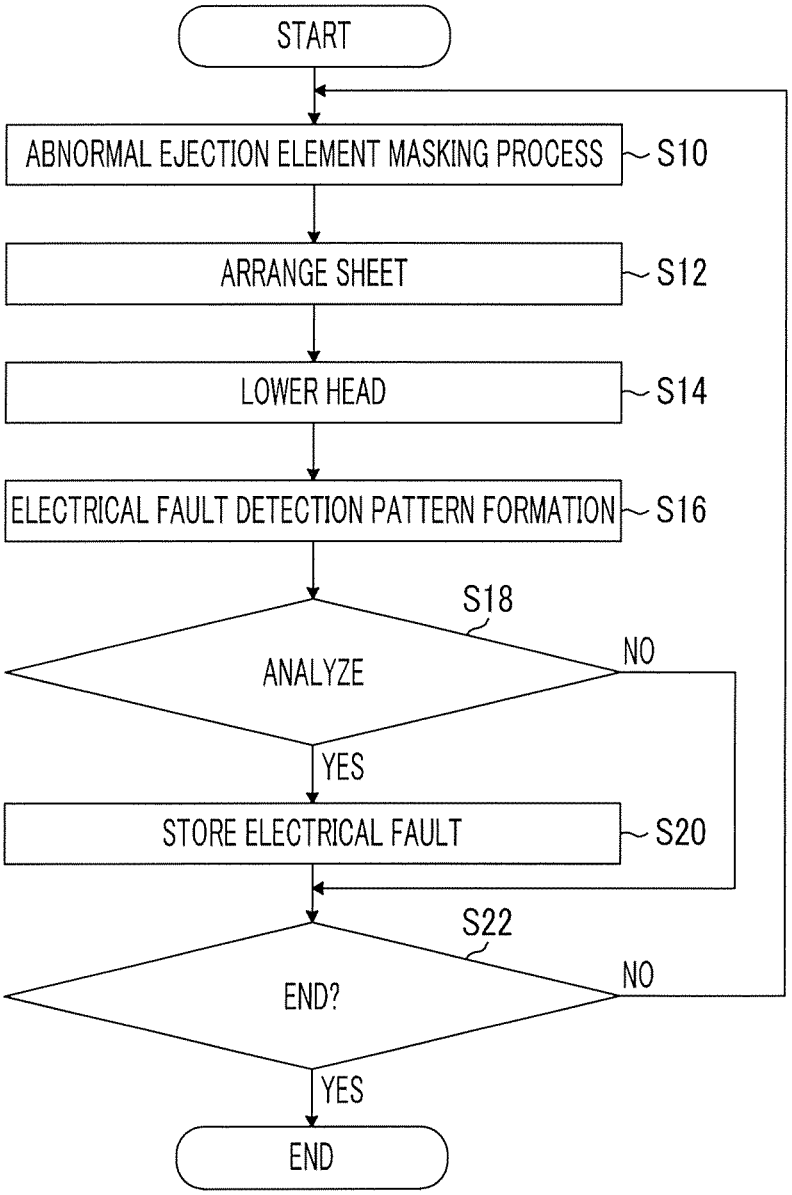
FIG. 15 is a flowchart illustrating a flow of a procedure of an electrical fault detection method according to the first embodiment.

FIG. 15 is a flowchart illustrating a flow of a procedure of the electrical fault detection method according to the first embodiment. If the electrical fault detection method starts, the identification information of the abnormal ejection element is read from the abnormal ejection element information storage unit 45 illustrated in FIG. 2 in the abnormal ejection element masking processing step S10. A masking process for an abnormal ejection element is executed.

In a case where an abnormal ejection element does not exist, the masking processing for the abnormal ejection element is not executed. In the following description, a case where the abnormal ejection element does not exist will be described.

If the abnormal ejection element masking processing step S10 illustrated in FIG. 15 ends, the process proceeds to a sheet arrangement step S12. In the sheet arrangement step S12, the sheet 18 is arranged at a support position of the sheet 18 in the conveyance belt 22 illustrated in FIG. 1.

After the sheet 18 is arranged in the sheet arrangement step S12 illustrated in FIG. 15, the process proceeds to a head lowering step S14. In the head lowering step S14, the inkjet head 12 is moved to an electrical fault detection pattern forming position using the head lifting and lowering unit 23 illustrated in FIG. 1.

After the inkjet head 12 illustrated in FIG. 1 is moved to the electrical fault detection pattern forming position in the head lowering step S14 illustrated in FIG. 15, the process proceeds to an electrical fault detection pattern formation step S16. A process of moving the inkjet head 12 to the electrical fault detection pattern formation position is an aspect of a process of changing a distance between the liquid ejection head and the medium supported by the relative conveyance unit.

In the electrical fault detection pattern formation step S16, the electrical fault detection pattern is formed. The formation of the electrical fault detection pattern in the electrical fault detection pattern formation step S16 indicates that the driving voltage is supplied to the inkjet head 12 illustrated in FIG. 1 on the basis of the ejection data of the electrical fault detection pattern.

After the electrical fault detection pattern is formed in the electrical fault detection pattern formation step S16, the process proceeds to an electrical fault detection pattern analysis step S18 illustrated in FIG. 15. The electrical fault detection pattern formation step S16 includes an ejection data acquisition step of acquiring the ejection data of the electrical fault detection pattern as a component. The electrical fault detection pattern formation step S16 includes a driving voltage supply step as a component.

In the electrical fault detection pattern analysis step S18, the electrical fault detection pattern formed on the sheet 18 in the electrical fault detection pattern formation step S16 is analyzed. In the electrical fault detection pattern analysis step S18, in a case where the arrangement of the dots 24 constituting the electrical fault detection pattern 200 illustrated in FIG. 8 satisfies the predetermined arrangement relationship with the arrangement of the ejection elements 68 illustrated in FIG. 5, the number of dots 24 formed using the ejection elements 68 illustrated in FIG. 5 satisfies the predetermined dot array number condition, and the areas of the respective dots 24 are the same, a result of the determination is a No determination.

In the case of the No determination, the process proceeds to an end determination step S22. On the other hand, in the electrical fault detection pattern analysis step S18, in a case where at least one of the above-described arrangement condition and the above-described dot array number condition is not satisfied or in a case where areas of some of the dots constituting the electrical fault detection pattern illustrated in FIG. 8 exceed areas of other dots, a result of the determination is a Yes determination.

In the case of the Yes determination, the process proceeds to an electrical fault storage step S20. In the electrical fault storage step S20, the identification information of the ejection element in which the electrical fault has occurred is stored in the electrical fault information storage unit 47 illustrated in FIG. 2.

In a case where a cause of the electrical fault is found in the electrical fault storage step S20 illustrated in FIG. 15, the identification information of the ejection element in which the electrical fault has occurred and the causes of the electrical fault are associated and stored.

After the identification information of the ejection element in which the electrical fault has occurred is stored in electrical fault storage step S20 illustrated in FIG. 15, the process proceeds to an end determination step S22. In the end determination step S22, it is determined whether or not the electrical fault detection ends.

In a case where it is determined in the end determination step S22 that the electrical fault detection does not end, a determination result is a No determination. In the case of the No determination, the process proceeds to the abnormal ejection element masking processing step S10, and the steps from the abnormal ejection element masking processing step S10 to the end determination step S22 are repeatedly executed.

An examples in which the determination result is the No determination in the end determination step S22 may include a case where the electrical fault detection is executed for some of the ejection elements that included in the inkjet head 12 illustrated in FIG. 1 and the electrical fault detection is not executed for all of the ejection elements.

Another examples in which the determination result is the No determination in the end determination step S22 may include a case where in which two or more electrical fault detections are executed and it is determined whether or not there is electrical fault using a result of the two or more electrical fault detections.

In a case where it is determined in the end determination step S22 that the electrical fault detection ends, a determination result is a Yes determination. In the case of the Yes determination, the electrical fault detection ends.

<Description of Pattern Formation Device>

A pattern formation device including components that form the electrical fault detection pattern 200 illustrated in FIG. 8, which are extracted from the inkjet recording device 10 illustrated in FIG. 1, can be formed.

Specifically, a pattern formation device including the ejection data acquisition unit 40, the waveform storage unit 42, and the head driving unit 44 illustrated in FIG. 2 can be formed. The pattern formation device may include the head lifting and lowering control unit 37. Further, the pattern formation device may include the abnormal ejection element information storage unit 45 that stores the abnormal ejection element information. The pattern formation device may include the electrical fault information storage unit 47.

Effects of First Embodiment

According to the pattern formation device, the inkjet recording device, and the electrical fault detection method configured as described above, it is possible to achieve the following effects.

<First Effect>

It is possible to detect the electrical fault of the inkjet head 12 on the basis of a result of the analysis of the electrical fault detection pattern.

<Second Effect>

In a case where there are dots having a larger area than other dots among the dots constituting the electrical fault detection pattern, it is possible to determine that at least one of a short circuit between the plurality of ejection elements and a short circuit between the electrical wirings electrically connected to the plurality of respective ejection elements has occurred.

<Third Effect>

When an electrical fault detection pattern is generated, the distance between the inkjet head and the sheet is shorter than that at the time of normal drawing. Accordingly, since a variation in a landing position of the ink due to a variation in the ejection state of each ejection element is suppressed, it is possible to prevent a variation in the ejection state of each ejection element from being determined to be electrical fault.

<Fourth Effect>

By performing the masking process on the abnormal ejection elements, non-ejection or ejection abnormality caused by the abnormal ejection elements can be prevented from being detected as electrical fault.

[Description of Electrical Fault Detection According to Second Embodiment]

Next, electrical fault detection according to a second embodiment will be described. In the second embodiment to be described below, differences between the first embodiment and the second embodiment will be mainly described. The same configuration as that in the first embodiment will be appropriately omitted.

<Description of Electrical Fault Detection Pattern Formation>

Figure 16:
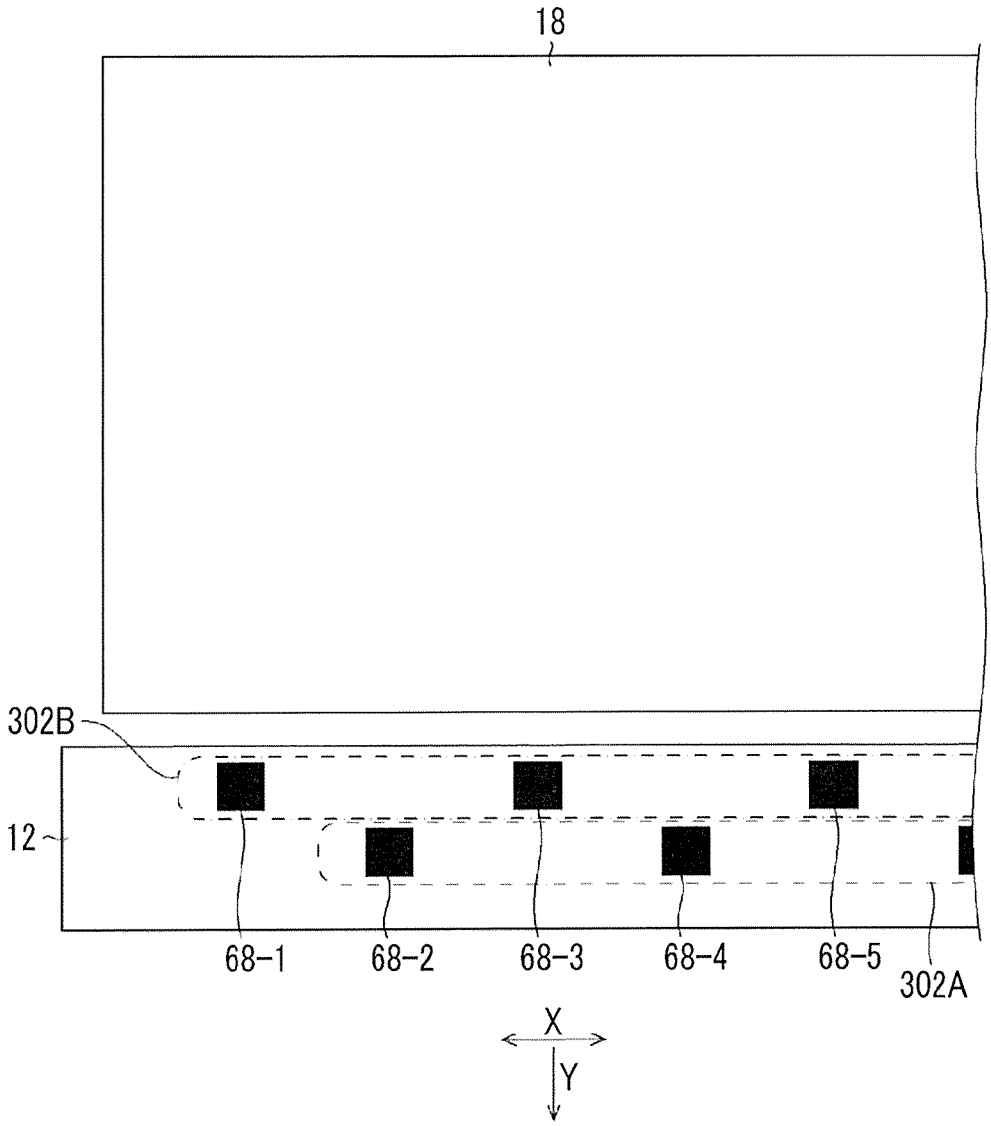
FIG. 16 is a schematic diagram of an electrical fault detection pattern formation in electrical fault detection applied to a liquid ejection device according to the second embodiment.

FIG. 16 is a schematic diagram of an electrical fault detection pattern formation in electrical fault detection applied to a liquid ejection device according to the second embodiment. In the electrical fault detection pattern formed in the electrical fault detection according to the second embodiment, a sheet 18 is conveyed in a sheet conveyance direction and the electrical fault detection pattern is generated.

In this embodiment, an aspect in which the sheet 18 is conveyed in the sheet conveyance direction relatively to the fixed inkjet head 12 is illustrated as an example of relative conveyance of the inkjet head 12 and the sheet 18.

For the relative conveyance of the inkjet head 12 and the sheet 18, an aspect in which the inkjet head 12 is conveyed relatively to the fixed sheet 18 may be applied. In the relative conveyance of the inkjet head 12 and the sheet 18, both of the inkjet head 12 and the sheet 18 may be relatively conveyed. The sheet conveyance direction is an aspect of the relative conveyance direction.

In the following description, the ejection element 68-2 and the ejection element 68-4 of which the sub-number is an even number are in the ejection element group 69A in the first row. The ejection element 68-1, the ejection element 68-3, and the ejection element 68-5 of which the sub-number is an odd number are in the ejection element group 69B in the second row.

<Description of Electrical Fault Detection Pattern>

Figure 17:
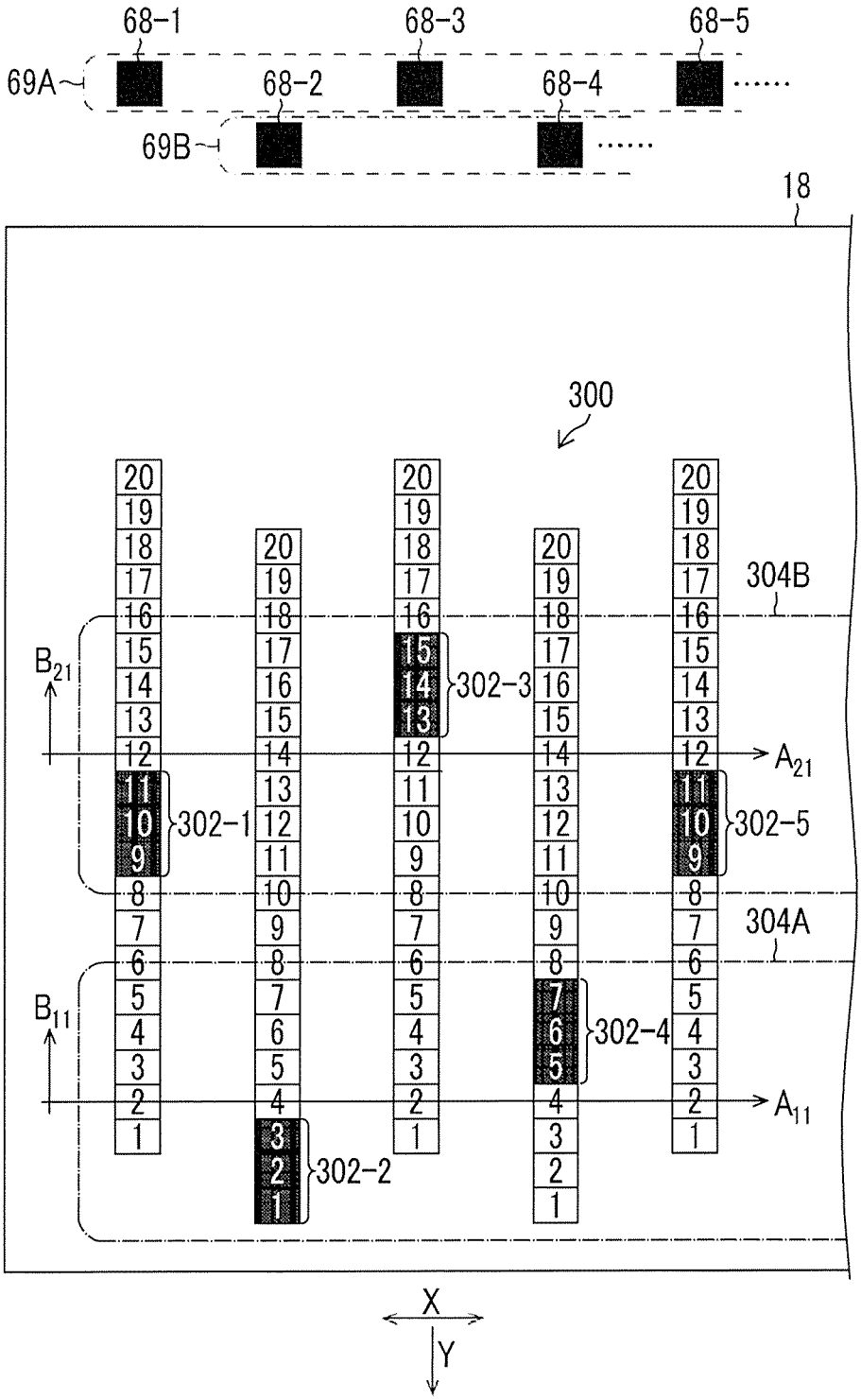
FIG. 17 is an illustrative diagram schematically illustrating an electrical fault detection pattern that is formed in a case where the electrical fault does not occur in electrical fault detection applied to the liquid ejection device according to the second embodiment.

FIG. 17 is an illustrative diagram schematically illustrating the electrical fault detection pattern in a case where the electrical fault does not occur in electrical fault detection applied to the liquid ejection device according to the second embodiment. In FIG. 17, the ejection elements 68-1 to 68-5 forming a dot array 302 constituting the electrical fault detection pattern are schematically illustrated.

The electrical fault detection pattern 300 illustrated in FIG. 17 includes a dot array 302-1 formed using the ejection element 68-1, a dot array 302-2 formed using the ejection element 68-2, a dot array 302-3 formed using the ejection element 68-3, a dot array 302-4 formed using the ejection element 68-4, and a dot array 302-5 formed using the ejection element 68-5.

Hereinafter, in a case where it is not necessary to distinguish among the dot array 302-1, the dot array 302-2, the dot array 302-3, the dot array 302-4, and the dot array 302-5, the dot array is described as a dot array 302.

Each dot array 302 is formed of three dots arranged continuously in the sheet conveyance direction. The dots constituting each dot array are formed from ink ejected at continuous ejection timings. In FIG. 17, for convenience of illustration, a reference sign of the clot is not illustrated. The dot array 302 illustrated in FIG. 17 may include one or more dots. In the following description, the term dot array can be replaced with a dot.

Cells in FIG. 17 indicate positions at which the dots may be formed in the sheet 18. Cells with a dot hatch indicate positions at which dots are actually formed. A numerical value assigned to each cell indicates a relative ejection timing. In the cells to which the same number is assigned, the dots can be formed at the same ejection timing.

The dot array 302-1, the dot arrays 302-2, the dot array 302-3, and the dot array 302-4 illustrated in FIG. 17 all include dots formed at different ejection timings. On the other hand, the dot array 302-1 and the dot array 302-5 include dots formed at the same ejection timing.

An arrangement of the dot arrays 302 constituting the electrical fault detection pattern 300 illustrated in FIG. 17 satisfies the arrangement condition determined in advance with the arrangement of the ejection elements 68 used in formation of each dot array 302.

Further, the number of dot arrays 302 constituting the electrical fault detection pattern 300 illustrated in FIG. 17 satisfies a predetermined dot array number condition. Hereinafter, the arrangement condition and the dot array number condition in the electrical fault detection pattern 300 will be described in detail.

In a first dot set second axis $B_{11}$, a maximum value of the coordinate values of the dot array 302-2 and the dot array 302-4 that are a plurality of first dot arrays included in the first dot set 304A is a coordinate value of a dot that is formed at a position with a numerical value 7 of the dot array 302-4.

In the first dot set second axis $B_{11}$, a minimum value of the coordinate values of the dot array 302-1, the dot array 302-3, and the dot array 302-5 that are a plurality of second dot arrays included in the second dot set 304B is a coordinate value of a dot that is formed at a position with a numerical value 9 of the dot array 302-1 and the dot array 302-5.

In the first clot set second axis $B_{11}$, since a maximum value of the coordinate value of the first dot set 304A is smaller than the minimum value of the coordinate value of the second dot set 304B, the arrangement of the dot arrays 302 in the electrical fault detection pattern 300 satisfies the predetermined arrangement condition with the arrangement of the ejection elements 68. The same applies to replacement of the first dot set second axis $B_{11}$ with the second dot set second axis $B_{21}$.

Further, each of the ejection element 68-1, the ejection element 68-3, and the ejection element 68-5 belonging to the ejection element group 69A of the first row forms one dot array 302. That is, the ejection element 68-1, the ejection element 68-3, and the ejection element 68-5 belonging to the ejection element group 69A of the first row form the same number of dot arrays 302.

Here, the dot array 302-1, the dot array 302-3, and the dot array 302-5 formed using the ejection element 68-1, the ejection element 68-3, and the ejection element 68-5 belonging to the ejection element group 69A of the first row correspond to a first dot array.

Similarly, each of the ejection element 68-2 and the ejection element 68-4 belong to the ejection element group 69B of the second row forms one dot array 302. That is, the ejection element 68-2 and the ejection element 68-4 belong to the ejection element group 69B of the second row form the same number of dot arrays 302.

In this case, the dot array 302-2 and the dot array 302-4 formed using the ejection element 68-2 and the ejection element 68-4 belonging to the ejection element group 69B of the second row corresponds to the second dot array.

Therefore, the electrical fault detection pattern 300 illustrated in FIG. 17 satisfies the predetermined dot array number condition. An electrical fault detection pattern in which a plurality of dot arrays are formed using the respective ejection elements 68 can be formed.

If the electrical fault detection pattern 300 in which the arrangement of the dot arrays 302 satisfies the predetermined arrangement condition with the arrangement of the ejection elements 68 and the number of dot arrays 302 satisfies the predetermined dot array condition is formed, it can be determined that electrical fault of the inkjet head 12 does not occur.

Further, an arrow line denoted with reference sign $A_{11}$ indicates the first dot set first axis. An arrow line denoted with reference sign $A_{21}$ indicates the second dot set first axis. An arrow line denoted with reference sign $B_{22}$ indicates the second dot set second axis.

In the electrical fault detection pattern 300 illustrated in FIG. 17, the dot array 302 formed using the two ejection elements 68 in which a short circuit is likely to be occur is located at a distance corresponding to a period of at least two ejection cycles in the sheet conveyance direction.

The two ejection elements 68 in which a short circuit is likely to be occur are two ejection elements 68 arranged at positions adjacent to each other in the sheet width direction or two ejection elements 68 arranged at positions adjacent to each other in an oblique direction intersecting the sheet width direction.

The two ejection elements 68 arranged at positions adjacent to each other in the sheet width direction may include the ejection element 68-1 and the ejection element 68-3, the ejection element 68-2 and the ejection element 68-4, and the ejection element 68-3 and the ejection element 68-5.

The two ejection elements 68 arranged at positions adjacent to each other in the oblique direction obliquely intersecting the sheet width direction may include the ejection element 68-1 and the ejection element 68-2, the ejection element 68-2 and the ejection element 68-3, the ejection element 68-3 and the ejection element 68-4, and the ejection element 68-5 and the ejection element 68-4.

In the electrical fault detection pattern 300 illustrated in FIG. 17, an arrangement interval between the dot array 302-1 formed using the ejection element 68-1 and the dot array 302-3 formed using the ejection element 68-3 is a distance corresponding to a period of two ejection cycles.

Further, an arrangement interval between the dot array 302-2 formed using the ejection element 68-2 and the dot array 302-4 formed using the ejection element 68-4 is a distance equal to or larger than the distance corresponding to the period of two ejection cycles.

The distance corresponding to the period of two ejection cycles can be obtained by multiplying the conveyance speed of the sheet 18 by the period of the two ejection cycles.

Since the dot array 302 formed using two ejection elements 68 in which a short circuit is likely to occur is located at a distance corresponding to the period of at least two ejection cycles in the sheet conveyance direction, it is easy to recognize each dot array 302 and it is easy to determine whether or not abnormality occurs in the arrangement of the dot arrays 302.

Figure 18:
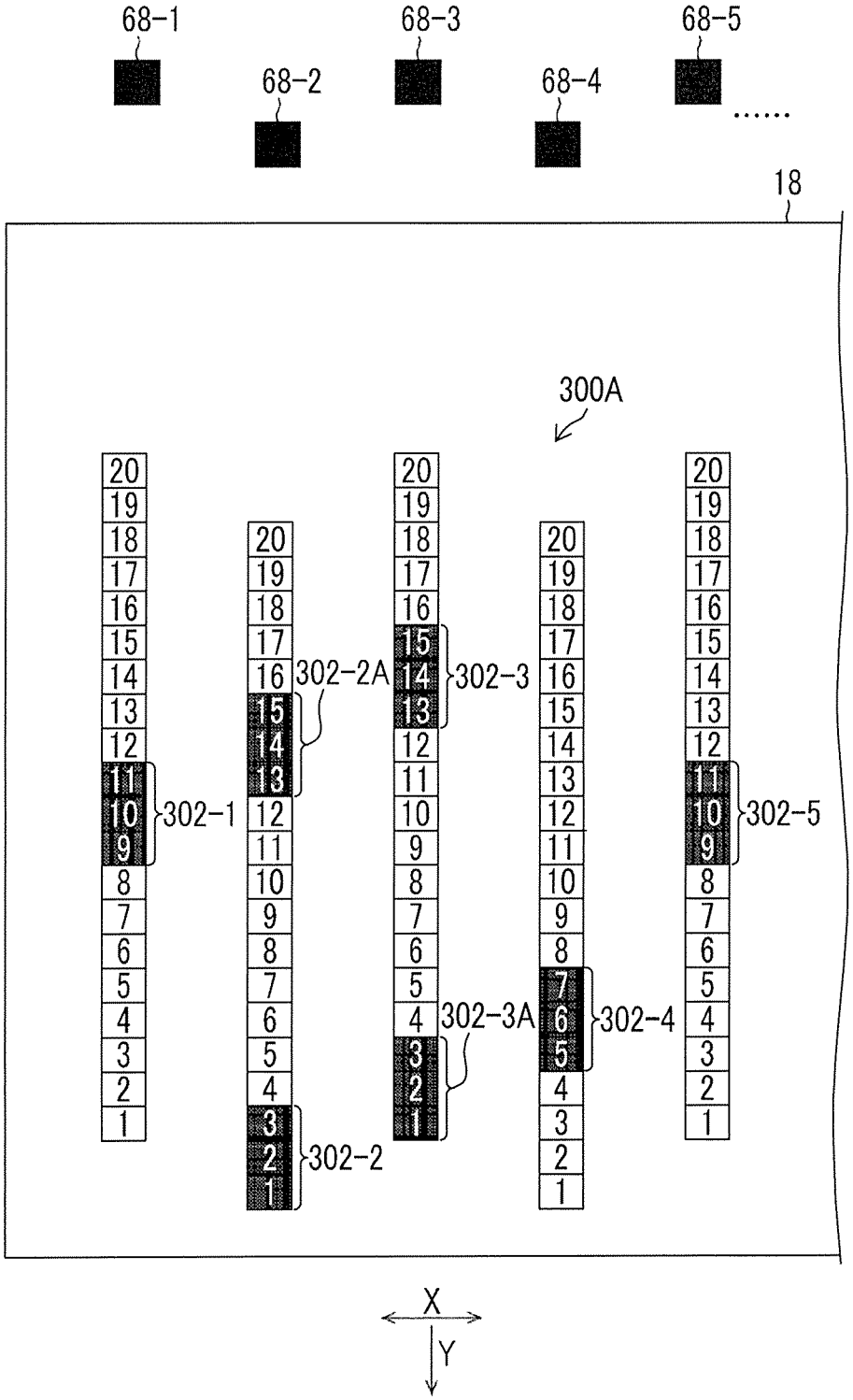
FIG. 18 is an illustrative diagram schematically illustrating an example of the electrical fault detection pattern that is formed in a case where electrical fault occurs in electrical fault detection that is applied to the liquid ejection device according to the second embodiment.

FIG. 18 is an illustrative diagram schematically illustrating an example of the electrical fault detection pattern that is formed in a case where electrical fault occurs in electrical fault detection that is applied to the liquid ejection device according to the second embodiment. In FIG. 18, for convenience of illustration, the single dotted line indicating the ejection element group of the first row, the reference sign 69A indicating the ejection element group of the first row, the single dotted indicating the ejection element group of the second row, and the reference sign 69B indicating the ejection element group of the second row illustrated in FIG. 17 are not illustrated.

Further, in FIG. 18, for convenience of illustration, the single dotted line indicating the first dot set, the reference sign 304A indicating the first dot set, the single dotted line indicating the second dot set, and the reference sign 304B indicating the second dot set illustrated in FIG. 17 are not illustrated.

Further, in FIG. 18, for convenience of illustration, the first dot set first axis $A_{11}$, the first dot set second axis $B_{11}$, the second dot set first axis $A_{21}$, and the second dot set second axis $B_{21}$ illustrated in FIG. 17 are not illustrated. The same applies to FIGS. 19 to 23.

In the electrical fault detection pattern 300A illustrated in FIG. 18, a dot array 302-2A and a dot array 302-3A not formed in the electrical fault detection pattern 300 illustrated in FIG. 17 are formed.

The electrical fault detection pattern 300A includes a dot array 302-2 and the dot array 302-2A that are two dot arrays formed using the ejection element 68-2. Similarly, the electrical fault detection pattern 300A includes a dot array 302-3 and the dot array 302-3A that are two dot arrays formed using the ejection element 68-3.

Further, the electrical fault detection pattern 300A includes a dot array 302-1 that is one dot array formed using the ejection element 68-1, a dot array 302-4 that is one dot array formed using the ejection element 68-4, and a dot array 302-5 that is one dot array formed using the ejection element 68-5.

That is, each of the ejection element 68-1, the ejection element 68-3, and the ejection element 68-5 belonging to the ejection element group 69A of the first row does not form the same number of dot arrays 302. Further, each of the ejection element 68-2 and the ejection element 68-4 belonging to the ejection element group 69B of the second row does not the same number of dot arrays 302.

Thus, the electrical fault detection pattern 300A illustrated in FIG. 18 does not satisfy the dot array number condition.

Since the dot array 302-2A is formed using the ejection element 68-2, the dot array 302-2A is a dot array belonging to the first dot set 304A illustrated in FIG. 17. Further, since the dot array 302-3A is formed using the ejection element 68-3, the dot array 302-2A is a dot arrays belonging to the second dot set 304B illustrated in FIG. 17.

In the electrical fault detection pattern 300A illustrated in FIG. 18, a maximum value of the coordinate value of the first dot set 304A in the first dot set second axis $B_{11}$ illustrated in FIG. 17 is a dot at a position with a numerical value 15 in the dot array 302-2A, and a minimum value of the coordinate value of the second dot set 304B is a dot at a position with a numerical value 15 of the dot array 302-1 and the dot arrays 302-5.

That is, in the electrical fault detection pattern 300A illustrated in FIG. 18, a maximum value of the coordinate value of the first dot set 304A is not smaller than a minimum value of the coordinate value of the second dot set 304B. Therefore, in the electrical fault detection pattern 300A, the arrangement of the dot arrays 302 does not satisfy the predetermined arrangement condition with the arrangement of the ejection elements 68.

Then, in a case where the electrical fault detection pattern 300A illustrated in FIG. 18 is formed, it can be determined that electrical fault of the inkjet head 12 occurs. At an ejection timing with a numerical value 1, an ejection timing with a numerical value 2, and an ejection timing with a numerical value 3, the dot array 302-2 and the dot array 302-3A are formed using the ejection element 68-2 and the ejection element 68-3. Further, at an ejection timing with a numerical value 13, an ejection timing with a numerical value 14, and an ejection timing with a numerical value 15, the dot array 302-2A and the dot array 302-3 are formed using the ejection element 68-2 and the ejection element 68-3.

Then, it can be determined that a short circuit occurs in at least one of between the ejection element 68-2 and the ejection element 68-3 and between the electrical wiring electrically connected to the ejection element 68-2 and the electrical wiring electrically connected to the ejection element 68-3.

Figure 19:
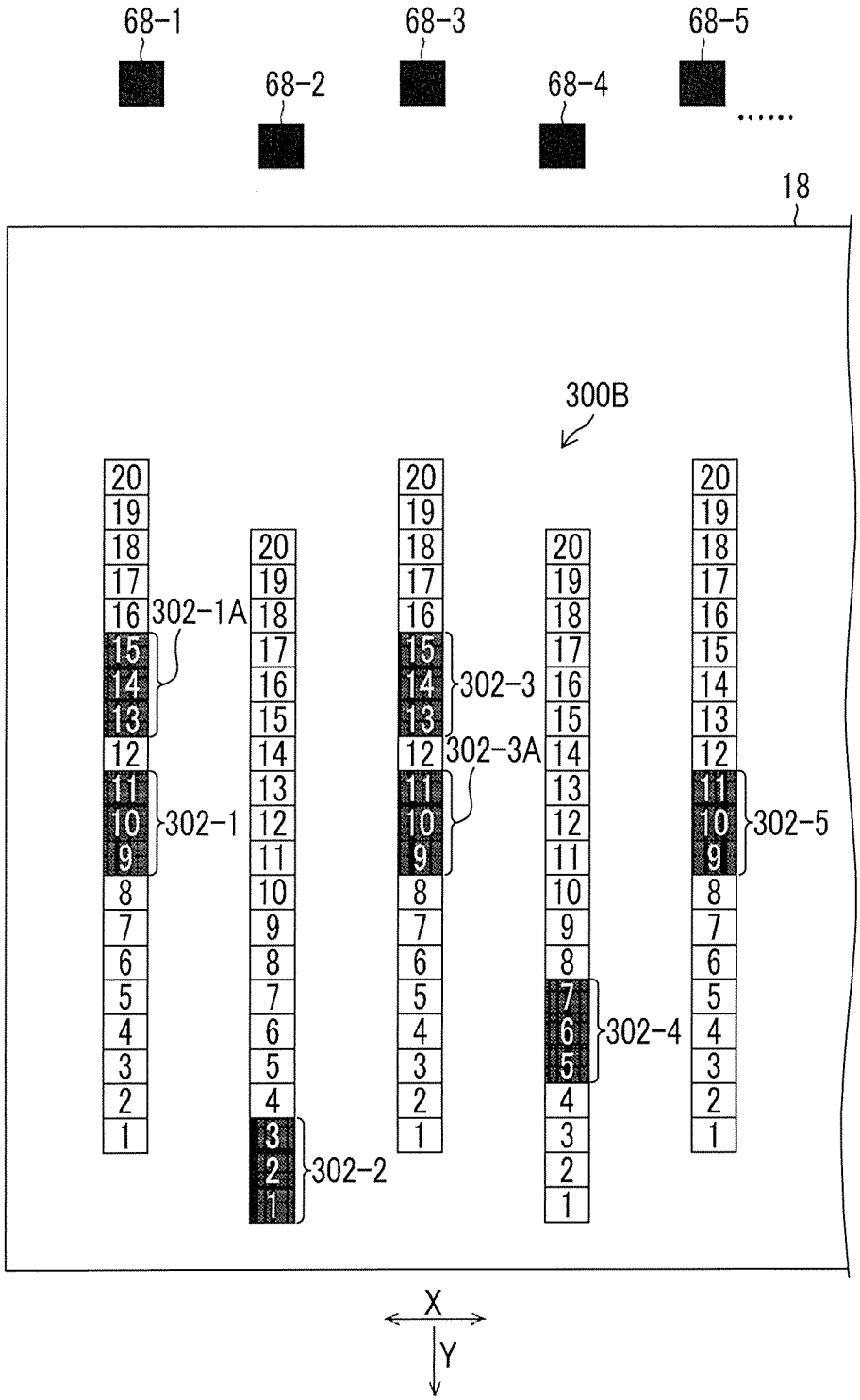
FIG. 19 is an illustrative diagram schematically illustrating another example of the electrical fault detection pattern that is formed in a case where electrical fault occurs in electrical fault detection that is applied to the liquid ejection device according to the second embodiment.

FIG. 19 is an illustrative diagram schematically illustrating another example of the electrical fault detection pattern that is formed in a case where electrical fault occurs in electrical fault detection that is applied to the liquid ejection device according to the second embodiment. The electrical fault detection pattern 300B illustrated in FIG. 19 is formed in a case where the ejection element 68-1 and the ejection element 68-3 are short-circuited.

The electrical fault detection pattern 300B illustrated in FIG. 19 includes the dot array 302-1A and the dot array 302-3A, which have not been originally formed, due to a short circuit between the ejection element 68-1 and the ejection element 68-3.

In the electrical fault detection pattern 300B illustrated in FIG. 19, the arrangement of the dot arrays 302 satisfies the predetermined arrangement condition with the arrangement of the ejection elements 68, but since the number of dot arrays 302 formed using the ejection element 68-1 and the ejection element 68-3 is different the number of dot arrays 302 formed using the ejection element 68-2, the ejection element 68-4, and the ejection element 68-5, the electrical fault detection pattern 300B illustrated in FIG. 19 does not satisfy the dot array number condition.

Therefore, it can be detected that a short circuit between the ejection element 68-1 and the ejection element 68-3 that are two ejection elements 68 occurs.

Further, the ejection element 68-1 used for formation of the dot array 302-1A and the ejection element 68-3 used for formation of the dot array 302-3A can be detected as the ejection elements 68 in which a short circuit occurs on the basis of the positions of the dot array 302-1A and the dot array 302-3A that have not been originally formed.

<Description of First Modification Example of Electrical Fault Detection Pattern>

Figure 20:
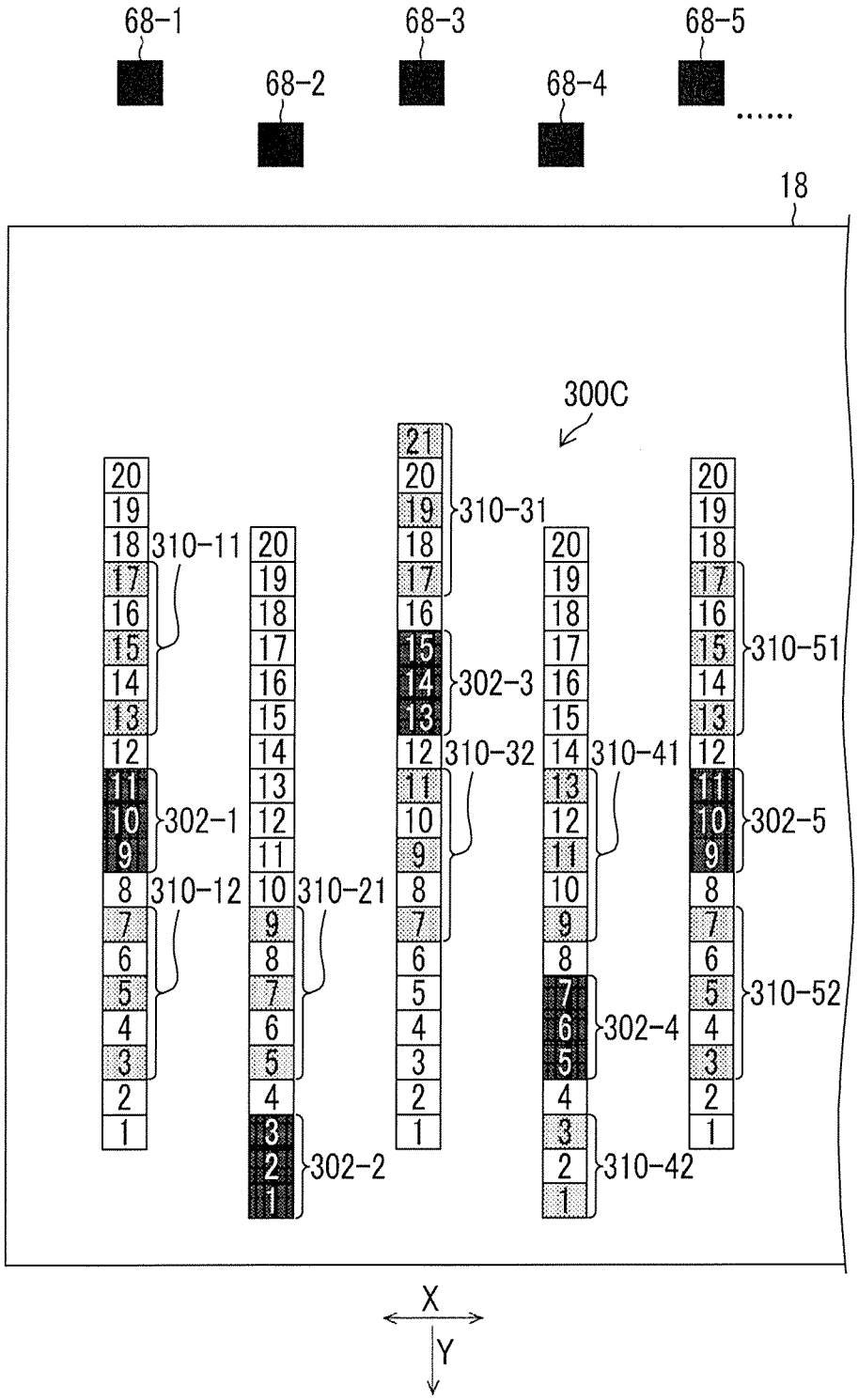
FIG. 20 is an illustrative diagram of a first modification example of the electrical fault detection pattern that is applied to the electrical fault detection applied to the liquid ejection device according to the second embodiment.

FIG. 20 is an illustrative diagram of a first modification example of an electrical fault detection pattern that is applied to the electrical fault detection according to the second embodiment. In an electrical fault detection pattern 300C illustrated in FIG. 20, a first auxiliary pattern 310 is added to at least one of an upstream side and a downstream side in the sheet conveyance direction of each dot array 302 in the electrical fault detection pattern 300 illustrated in FIG. 17.

A numerical value of a ten place of the sub-number added to the first auxiliary pattern 310 corresponds to the sub-number of the ejection element 68. In a case where a numerical value of one-place numbers of the sub-number denoting the first auxiliary pattern 310 is 1, this indicates that the first auxiliary pattern 310 is formed on the upstream side in the sheet conveyance direction. In a case where the numerical value of one-place numbers of the sub-number denoting the first auxiliary pattern 310 is 2, this indicates that the first auxiliary pattern 310 is formed on the downstream side in the sheet conveyance direction.

Dots constituting each first auxiliary pattern 310 are formed using intermittently ejected ink. An arrangement interval of the dots constituting each first auxiliary pattern 310 is a distance corresponding to a period of two ejection cycle.

Further, each of the first auxiliary patterns 310 is arranged at a distance corresponding to the period of the two ejection cycles between the clot arrays 302. The first auxiliary pattern 310 illustrated in FIG. 20 is an aspect of an auxiliary pattern of a dotted line in the relative conveyance direction. Further, the first auxiliary pattern 310 illustrated in FIG. 20 is an aspect of an auxiliary pattern of a broken line in the relative conveyance direction.

Figure 21:
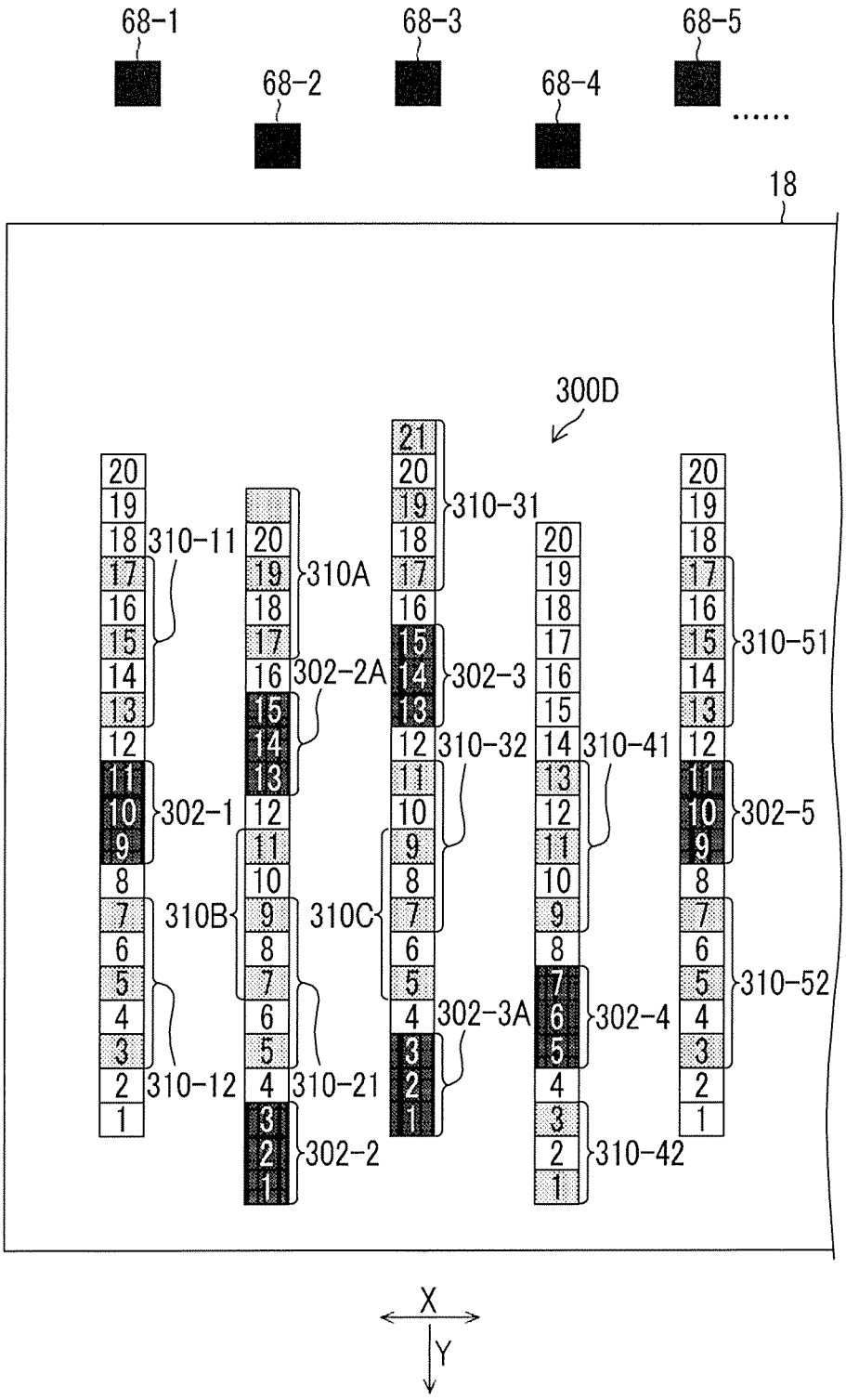
FIG. 21 is an illustrative diagram schematically illustrating an electrical fault detection pattern with a first auxiliary pattern in a case in which electrical fault occurs.

FIG. 21 is an illustrative diagram schematically illustrating the electrical fault detection pattern with the first auxiliary pattern in a case in which electrical fault occurs. An electrical fault detection pattern 300D illustrated in FIG. 21 is formed in a case where the ejection element 68-2 and the ejection element 68-3 are short-circuited.

In the electrical fault detection pattern 300D illustrated in FIG. 21, a dot array 302-2A and a dot array 302-3A that are not originally formed, and a first auxiliary pattern 310A, a first auxiliary pattern 310B, and a first auxiliary pattern 310C that are not formed originally are formed.

In the electrical fault detection pattern according to the first modification example, a position in the sheet conveyance direction of the dot array deviating from a regular arrangement is easily recognized. A relationship between the dot array deviating from the regular arrangement and the ejection elements is easily recognized.

An area of the dots constituting the first auxiliary pattern 310 may be smaller than the area of the dots constituting the dot array 302, or a concentration of the dots constituting the first auxiliary pattern 310 is lower than the concentration of the dots constituting the dot array 302. Accordingly, it is easy to distinguish between the dot array 302 and the first auxiliary pattern 310. The same applies to second to fifth modification examples to be described below.

For example, if the size of the dots can be set in three steps including large, medium, and small, in a case where the size of the dots constituting the dot array 302 is large, the size of the dots constituting the first auxiliary pattern may be medium or small.

Further, for the dots constituting the first auxiliary pattern 310, color different from that of the dots constituting the dot array 302 is applied. Accordingly, it is easy to distinguish between the dot array 302 and the first auxiliary pattern 310. Further, it is possible to prevent complexity when the first auxiliary pattern 310 is formed using the inkjet head 12 in which electrical abnormality occurs.

It is more preferable for the dots constituting the first auxiliary pattern 310 to have lighter color than the dots constituting the dot array 302. For example, in a case where the dot array 302 is black, cyan or yellow may be applied for the first auxiliary pattern 310. The same applies to second to fifth modification examples to be described below.

<Description of Second Modification Example of Electrical Fault Detection Pattern>

Figure 22:
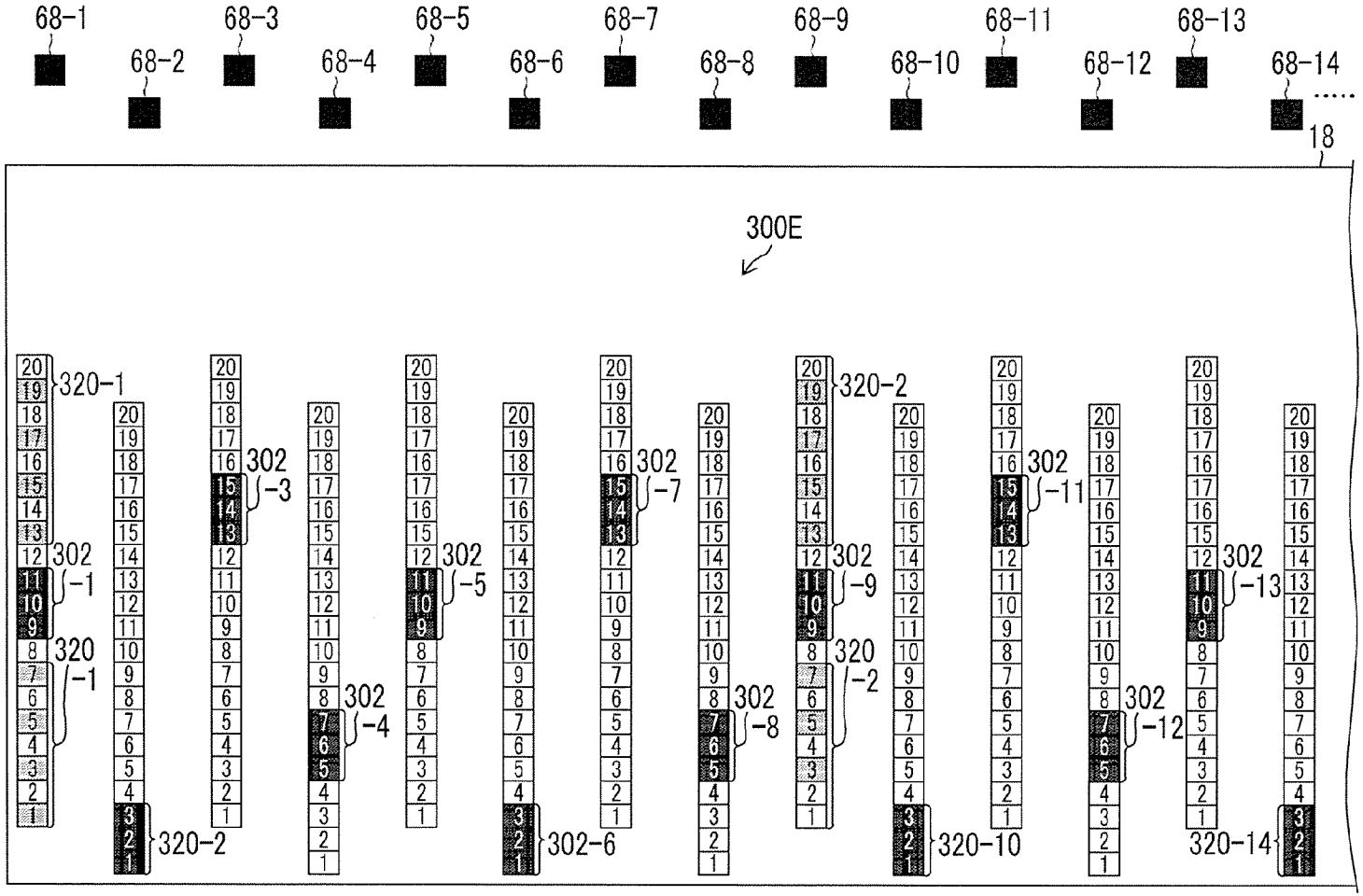
FIG. 22 is an illustrative diagram of a second modification example of the electrical fault detection pattern that is applied to the electrical fault detection applied to the liquid ejection device according to the second embodiment.

FIG. 22 is an illustrative diagram of a second modification example of the electrical fault detection pattern that is applied to the electrical fault detection applied to the liquid ejection device according to the second embodiment. In FIG. 22, fourteen ejection elements 68 among the sixteen ejection elements 68 illustrated in FIG. 5 are illustrated. Further, in FIG. 22, fourteen dot arrays 302 formed using the fourteen ejection elements 68 are illustrated.

In an electrical fault detection pattern 300E illustrated in FIG. 22, a second auxiliary pattern 320-1 and a second auxiliary pattern 320-2 are added to the electrical fault detection pattern 300 illustrated in FIG. 17. The second auxiliary pattern 320-1 is formed using the ejection element 68-1. The second auxiliary pattern 320-2 is formed using the ejection element 68-9.

The electrical fault detection pattern 300E includes a plurality of second auxiliary patterns 320 (not illustrated), in addition to the second auxiliary pattern 320-1 and the second auxiliary pattern 320-2 illustrated in FIG. 22. In a case where it is not necessary to distinguish among the plurality of second auxiliary patterns, a sub-number of the reference sign 320 is omitted.

According to the electrical fault detection pattern 300E according to the second modification example, since the second auxiliary pattern 320 functions as a scale when the position of the dot array is recognized, it is easy to recognize the position of the dot array 302.

Further, in a case where read data obtained by reading the electrical fault detection pattern 300E using a reading device is analyzed, the second auxiliary pattern 320 can function as a mark when the position of each dot array 302 is specified, and it is easy to create an analysis program for the read data.

In the electrical fault detection pattern 300E illustrated in FIG. 22, an arrangement interval in the sheet width direction of the second auxiliary patterns 320 formed at positions adjacent to each other are eight times. The arrangement interval in the sheet width direction of the second auxiliary patterns 320 formed at positions adjacent to each other can be a positive integer multiple of the arrangement interval of the dot arrays 302 in the sheet width direction.

Further, the second auxiliary pattern 320 may be formed only at a position on the upstream side in the sheet conveyance direction of the dot array 302. The second auxiliary pattern 320 may be formed only at a position on the downstream side in the sheet conveyance direction of the dot array 302.

That is, the second auxiliary pattern 320 may be formed at at least one of the position on the upstream side in the sheet conveyance direction of the dot array 302 and the position on the downstream side in the sheet conveyance direction of the dot array 302.

A length in the sheet conveyance direction of the second auxiliary pattern 320 can be appropriately determined from the viewpoint of a function as a scale. In the electrical fault detection pattern 300E illustrated in FIG. 22, an arrangement interval in the sheet conveyance direction of the dots constituting the second auxiliary pattern 320 is a distance corresponding to the period of two ejection cycles.

The arrangement interval in the sheet conveyance direction of the dots constituting the second auxiliary pattern 320 is not limited to the distance corresponding to the period of the two ejection cycles. However, from the viewpoint of distinguishment from the dot array 302, it is preferable for the dots constituting the second auxiliary pattern 320 to be located at a distance equal to larger than the distance corresponding to the period of the two ejection cycles in the sheet conveyance direction.

<Description of Third Modification Example of Electrical Fault Detection Pattern>

Figure 23:
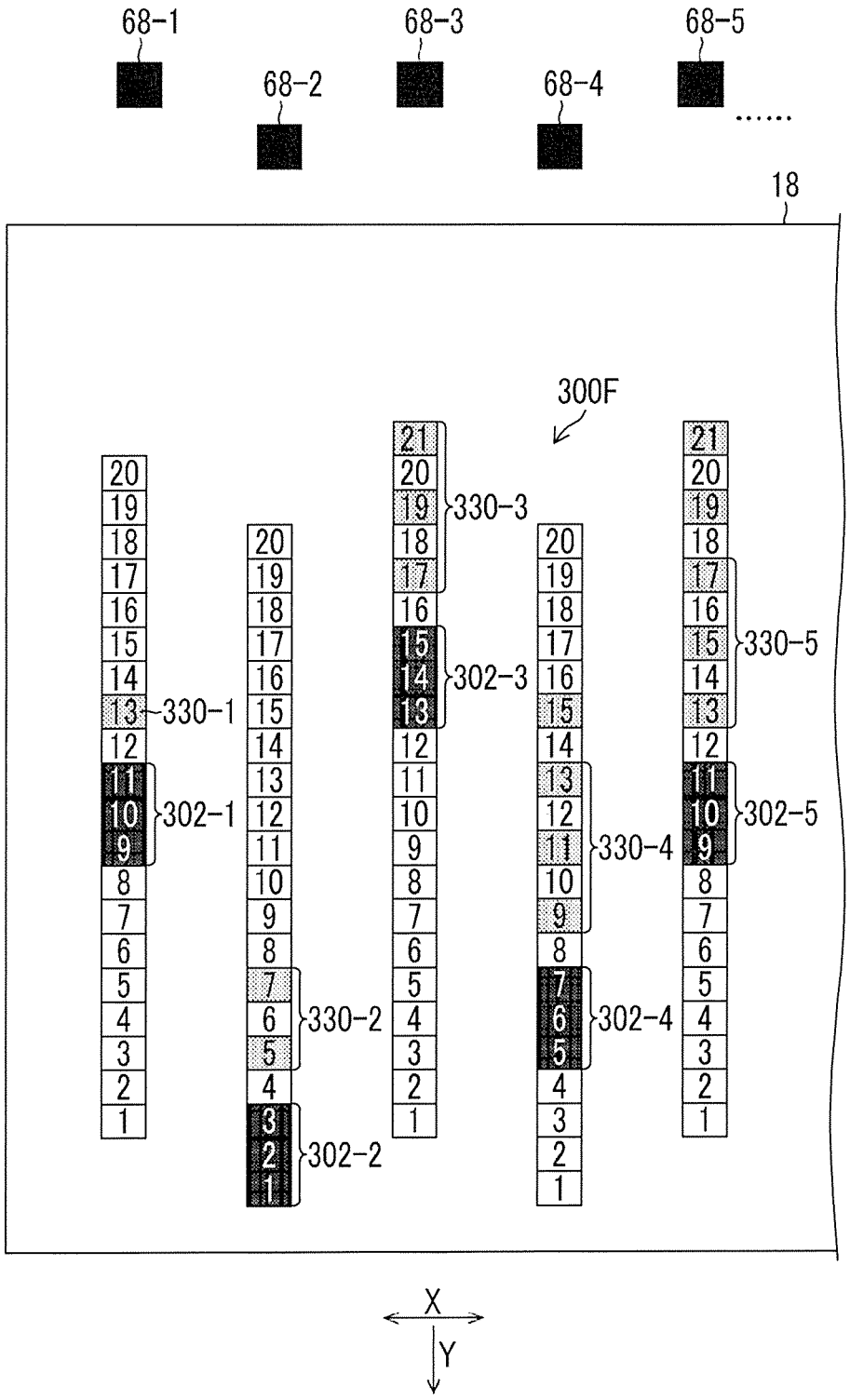
FIG. 23 is an illustrative diagram of a third modification example of the electrical fault detection pattern that is applied to the electrical fault detection applied to the liquid ejection device according to the second embodiment.

FIG. 23 is an illustrative diagram of a third modification example of the electrical fault detection pattern that is applied to the electrical fault detection applied to the liquid ejection device according to the second embodiment. In an electrical fault detection pattern 300F illustrated in FIG. 23, third auxiliary patterns 330-1 to 330-5 including the number of dots corresponding to a numerical value indicating the position of the dot array 302 are added.

The electrical fault detection pattern 300F includes a plurality of third auxiliary patterns 330 (not illustrated), in addition to the third auxiliary patterns 330-1 to 330-5 illustrated in FIG. 23. In a case where it is not necessary to distinguish among the plurality of third auxiliary patterns, a sub-number of reference sign 330 is omitted.

The third auxiliary pattern 330 illustrated in FIG. 23 includes the same number of dots as a numerical value of one place of the identification number of the ejection element 68 forming the dot array to which the third auxiliary pattern 330 is added.

According to the electrical fault detection pattern 300F according to the third modification example, since the number of dots constituting the third auxiliary patterns 330 corresponds to the identification number of the ejection element, it is easy to recognize an ejection element in which electrical fault occurs.

Although the third auxiliary pattern 330 illustrated in FIG. 23 is formed at a position on the upstream side in the sheet conveyance direction of the dot arrays 302, the third auxiliary pattern 330 may be formed at at least one of the position on the upstream side in the sheet conveyance direction of the dot arrays 302 and a position on the downstream side in the sheet conveyance direction.

Further, the arrangement interval in the sheet conveyance direction of the dots constituting the third auxiliary pattern 330 is not limited to the distance corresponding to the period of the two ejection cycles. An arrangement interval in the sheet conveyance direction of the dots constituting the third auxiliary pattern 330 may be a distance equal to or larger than a distance corresponding to the period of three ejection cycles in the sheet conveyance direction.

From the viewpoint of easiness of counting of the number of dots constituting the third auxiliary patterns 330, it is preferable for an arrangement interval in the sheet conveyance direction of the dots constituting the third auxiliary pattern 330 to be an equal interval.

<Description of Fourth Modification Example of Electrical Fault Detection Pattern>

Figure 24:
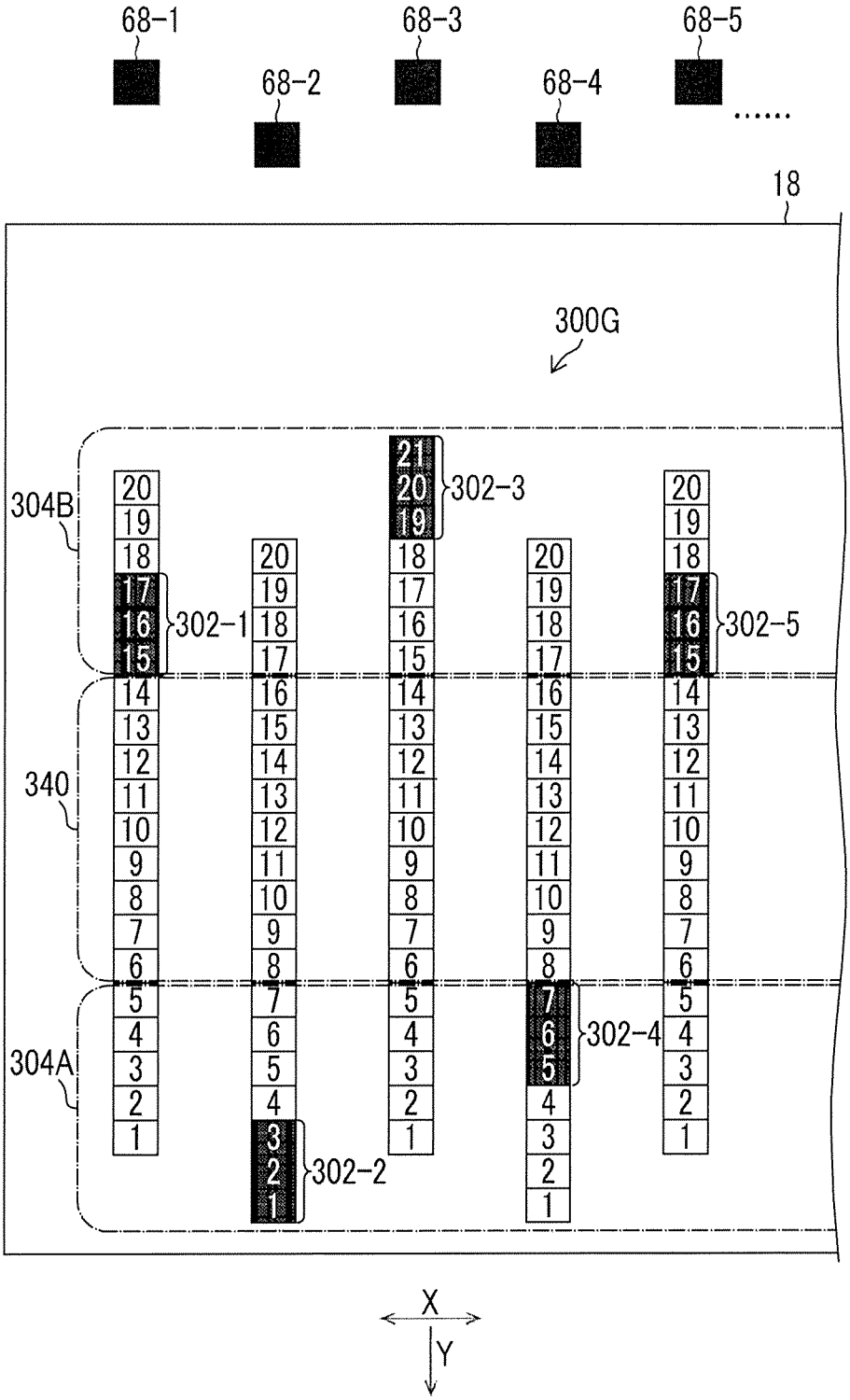
FIG. 24 is an illustrative diagram of a fourth modification example of the electrical fault detection pattern that is applied to the electrical fault detection applied to the liquid ejection device according to the second embodiment.

FIG. 24 is an illustrative diagram of a fourth modification example of the electrical fault detection pattern that is applied to the electrical fault detection applied to the liquid ejection device according to the second embodiment. In an electrical fault detection pattern 300G illustrated in FIG. 24, an arrangement interval in the sheet conveyance direction between a first dot set 304A and a second dot set 304B is a distance exceeding an arrangement interval in the sheet width direction of ejection elements 68 arranged at a position adjacent to one another in the sheet width direction.

That is, in the electrical fault detection pattern 3006, a dot array non-formation area 340 is provided between the first dot set 304A and the second dot set 304B in the sheet conveyance direction. A distance in the sheet conveyance direction of the dot array non-formation area 340 illustrated in FIG. 24 is a distance exceeding the arrangement interval in the sheet width direction of the ejection elements 68 arranged at a position adjacent to one another in the sheet width direction.

An example of the ejection elements 68 arranged at positions adjacent to each other in the sheet width direction may include the ejection element 68-1 and the ejection element 68-3, the ejection element 68-2 and the ejection element 68-4, and the ejection element 68-3 and the ejection element 68-5 illustrated in FIG. 24.

In a case where image formation resolution is 600 clots per inch, an arrangement interval between the ejection element 68-1 and the ejection element 68-3 in the sheet width direction is 84 micrometers. This numerical value is a numerical value obtained by rounding off a first decimal place.

According to the electrical fault detection pattern 300G illustrated in FIG. 24, physical positions of the first dot set 304A and the second dot set 304B in the sheet conveyance direction are emphasized. Then, it is easy to determine whether or not a dot array caused by electrical fault of the ejection element 68 is formed at the same position in the sheet width direction as that of each dot array 302.

The emphasis of the physical position described herein refers to the fact that, in the sheet conveyance direction, an arrangement interval between the first dot set 304A and the second dot set 304B is larger than an arrangement interval between the dot arrays of the first dot set 304A and the second dot set 304B.

<Description of Fifth Modification Example of Electrical Fault Detection Pattern>

Figure 25:
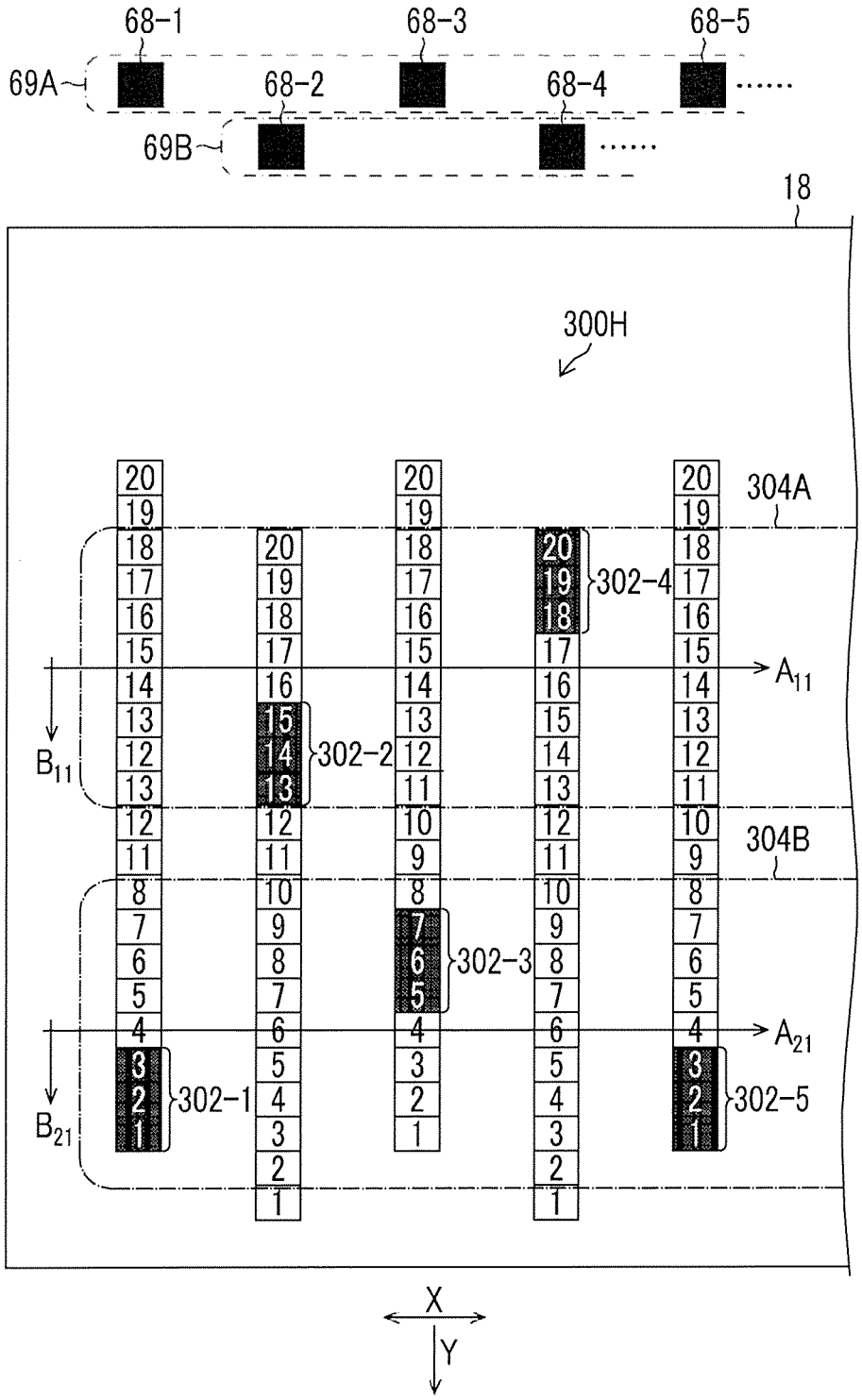
FIG. 25 is an illustrative diagram of a fifth modification example of the electrical fault detection pattern that is applied to the electrical fault detection applied to the liquid ejection device according to the second embodiment.

FIG. 25 is an illustrative diagram of a fifth modification example of the electrical fault detection pattern that is applied to the electrical fault detection applied to the liquid ejection device according to the second embodiment. An electrical fault detection pattern 300H illustrated in FIG. 25 is obtained by inverting the electrical fault detection pattern 300 illustrated in FIG. 17 in the sheet conveyance direction.

In the electrical fault detection pattern 300H illustrated in FIG. 25, a clot array 302-1, a dot array 302-3, and a dot array 302-5 formed using an ejection element group 69A of a first row are arranged on the downstream side in the sheet conveyance direction relative to a dot array 302-2 and a dot array 302-4 formed using an ejection element group 69B of a second row.

That is, in the electrical fault detection pattern 300H illustrated in FIG. 25, an arrangement in the sheet conveyance direction of the dot array 302-1, the dot array 302-3, and the dot array 302-5 formed using the ejection element group 69A of the first row and the dot array 302-2 and the dot array 302-4 formed using the ejection element group 69B of the second row in the electrical fault detection pattern 300 illustrated in FIG. 17 has been replaced.

In other words, the electrical fault detection pattern 300H illustrated in FIG. 25 is obtained by rotating the electrical fault detection pattern 300 illustrated in FIG. 17 by 180° in a surface of the sheet 18.

A direction of a first dot set second axis $B_{11}$ and a direction of a second dot set second axis $B_{21}$ in the electrical fault detection pattern 300 illustrated in FIG. 25 are opposite to the direction of the first dot set second axis $B_{11}$ and the direction of the second dot set second axis $B_{21}$ in the electrical fault detection pattern 300H illustrated in FIG. 17.

In the electrical fault detection pattern 300H illustrated in FIG. 25, it is possible to detect the electrical fault of the inkjet head 12 illustrated in FIG. 1 according to whether or not the arrangement of the dot arrays 302 satisfies the predetermined arrangement condition with the arrangement of the ejection elements 68 and whether or not the arrangement satisfies the dot array number condition, similar to the electrical fault detection pattern 300 illustrated in FIG. 17.

The modification examples of the second embodiment described above are also applicable to a third embodiments to be described below.

<Description of Flow of Electrical Fault Detection Procedure>

Figure 26:
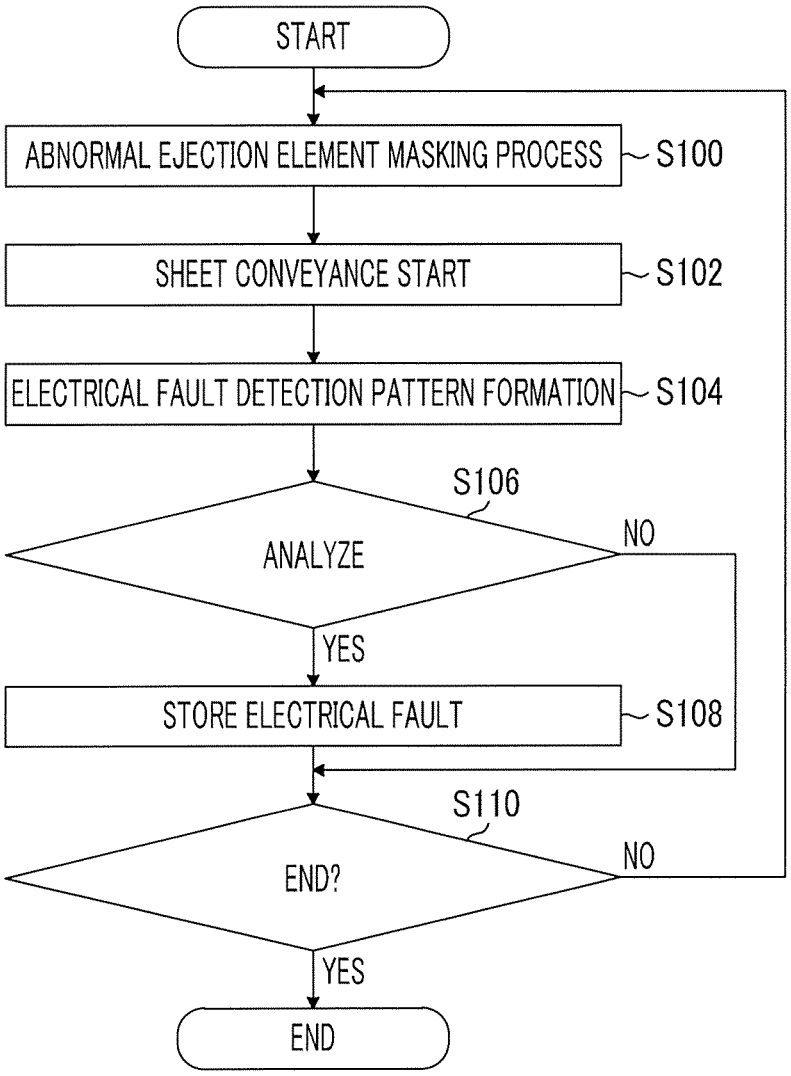
FIG. 26 is a flowchart illustrating a flow of a procedure of an electrical fault detection method according to the second embodiment.

FIG. 26 is a flowchart illustrating a flow of a procedure of an electrical fault detection method according to the second embodiment. When the electrical fault detection is started, a masking process is performed on an abnormal ejection element in an abnormal ejection element masking processing step S100. For the abnormal ejection element masking processing step S100, the same process as the abnormal ejection element masking processing step S10 illustrated in FIG. 15 can be applied. Here, description of the abnormal ejection element masking processing step S100 illustrated in FIG. 26 is omitted.

After the masking process is performed on the abnormal ejection element in the abnormal ejection element masking processing step S100, the process proceeds to a sheet conveyance start step S102. In the sheet conveyance start step S102, conveyance of the sheet 18 illustrated in FIG. 1 is started.

A head lowering step of lowering the inkjet head 12 illustrated in FIG. 9 may be included between the abnormal ejection element masking processing step S100 and the sheet conveyance start step S102.

After the conveyance of the sheet 18 illustrated in FIG. 1 is started in the conveyance start step S102 illustrated in FIG. 26, the process proceeds to an electrical fault detection pattern formation step S104 illustrated in FIG. 26. In the electrical fault detection pattern formation step S104, the electrical fault detection pattern 300 illustrated in FIG. 17 is formed with respect to the sheet 18 that is conveyed in the sheet conveyance direction.

In the electrical fault detection pattern formation step S104 illustrated in FIG. 26, ink is ejected from each ejection element 68 at the ejection timing illustrated in FIG. 17 and the electrical fault detection pattern 300 is formed.

In the electrical fault detection pattern formation step S104 illustrated in FIG. 26, the electrical fault detection pattern 300H illustrated in FIG. 25 may be formed.

After the electrical fault detection pattern 300 illustrated in FIG. 17 is formed in the electrical fault detection pattern formation step S104 illustrated in FIG. 26, the process proceeds to an electrical fault detection pattern analysis step S106 illustrated in FIG. 26.

For the electrical fault detection pattern analysis step S106, the same process as the electrical fault detection pattern analysis step S18 illustrated in FIG. 15 can be applied. Here, description of the electrical fault detection pattern analysis step S106 illustrated in FIG. 26 is omitted.

In the case of a No determination in the electrical fault detection pattern analysis step S106, the process proceeds to an end determination step S110. For the end determination step S110, the same process as the end determination step S22 illustrated in FIG. 15 can be applied. Here, description of the end determination step S110 illustrated in FIG. 26 is omitted.

In the case of a Yes determination in the electrical fault detection pattern analysis step S106 illustrated in FIG. 26, the process proceeds to an electrical fault storage step S108. For the electrical fault storage step S108, the same process as the electrical fault storage step S20 illustrated in FIG. 15 can be applied. Here, description of the electrical fault storage step S108 illustrated in FIG. 26 is omitted.

In the case of a No determination in the end determination step S110, the process proceeds to the abnormal ejection element masking processing step S100. Then, the processes from the abnormal ejection element masking processing step S100 to the end determination step S110 are repeatedly executed. In the case of a Yes determination in the end determination step S110, the electrical fault detection ends.

[Description of Effects of Second Embodiment]

According to the inkjet recording device and the electrical fault detection method according to the second embodiment, it is possible to achieve the following effects.

<First Effect>

It is possible to detect the electrical fault of the inkjet head 12 on the basis of a result of the analysis of the electrical fault detection pattern.

<Second Effect>

In a case where the arrangement of the dot arrays in the electrical fault detection pattern formed on the sheet 18 does not satisfy the predetermined arrangement condition with the arrangement of the ejection elements 68, or in a case where the number of dot arrays in the electrical fault detection pattern formed on the sheet 18 does not satisfy the predetermined dot array number condition, it is possible to determine that electrical fault occurs in the inkjet head 12.

<Third Effect>

Since the driving voltage application timing of the ejection elements arranged at the positions adjacent to each other in the first direction orthogonal to the relative conveyance direction or the oblique direction obliquely intersecting the first direction is located at the distance equal to or larger than the distance corresponding to the period of two ejection cycles, it is possible to separate and arrange the dot array formed using two ejection elements suspected of a short circuit, and it is easy to determine whether or not the arrangement of the dot arrays in the electrical fault detection pattern satisfies the predetermined arrangement condition with the arrangement of the plurality of ejection elements in the inkjet head 12.

<Fourth Effect>

Since the arrangement interval of the first dot set 304A formed using the ejection element group 69A of the first column and the second dot set 304B formed using the ejection element group 69B of the second column is a distance equal to or larger than the distance corresponding to the period of the two ejection cycles, the electrical fault detection pattern in which the arrangement of the first dot set 304A and the second dot set 304B in the sheet conveyance direction is emphasized can be formed.

Since the electrical fault detection pattern in which the arrangement of the first dot set 304A and the second dot set 304B in the sheet conveyance direction is emphasized can be formed, it is easy to determine whether or not the arrangement of the dot arrays 302 of the electrical fault detection pattern satisfies the predetermined arrangement condition with the arrangement of the ejection elements 68 in the inkjet head 12.

<Fifth Effect>

By adding the auxiliary pattern to each dot array 302, it is easy to recognize a correspondence relationship between the ejection elements and the dot arrays that is used to form the dot arrays. Since the auxiliary pattern of which the length is changed regularly in the sheet conveyance direction is formed, it is easy to recognize a correspondence relationship between the ejection elements and the dot arrays that is used to form the dot arrays.

Since the auxiliary pattern indicating the identification number of the ejection element is formed, it is easy to recognize a correspondence relationship between the ejection elements and the dot arrays that is used to form the dot arrays.

<Sixth Effect>

Since the auxiliary pattern thinned out in the sheet conveyance direction, the auxiliary pattern formed as a dotted line in the sheet conveyance direction, or the auxiliary pattern formed as of a broken line in the sheet conveyance direction is formed, it is easy to distinguish between the dot array and the auxiliary pattern.

Description of Electrical Fault Detection According to Third Embodiment

Next, electrical fault detection according to a third embodiment will be described. In the third embodiment to be described below, differences between the third embodiment and the first and second embodiments will be mainly described. The same configurations as those in the first and second embodiments will be appropriately omitted.

<Description of Matrix Arrangement of Ejection Element>

FIG. 27 is an illustrative diagram of a matrix arrangement of ejection elements. In a third embodiment to be described below, an inkjet head 12A in which a plurality of ejection elements 68 are arranged in a matrix form is applied. In the matrix arrangement of the plurality of ejection elements 68, the plurality of ejection elements 68 are arranged in a column direction along the sheet width direction and a row direction obliquely intersecting the sheet width direction.

If the plurality of ejection elements 68 are arranged in a matrix form, the plurality of ejection elements 68 are projected in the sheet width direction, and an arrangement interval of the ejection elements 68 in a projected ejection element group arranged in the sheet width direction is an equal interval.

In FIG. 27, the projection ejection element group is omitted. Further, in the drawings to be used in the following description, only some of the plurality of ejection elements 68 are illustrated. The matrix arrangement of the ejection elements is an aspect of a two-dimensional arrangement of ejection elements.

<Description of Electrical Fault Detection Pattern Formation>

Figure 28:
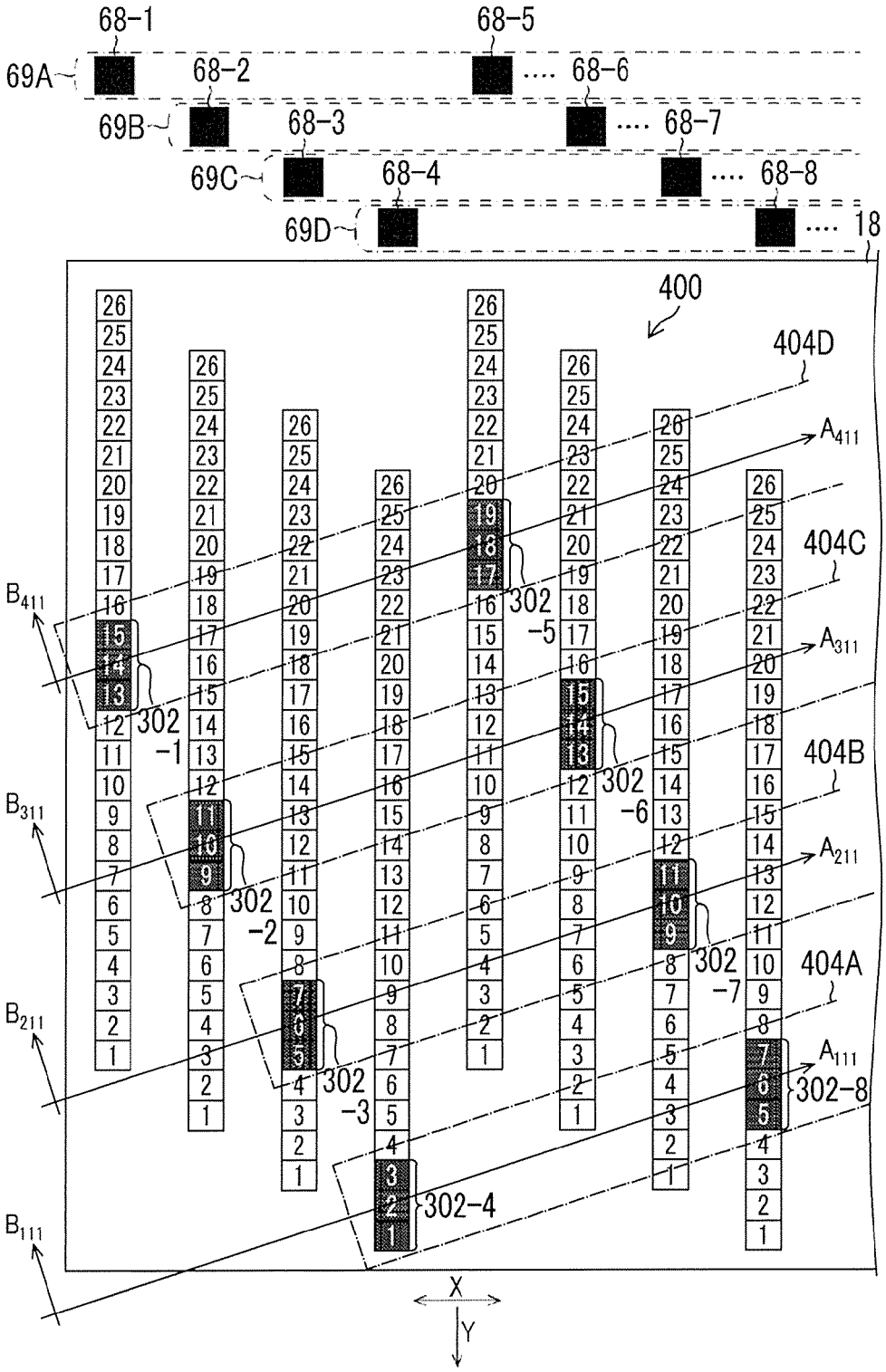
FIG. 28 is an illustrative diagram schematically illustrating an electrical fault detection pattern that is applied to an inkjet head in which ejection elements are arranged in a matrix form, which is an electrical fault detection pattern in a case where electrical fault does not occur.

FIG. 28 is an illustrative diagram schematically illustrating an electrical fault detection pattern that is applied to the inkjet head in which the ejection elements are arranged in a matrix form, which is an electrical fault detection pattern in a case where electrical fault does not occur.

In FIG. 28, an ejection element group 69A of a first row including the ejection element 68-1 and the ejection element 68-5, an ejection element group 69B of a second row including the ejection element 68-2 and the ejection element 68-6, an ejection element group 69C of a third row including the ejection element 68-3 and the ejection element 68-7, and an ejection element group 69D of a fourth row including the ejection element 68-4 and the ejection element 68-8 are illustrated.

The ejection element group 69A illustrated in FIG. 28 includes a plurality of ejection elements, in addition to the ejection element 68-1 and the ejection element 68-5. The same applies to the ejection element group 69B, the ejection element group 69C, and the ejection element group 69D.

The electrical fault detection pattern 400 illustrated in FIG. 28 includes the dot arrays 302-1 to 302-8. The electrical fault detection pattern 400 includes a plurality of dot arrays 302, in addition to the dot arrays 302-1 to 302-8.

The arrangement of the dot arrays 302 of the electrical fault detection pattern 400 satisfies the predetermined arrangement condition with the arrangement of the ejection elements 68 used for formation of the dot array 302 in a case where the same condition as that in the second embodiment is satisfied between the dot array set serving as an arbitrary dot array set and the other dot array set.

The dot array 302-4 and the dot array 302-8 are the first dot arrays, and a dot array set 404A including the first dot arrays is the first dot set.

The approximate straight line indicating the arrangement direction of the first dot arrays constituting the dot array set 404A is a first dot set first axis $A_{111}$. An axis orthogonal to the first dot set first axis $A_{111}$ is a first dot set second axis $B_{111}$.

The dot array 302-3 and the dot array 302-7 are second dot arrays, and the dot array set 404B including the second dot arrays is a second dot set. The approximate straight line indicating the arrangement direction of the dot arrays 302 constituting the dot array set 404B is a second dot set first axis $A2_{11}$. An axis orthogonal to the second dot set first axis $A2_{11}$ is a second dot set second axis $B2_{11}$.

For the first dot set second axis $B_{111}$, a maximum coordinate value of the dots constituting the dot array set 404A that is the first dot set is a coordinate value of the dot with a numerical value 7 in the dot array 302-8. Further, a minimum coordinate value of the dots constituting the dot array set 404B that is the second dot set is a coordinate value of the dot with a numerical value 5 in the dot array 302-3.

For the first dot set second axis $B_{111}$, a coordinate value of the dot with a numerical value 7 in the dot array 302-8 is smaller than the coordinate value of the dot with a numerical value 5 of the dot array 302-3.

Further, in a case where the dot array 302-2 and the dot array 302-6 are the second dot arrays, and the dot array set 404C including the dot array 302-2 and the dot array 302-6 that are the second dot arrays is the second dot set, a minimum coordinate value of the dot constituting the dot array set 404C in the first dot set second axis $B_{111}$ is a coordinate value of dot with a numerical value 9 in the dot array 302-2.

Therefore, in the first dot set second axis $B_{111}$, the coordinate value of the dot with the numerical value 7 in the dot array 302-8 is smaller than the coordinate value of the dot with the numerical value 9 in the dot array 302-2, and the dot arrangement of the dot array set 404A and the arrangement of the dot arrays of the dot array set 404C of the electrical fault detection pattern 400 satisfy the predetermined arrangement condition with the arrangement of the ejection elements 68.

Further, in a case where the dot array 302-1 and the dot array 302-5 are the second dot arrays, and a dot array set 404D including the dot array 302-1 and the dot array 302-5 that are the second dot arrays is a second dot set, a minimum coordinate value of the dots constituting the dot array set 404D in the first dot set second axis $B_{111}$ is a coordinate value of the dot with a numerical value 13 in the dot array 302-1.

Therefore, in the first dot set second axis $B_{111}$, the coordinate value of the dot with the numerical value 7 in the dot array 302-8 is smaller than the coordinate value of the dot with the numerical value 13 in the dot array 302-1, and the dot arrangement of the dot array set 404A and the arrangement of the dot arrays in the dot array set 404D of the electrical fault detection pattern 400 satisfy the predetermined arrangement condition with the arrangement of the ejection elements 68.

Further, reference sign $A_{211}$, reference sign $A_{311}$, and reference sign $A_{411}$ are the axis indicating the arrangement direction of the dot arrays 302 constituting the dot array set 404B, the axis indicating the arrangement direction of the dot arrays 302 constituting the dot array set 404C, and the axis indicating the arrangement direction of the dot arrays 302 constituting the dot array set 404D, respectively.

Further, a reference sign $B_{211}$, a reference sign $B_{311}$, and a reference sign $B_{411}$ are an axis orthogonal to the axis $A_{211}$, an axis orthogonal to the axis $A_{311}$, and an axis orthogonal to the axis $A_{411}$, respectively.

That is, in the electrical fault detection of the inkjet head in which M rows of ejection element groups in which the plurality of ejection elements are arranged in the first direction are arranged in a second direction intersecting the first direction, an electrical fault detection pattern to be shown below is formed.

In the inkjet head in which M is an integer equal to or greater than 2 and the M rows of ejection element groups 69 are included, the ejection element group on the most upstream side in the sheet conveyance direction is the ejection element group of the first row. i is an integer equal to greater than 2 and equal to or smaller than M, and j is an integer smaller than i, equal to greater than 1 and equal to or smaller than M-1.

A first dot array set in which a plurality of first dot arrays each including one or more dots formed by ejecting liquid from a plurality of respective ejection elements belonging to an ejection element group of a j-th row are arranged along the first dot set first axis is a first dot set. An approximate straight line indicating an arrangement direction of the plurality of second dot arrays is the first dot set first axis. A direction orthogonal to the first dot set first axis is the first dot set second axis.

A second dot array set in which a plurality of second dot arrays each including one or more dots formed by ejecting liquid from a plurality of respective ejection elements belonging to an ejection element group of a i-th row are arranged along the second dot set first axis is a second dot set. An approximate straight line indicating an arrangement direction of the plurality of second dot arrays is the second dot set first axis. A direction orthogonal to the second dot set first axis is the second dot set second axis.

The direction from the first dot set to the second dot set is a positive direction of the first dot set second axis and a positive direction of the second dot set second axis. For the first dot set second axis, a maximum coordinate value of the dots constituting the first dot set becomes a minimum coordinate value of the dots constituting the second dot set.

Further, the ejection element 68-4 and the ejection element 68-8 illustrated in FIG. 28 form one dot array 302. Similarly, each of the ejection element 68-3 and the ejection element 68-7, the ejection element 68-2 and the ejection element 68-9, and the ejection element 68-1 and the ejection element 68-5 forms one dot array 302.

The number of dot arrays 302 formed using the respective ejection elements 68 in the ejection element groups of any two rows are the same, and the electrical fault detection pattern 400 illustrated in FIG. 28 satisfies the predetermined dot array number condition.

Figure 29:
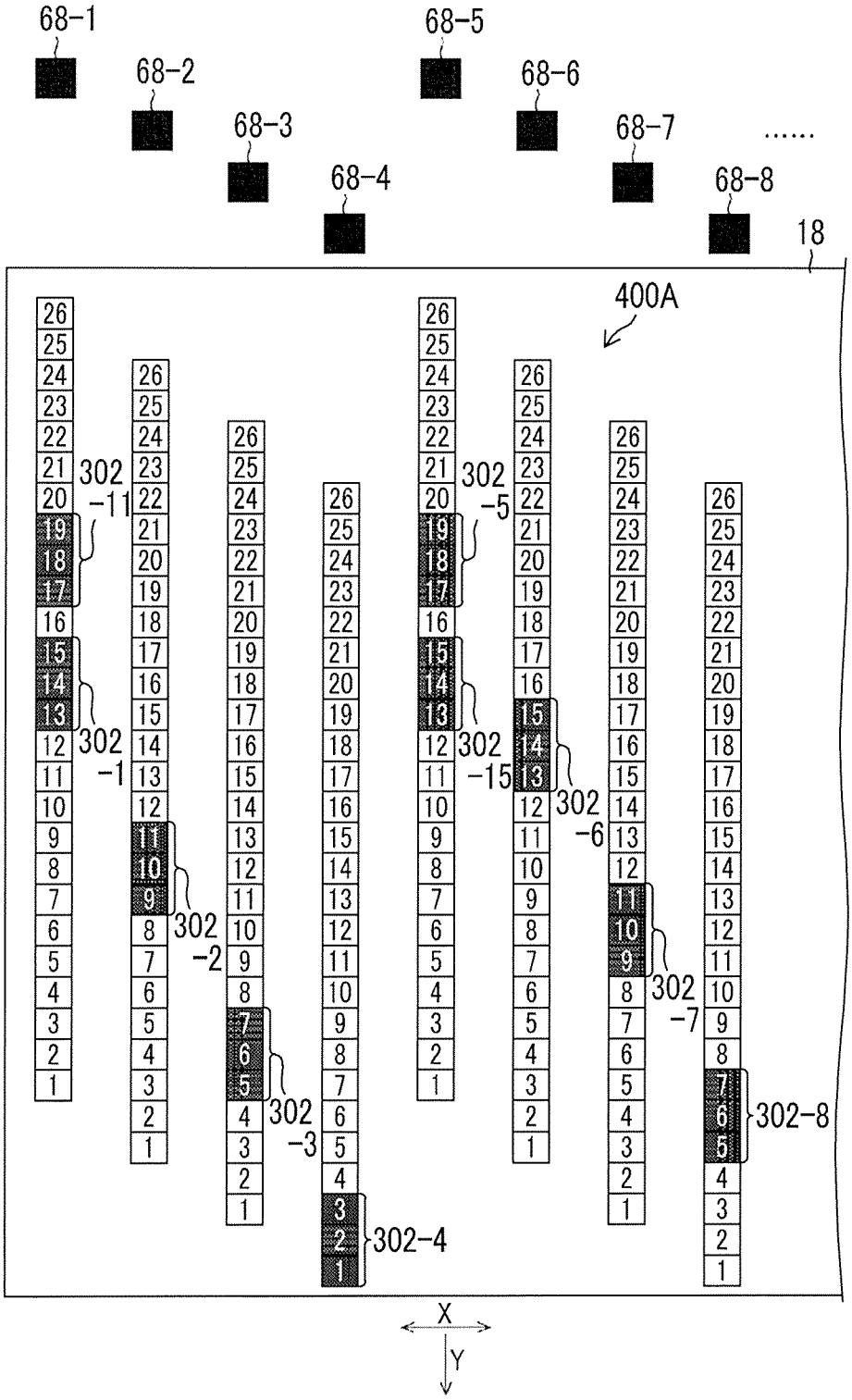
FIG. 29 is an illustrative diagram schematically illustrating an electrical fault detection pattern in a case where ejection elements are arranged in a matrix form, which is an electrical fault detection pattern in a case where electrical fault occurs.

FIG. 29 is an illustrative diagram schematically illustrating an electrical fault detection pattern in a case where ejection elements are arranged in a matrix form, which is an electrical fault detection pattern in a case where electrical fault occurs. In FIG. 29, the single dotted line indicating the dot set, the reference sign indicating the dot set, the axis, and the reference sign indicating the axis illustrated in FIG. 28 are not illustrated. The same applies to FIG. 30.

In the electrical fault detection pattern 400A illustrated in FIG. 29, the dot array 302-1 and the dot array 302-11 are formed the ejection element 68-1. Further, in the electrical fault detection pattern 400A, the dot array 302-5 and the dot array 302-15 are formed using the ejection element 68-5.

When attention is paid to the dot array set 404C and the dot array set 404D illustrated in. FIG. 29, a minimum coordinate value of the dots constituting the dot array set 404D that is the second dot set in the first dot set second axis $B_{111}$ illustrated in FIG. 28 is a coordinate value of a dot formed at a position with a numerical value 13 of the dot array 302-15. Then, a maximum coordinate value of the dots constituting the dot array set 404C that is the first dot set is a coordinate value of the dot formed at the position with the numerical value 15 of the dot array 302-6, and the minimum coordinate value of the second dot set exceeds the maximum coordinate value of the first dot set.

Thus, since the arrangement of the dot arrays constituting the electrical fault detection pattern 400 illustrated in FIG. 29 does not satisfy the predetermined arrangement condition with the arrangement of the ejection elements 68, it can be determined that electrical fault occurs in the inkjet head.

At the ejection timing indicated by the numerical value 17, the numerical value 18, and the numerical value 19, which is not originally the ejection timing of the ejection element 68-1, but is the ejection timing of the ejection element 68-5, the dot array 302-11 is formed using the ejection element 68-1.

Further, at the ejection timing indicated by the numerical value 13, the numerical value 14, and the numerical value 15, which is not originally the ejection timing of the ejection element 68-5, but is the ejection timing of the ejection element 68-1, the dot array 302-15 is formed.

That is, in the electrical fault detection pattern 400A illustrated in FIG. 29, the number of the dot arrays 302 formed using the respective ejection elements 68 in the ejection element group of any two rows may not be the same, and the electrical fault detection pattern 400 illustrated in FIG. 28 does not satisfy the predetermined dot array number condition.

Therefore, it can be determined that a short circuit occurs between the ejection element 68-1 and the ejection element 68-5 on the basis of the electrical fault detection pattern 400A.

<Description of Modification Example of Electrical Fault Detection Pattern>

Figure 30:
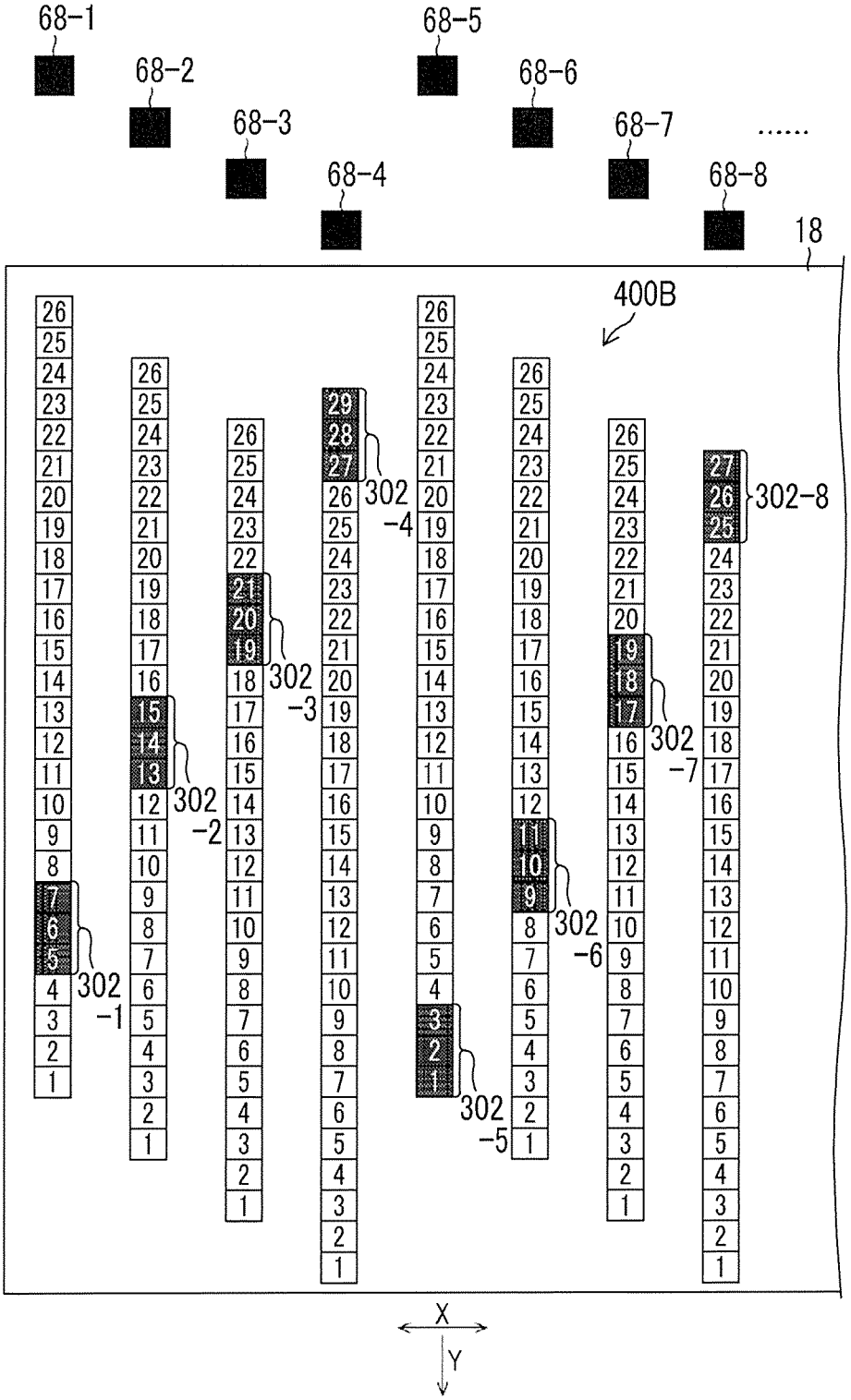
FIG. 30 is an illustrative diagram of a modification example of the electrical fault detection pattern illustrated in FIG. 28.

FIG. 30 is an illustrative diagram of a modification example of the electrical fault detection pattern illustrated in FIG. 28. An electrical fault detection pattern 400B illustrated in FIG. 30 is obtained by inverting the electrical fault detection pattern 400 illustrated in FIG. 28 in the sheet conveyance direction.

The electrical fault detection pattern 400B is formed in a case where electrical fault of the inkjet head does not occur, similar to the electrical fault detection pattern 300H illustrated in FIG. 25.

The electrical fault detection in the inkjet head 12A in which the plurality of ejection elements 68 are arranged in a matrix form, which has been described with reference to FIGS. 28 to 30, may be performed on the ejection element groups of at least two rows.

[Description of Modification Example of Inkjet Head]

<Description of First Modification Example>

FIG. 31 is an illustrative diagram of a first modification example of the inkjet head. The inkjet head 12B illustrated in FIG. 31 includes a plurality of ejection elements 68 that can form dots at the same position in the sheet width direction. In an inkjet head 12B illustrated in FIG. 31, only some of ejection elements are illustrated.

The inkjet head 12B includes an ejection element 68-201 that can form a dot at a position of a sheet 18 in which an ejection element 68-101 can form a dot in the sheet width direction.

The inkjet head 12B includes an ejection element 68-202, an ejection element 68-203, an ejection element 68-204, and an ejection element 68-205 that can form dots at positions of the sheet 18 in which an ejection element 68-102, an ejection element 68-103, an ejection element 68-104, and an ejection element 68-105 can form dots in the sheet width direction.

That is, the inkjet head 12B includes the ejection element 68-201, the ejection element 68-202, the ejection element 68-203, the ejection element 68-204, and the ejection element 68-205 functioning as redundant ejection elements for the ejection element 68-101, the ejection element 68-102, the ejection element 68-103, the ejection element 68-104, and the ejection element 68-105.

In electrical abnormality detection of the inkjet head 12B, the electrical fault detection pattern 400 illustrated in the third embodiment can be applied. That is, the ejection element 68-101, the ejection element 68-103, and the ejection element 68-105 form an ejection element group of a first row, and the ejection element 68-102 and the ejection element 68-104 form an ejection element group of a second row.

Further, the ejection element 68-201, the ejection element 68-203, and the ejection element 68-205 form an ejection element group of a third row, and the ejection element 68-202 and the ejection element 68-204 form an ejection element group of a fourth row.

In a case where the arrangement of the dot arrays included in the electrical fault detection pattern satisfies the predetermined arrangement condition with the arrangement of the ejection elements 68 used for formation of the dot arrays 302 included in the electrical fault detection pattern, and satisfies the predetermined dot array number condition in which the numbers of dot arrays formed using the respective ejection elements 68 are the same number, it can be determined that the electrical fault of the inkjet head 12B does not occur.

On the other hand, in a case where the arrangement of the dot arrays included in the electrical fault detection pattern does not satisfy the predetermined arrangement condition with the arrangement of the ejection elements 68 used for formation of the dot arrays 302 included in the electrical fault detection pattern or dose not satisfy the predetermined dot array number condition, it can be determined that the electrical fault of the inkjet head 12B occurs.

The inkjet head including the redundant ejection elements is an aspect of the liquid ejection head in which two or more ejection elements are arranged at the same position in the first direction.

<Description of Second Modification Example>

FIG. 32 is an illustrative diagram of a second modification example of the inkjet head. An inkjet head 12C illustrated in FIG. 32 includes a first head 12D and a second head 12E. The first head 12D includes ejection elements 68-105 to 68-101.

The second head 12E includes ejection elements 68-201 to 68-205. The ejection elements 68-201 to 68-205 function as redundant ejection elements of the ejection elements 68-101 to 68-105.

For electrical fault detection in the inkjet head 12C illustrated in. FIG. 32, the electrical fault detection pattern 300 illustrated in FIG. 17 can be applied to each of the first head 12D and the second head 12E.

That is, a short circuit does not occur between the ejection elements 68-101 to 68-105 included in the first head 12D and the ejection elements 68-201 to 68-205 included in the second head 12E.

Further, in fault of the switch element 62 illustrated in FIG. 10, the switch element 62 electrically connected to the ejection element 68 included in the first head 12D and the switch element 62 electrically connected to the ejection element 68 included in the second head 12E are not related to each other.

Thus, in the electrical fault detection in the inkjet head 12C, the electrical fault detection pattern 300 illustrated in FIG. 17 can be applied to each of the first head 12D and the second head 12E.

<Description of Third Modification Example>

FIG. 33 is an illustrative diagram of a third modification example of the inkjet head. An inkjet head 12F illustrated in FIG. 33 includes a first head module 12G, a second head module 12H, and a third head module 12I.

In electrical fault detection of the inkjet head 12F, the first head module 12G and the third head module 12H form an ejection element group of a first row, the second head module 12H forms an ejection element group a second row, and the electrical fault detection pattern 300 illustrated in FIG. 17 can be applied.

Further, in a case where supply circuits for respective driving voltages of the first head module 12G, the second head module 12H, and the third head module 12I are independent, the electrical fault detection pattern 300 illustrated in FIG. 17 can be applied to each of the first head module 12G, the second head module 12H, and the third head module 12I.

Although not illustrated, the electrical abnormality detection of the inkjet head described above can be applied to an inkjet head having various ejection element arrangements or an inkjet head including a plurality of heads and having various head arrangements.

The image includes an image for use other than graphical use, such as a pattern of an electrical wiring or a pattern of a mask. For example, the pattern formation device in which an electrical wiring pattern is formed or a mask pattern formation device in which a mask pattern is formed is an aspect of the liquid ejection device.

As the ink, ink that can be ejected in a droplet state by applying the inkjet head, such as ink containing metal particles or ink containing resin particles, can be applied.

In the embodiment of the present invention described above, configuration requirements can be appropriately changed, added, or removed without departing from the scope of the present invention. The present invention is not limited to the above-described embodiments, and many modifications can be performed by those with ordinary skill in the art within the technical spirit of the present invention.

EXPLANATION OF REFERENCES

10: inkjet recording device
12, 12A, 12B, 12C, 12F: inkjet head
12D: first head
12E: second head
12G: first head module
12H: second head module
12I: third head module
13: lifting and lowering support member
14: tube
16: ink tank
18: sheet
20: sheet conveyance unit
22: conveyance belt
23: head lifting and lowering unit
23A: head support member
23B: actuator
23C: driving member
24, 24-1, 24-2, 24-3, 24-4, 24-5, 24-6, 24-7, 24-8, 24-9, 24-10, 24-11, 24-12, 24-13, 24-14, 24-15, 24-16: dot
25A: first dot set
25B: second dot set
30: system control unit
32: communication unit
34: image memory
36: conveyance control unit
37: head lifting and lowering control unit
38: image processing unit
40: ejection data acquisition unit
42: waveform storage unit
44: head driving unit
45: abnormal ejection element information storage unit
46: parameter storage unit
47: electrical fault information storage unit
48: program storage unit
49: detection information acquisition unit
50: head controller
52: digital-to-analog conversion circuit
54: amplification circuit
56: shift register
58: latch circuit
60: level conversion circuit
62, 62-1, 62-2, 62-3, 62-4, 62-5, 62-6, 62-7, 62-8, 62-9, 62-10, 62-11, 62-12, 62-13, 62-14, 62-15, 62-16: switch element
64: switch element integrated circuit
68, 68-1, 68-2, 68-3, 68-4, 68-5, 68-6, 68-7, 68-7, 68-8, 68-9, 68-10, 68-11, 68-12, 68-13, 68-14, 68-101,

68-102, 68-103, 68-104, 68-105, 68-201, 68-202, 68-203, 68-204, 68-205: ejection element
69, 69A, 69B, 69C, 69D: ejection element group
80: nozzle opening
82: nozzle plate
84: pressure chamber
86: vibration plate
88, 88-1, 88-2, 88-3, 88-4, 88-5, 88-6, 88-7, 88-8, 88-9, 88-10, 88-11, 88-12, 88-13, 88-14, 88-15, 88-16: piezoelectric element
90: supply port
94: upper electrode
96: lower electrode
98: piezoelectric body
99: flow path plate
100: flexible substrate
102, 102A, 102B, 104: electrical wiring
110: conductive material
200, 200A, 200B, 200C, 300, 300A, 300B, 300C, 300D, 300E, 300F, 300G, 300H, 400, 400A, 400B: electrical fault detection pattern
224A, 302, 302-1, 302-1A, 302-2, 302-2A, 302-3, 302-3A, 302-4, 302-5, 302-6, 302-7, 302-8, 302-9, 302-10, 302-11, 302-12, 302-13, 302-14: dot array
304A: first dot set
304B: second dot set
310, 310-11, 310-12, 310-21, 310-31, 310-31, 310-41, 310-42, 310-51, 310-52, 310A, 310B, 310C: first auxiliary pattern
320, 320-1, 320-2: second auxiliary pattern
330, 330-1, 330-2, 330-3, 330-4, 330-5: third auxiliary pattern
404A, 404B, 404C, 404D: dot array set
S10 to S22, S100 to S110: each step of electrical abnormality detection method

What is claimed is:

1. A pattern formation device that forms, in a medium, an electrical fault detection pattern that is used when electrical fault of a liquid ejection head is detected, by ejecting liquid from the liquid ejection head in which M rows of ejection element groups in which a plurality of ejection elements are arranged in a first direction are arranged in a second direction intersecting the first direction, M being an integer equal to or greater than 2, the pattern formation device comprising:

an ejection data acquisition unit that acquires ejection data of the electrical fault detection pattern when the electrical fault detection pattern is formed on a medium; and a driving voltage supply unit that supplies a driving voltage to each of the plurality of ejection elements on the basis of the ejection data acquired using the ejection data acquisition unit, wherein the ejection data acquisition unit acquires ejection data of the electrical fault detection pattern including a first dot set in which a plurality of first dot arrays each including one or more dots formed by ejecting liquid from a plurality of respective ejection elements belonging to an ejection element group of a j-th row are arranged along a first dot set first axis, and a second dot set in which a plurality of second dot arrays each including one or more dots formed by ejecting liquid from a plurality of respective ejection elements belonging to an ejection element group of an i-th row are arranged along a second dot set first axis, i being an integer equal to greater than 2 and equal to or smaller than M and j being an integer smaller than i, equal to greater than 1 and equal to or smaller than M−1, an approximate straight line indicating an arrangement direction of the plurality of first dot arrays being the first dot set first axis, an axis orthogonal to the first dot set first axis being a first dot set second axis, a direction from the first dot set to the second dot set being a positive direction of the first dot set second axis, and a maximum value of a coordinate value of the first dot set second axis of the plurality of first dot arrays being a value smaller than a minimum value of the coordinate value of the first dot set second axis of the plurality of second dot arrays.

2. The pattern formation device according to claim 1, wherein the ejection data acquisition unit acquires ejection data of the electrical fault detection pattern in which the plurality of respective ejection elements belonging to the ejection element group of the j-th row form the same number of first dot arrays, and the plurality of respective ejection elements belonging to the ejection elements of the i-th row form the same number of second dot arrays.

3. The pattern formation device according to claim 1, wherein the driving voltage supply unit supplies a driving voltage for forming the electrical fault detection pattern to the plurality of ejection elements in a state in which relative conveyance of the liquid ejection head and the medium is stopped.

4. The pattern formation device according to claim 1, wherein the driving voltage supply unit supplies a driving voltage for forming the electrical fault detection pattern to the plurality of ejection elements in a state in which the liquid ejection head and the medium are conveyed relatively in a relative conveyance direction.

5. The pattern formation device according to claim 4, wherein the ejection data acquisition unit acquires ejection data of the electrical fault detection pattern in which an arrangement interval of the dots formed using ejection elements that are arranged at positions adjacent to each other in the first direction or ejection elements that are arranged at positions adjacent to each other in an oblique direction obliquely intersecting the first direction is equal to or larger than a distance corresponding to a period of two ejection cycles.

6. The pattern formation device according to claim 4, wherein the ejection data acquisition unit acquires ejection data of the electrical fault detection pattern in which an arrangement interval in the relative conveyance direction of the first dot set and the second dot set exceeds an arrangement interval of the ejection elements in the first direction.

7. The pattern formation device according to claim 4, wherein the ejection data acquisition unit acquires ejection data of the electrical fault detection pattern including an auxiliary pattern formed on at least one of the upstream side in the relative conveyance direction and the downstream side in the relative conveyance direction for at least one of a plurality of patterns constituting the first dot set and the second dot set.

8. The pattern formation device according to claim 7, wherein the ejection data acquisition unit acquires the ejection data of the electrical fault detection pattern including the auxiliary pattern that is formed at a position thinned out in the first direction.

9. The pattern formation device according to claim 7, wherein the ejection data acquisition unit acquires the ejection data of the electrical fault detection pattern including the auxiliary pattern that includes dots having a diameter smaller than a diameter of dots constituting the first dot set and the second dot set.

10. The pattern formation device according to claim 7, wherein the ejection data acquisition unit acquires the ejection data of the electrical fault detection pattern including the auxiliary pattern that includes dots having a concentration lower than a concentration of dots constituting the first dot set and the second dot set.

11. The pattern formation device according to claim 7, wherein the ejection data acquisition unit acquires the ejection data of the electrical fault detection pattern including the auxiliary pattern of which a length in the relative conveyance direction is regularly changed.

12. The pattern formation device according to claim 11, wherein the ejection data acquisition unit acquires the ejection data of the electrical fault detection pattern including the auxiliary pattern that indicates an identification number of the plurality of ejection elements.

13. The pattern formation device according to claim 4, wherein the ejection data acquisition unit acquires ejection data of the electrical fault detection pattern in which the ejection element in which ejection abnormality occurs is not used.

14. A liquid ejection device, comprising:

a liquid ejection head in which M rows of ejection element groups in which a plurality of ejection elements are arranged in a first direction are arranged in a second direction intersecting the first direction, M being an integer equal to or greater than 2;

a relative conveyance unit that relatively conveys the liquid ejection head and a medium in a relative conveyance direction;

an ejection data acquisition unit that acquires ejection data of an electrical fault detection pattern when liquid is ejected from the plurality of ejection elements and the electrical fault detection pattern for detecting electrical fault of the liquid ejection head is formed on a medium; and a driving voltage supply unit that supplies a driving voltage to each of the plurality of ejection elements on the basis of the ejection data acquired using the ejection data acquisition unit, wherein the ejection data acquisition unit acquires ejection data of the electrical fault detection pattern including a first dot set in which a plurality of first dot arrays each including one or more dots formed by ejecting liquid from a plurality of respective ejection elements belonging to an ejection element group of a j-th row are arranged along a first dot set first axis, and a second dot set in which a plurality of second dot arrays each including one or more dots formed by ejecting liquid from a plurality of respective ejection elements belonging to an ejection element group of an i-th row are arranged along a second dot set first axis, i being an integer equal to greater than 2 and equal to or smaller than M and j being an integer smaller than i, equal to greater than 1 and equal to or smaller than M−1, an approximate straight line indicating an arrangement direction of the plurality of first dot arrays being the first dot set first axis, an axis orthogonal to the first dot set first axis being a first dot set second axis, a direction from the first dot set to the second dot set being a positive direction of the first dot set second axis, and a maximum value of a coordinate value of the first dot set second axis of the plurality of first dot arrays being a value smaller than a minimum value of the coordinate value of the first dot set second axis of the plurality of second dot arrays.

15. The liquid ejection device according to claim 14, wherein the ejection data acquisition unit acquires ejection data of the electrical fault detection pattern in which the plurality of respective ejection elements belonging to the ejection element group of the j-th row form the same number of first dot arrays, and the plurality of respective ejection elements belonging to the ejection elements of the i-th row form the same number of second dot arrays.

16. The liquid ejection device according to claim 14, further comprising one or more liquid ejection heads for each of a plurality of colors, wherein the ejection data acquisition unit acquires ejection data of the electrical fault detection pattern including an auxiliary pattern formed on at least one of the upstream side in the relative conveyance direction and the downstream side in the relative conveyance direction for at least one of a plurality of patterns constituting the first dot set and the second dot set, the ejection data of the electrical fault detection pattern being ejection data of the electrical fault detection pattern including the auxiliary pattern in which color different from those of the first dot set and the second dot set is used.

17. The liquid ejection device according to claim 14, further comprising a head movement unit that changes a distance between the liquid ejection head and the medium supported by the relative conveyance unit, wherein when the electrical fault detection pattern is formed, the head movement unit causes an interval between the liquid ejection head and the medium to be shorter than that in a case where normal liquid ejection is performed.

18. The liquid ejection device according to claim 14, wherein the liquid ejection head has a structure in which the plurality of ejection elements are arranged in a two-dimensional form.

19. The liquid ejection device according to claim 14, wherein the ejection data acquisition unit acquires ejection data of the electrical fault detection pattern for forming the electrical fault detection pattern using all of the ejection elements included in the liquid ejection head.

20. The liquid ejection device according to claim 14, wherein in the liquid ejection head, two or more ejection elements are arranged at the same position in the first direction.

21. An electrical fault detection method of detecting electrical fault of a liquid ejection head in which M rows of ejection element groups in which a plurality of ejection elements are arranged in a first direction are arranged in a second direction intersecting the first direction, M being an integer equal to or greater than 2, the method comprising:

an ejection data acquisition step of acquiring ejection data of an electrical fault detection pattern when the electrical fault detection pattern that is used when electrical fault of the liquid ejection head is detected is formed on a medium;

a driving voltage supply step of supplying a driving voltage to each of the plurality of ejection elements on the basis of the ejection data acquired in the ejection data acquisition step; and a determination step of analyzing the electrical fault detection pattern formed on the medium and determining whether or not there is electrical fault of the liquid ejection head, wherein the ejection data acquisition step includes acquiring ejection data of the electrical fault detection pattern including a first dot set in which a plurality of first dot arrays each including one or more dots formed by ejecting liquid from a plurality of respective ejection elements belonging to an ejection element group of a j-th row are arranged along a first dot set first axis, and a second dot set in which a plurality of second dot arrays each including one or more dots formed by ejecting liquid from a plurality of respective ejection elements belonging to an ejection element group of an i-th row are arranged along a second dot set first axis, i being an integer equal to greater than 2 and equal to or smaller than M and j being an integer smaller than i, equal to greater than 1 and equal to or smaller than M−1, an arrangement direction of the plurality of first dot arrays being the first dot set first axis, an axis orthogonal to the first dot set first axis being a first dot set second axis, a direction from the first dot set to the second dot set being a positive direction of the first dot set second axis, and a maximum value of a coordinate value of the first dot set second axis of the plurality of first dot arrays being a value smaller than a minimum value of the coordinate value of the first dot set second axis of dots constituting the plurality of second dot arrays.

22. The electrical fault detection method according to claim 21, wherein the ejection data acquisition step includes acquiring ejection data of the electrical fault detection pattern in which the plurality of respective ejection elements belonging to the ejection element group of the j-th row form the same number of first dot arrays, and the plurality of respective ejection elements belonging to the ejection elements of the i-th row form the same number of second dot arrays.

23. The electrical fault detection method according to claim 21, wherein the driving voltage supply step includes supplying a driving voltage for forming the electrical fault detection pattern to the plurality or ejection elements in a state in which relative conveyance of the liquid ejection head and the medium is stopped, and the determination step includes determining whether or not there is electrical fault of the liquid ejection head on the basis of areas of the dots in the electrical fault detection pattern.

24. The electrical fault detection method according to claim 21, wherein the driving voltage supply step includes supplying a driving voltage for forming the electrical fault detection pattern to the plurality of ejection elements in a state in which the liquid ejection head and the medium are conveyed relatively in a relative conveyance direction, and the determination step includes determining whether or not there is electrical fault of the liquid ejection head on the basis of whether or not an arrangement relationship among an arrangement of the first dot arrays, an arrangement of the second dot arrays, an arrangement of the plurality of ejection elements belonging to the ejection element group of the j-th row, and an arrangement of the plurality of ejection elements belonging to the ejection element group of the i-th row satisfies a predetermined arrangement condition.

25. The electrical fault detection method according to claim 24, wherein the determination step includes determining whether or not there is electrical fault of the liquid ejection head on the basis of at least one of whether or not the number of the first dot arrays formed by the plurality of respective ejection elements belonging to the ejection element group of the j-th row satisfies a predetermined dot array number condition and whether or not the number of the second dot arrays formed by the plurality of respective ejection elements belonging to the ejection element group of the i-th row satisfies a predetermined dot array number condition.

* * * * *